US012031316B2

(12) United States Patent
Adams et al.

(10) Patent No.: US 12,031,316 B2
(45) Date of Patent: Jul. 9, 2024

(54) BEAM TO COLUMN CONNECTION

(71) Applicant: MITEK HOLDINGS, INC, Wilmington, DE (US)

(72) Inventors: Jared J Adams, Mission Viejo, CA (US); Behzad Rafezy, Laguna Niguel, CA (US); Quang Minh Huynh, San Diego, CA (US)

(73) Assignee: MITEK HOLDINGS, INC., Wilmington, DE (US)

( * ) Notice: Subject to any disclaimer, the term of this patent is extended or adjusted under 35 U.S.C. 154(b) by 0 days.

(21) Appl. No.: 17/097,752

(22) Filed: Nov. 13, 2020

(65) Prior Publication Data

US 2021/0140167 A1 May 13, 2021

Related U.S. Application Data

(60) Provisional application No. 62/934,967, filed on Nov. 13, 2019.

(51) Int. Cl.
*E04B 1/24* (2006.01)
*E04H 9/02* (2006.01)

(52) U.S. Cl.
CPC ..... *E04B 1/2403* (2013.01); *E04H 9/021* (2013.01); *E04B 2001/2415* (2013.01); *E04B 2001/2418* (2013.01); *E04B 2001/2466* (2013.01)

(58) Field of Classification Search
CPC ..... E04B 1/2403; E04B 2001/2418; E04B 2001/2466; E04H 9/021; E04H 9/024
USPC ..... 52/234, 236.3
See application file for complete search history.

(56) References Cited

U.S. PATENT DOCUMENTS 574,433 A * 1/1897 Keithley ..... E04B 1/2403 52/444
1,970,965 A * 8/1934 Leake ..... E04B 1/2403 403/230
2,441,890 A * 5/1948 Larkin ..... E04B 1/2403 52/838

(Continued)

FOREIGN PATENT DOCUMENTS

CN 107816131 A 3/2018
CN 108331163 A 7/2018

(Continued)

OTHER PUBLICATIONS

International Search Report & Written Opinion dated Feb. 11, 2021 in related PCT application PCT/US20/60488, 15 pages.

(Continued)

*Primary Examiner* — Brian E Glessner
*Assistant Examiner* — Adam G Barlow
(74) *Attorney, Agent, or Firm* — Stinson LLP

(57) ABSTRACT

A joint connection structure of a building framework includes a column assembly including a column and a pair of gusset plates connected to the column on opposite sides of the column and extending laterally outward from the column. A beam assembly includes a beam having upper and lower flanges and an end portion received between the gusset plates. The beam assembly is bolted to the column assembly. A channel is attached to one of the column and beam to facilitate connection of the beam assembly to the column assembly. The channel defines an elongate slot for attaching the channel to said one of the column and beam.

13 Claims, 51 Drawing Sheets

(56) References Cited

U.S. PATENT DOCUMENTS 2,607,450 A * 8/1952 Horowitz ..... E04B 1/2403 403/217
3,672,711 A * 6/1972 Red ..... E04C 3/40 52/283
5,412,913 A * 5/1995 Daniels ..... E04B 1/24 52/236.7
5,660,017 A * 8/1997 Houghton ..... E04H 9/024 52/283
5,680,737 A 10/1997 Sheipline
6,138,427 A * 10/2000 Houghton ..... E04B 1/2403 52/655.1
6,516,583 B1 * 2/2003 Houghton ..... E04B 1/24 52/638
7,178,296 B2 * 2/2007 Houghton ..... E04B 1/24 52/261
7,231,742 B2 6/2007 Majlessi
8,122,672 B2 * 2/2012 Houghton ..... E04B 1/24 52/657
8,146,322 B2 * 4/2012 Karns ..... E04H 9/02 52/657
8,176,706 B2 * 5/2012 Houghton ..... E04B 1/24 52/657
8,205,408 B2 * 6/2012 Houghton ..... E04B 1/24 52/657
8,635,834 B2 * 1/2014 Houghton ..... E04B 1/24 52/657
8,959,747 B2 2/2015 Calhoun et al.
9,091,065 B2 * 7/2015 Tran ..... E04B 1/388
9,441,360 B2 9/2016 Matteson
9,506,239 B2 * 11/2016 Houghton ..... E04H 9/024
9,523,188 B2 12/2016 Rahimzadeh et al.
9,988,808 B2 6/2018 Rahimzadeh et al.
10,273,677 B2 4/2019 Green
10,316,507 B2 * 6/2019 Richards ..... E04H 9/024
10,584,477 B2 * 3/2020 Richards ..... E04B 1/98
10,689,876 B2 * 6/2020 Richards ..... E04H 9/024
10,711,450 B2 7/2020 Green
10,760,261 B2 * 9/2020 Richards ..... E04C 3/06
10,900,215 B1 * 1/2021 Alrubaidi ..... E04H 9/024
11,002,011 B2 5/2021 Small et al.
2002/0184836 A1 * 12/2002 Takeuchi ..... E04C 3/04 52/289
2005/0204684 A1 * 9/2005 Houghton ..... E04B 1/24 52/653.1
2005/0229509 A1 10/2005 Majlessi
2006/0265992 A1 11/2006 Hiragaki
2007/0163204 A1 * 7/2007 Ceba ..... E04B 1/2403 52/741.1
2008/0016793 A1 1/2008 Majlessi
2008/0178551 A1 7/2008 Porter
2009/0162138 A1 6/2009 Burger et al.
2010/0043347 A1 * 2/2010 Houghton ..... E04B 1/24 52/745.19
2010/0043348 A1 * 2/2010 Houghton ..... E04B 1/24 52/848
2011/0030305 A1 * 2/2011 Karns ..... E04B 1/2403 52/655.1
2011/0252743 A1 10/2011 Yang
2013/0167358 A1 7/2013 Calhoun et al.
2014/0083046 A1 * 3/2014 Yang ..... E04B 1/2403 52/704
2015/0275501 A1 * 10/2015 Houghton ..... E04H 9/024 52/854
2016/0002910 A1 1/2016 Green
2016/0032580 A1 2/2016 Rahimzadeh et al.
2016/0130798 A1 5/2016 Rahimzadeh
2016/0208478 A1 7/2016 Matteson
2016/0356033 A1 * 12/2016 Houghton ..... E04B 1/2403
2017/0218616 A1 * 8/2017 Richards ..... E04H 9/024
2018/0094420 A1 * 4/2018 Houghton ..... E04H 9/021
2018/0274223 A1 * 9/2018 Richards ..... E04C 3/06
2018/0347222 A1 * 12/2018 Richards ..... E04H 9/021
2019/0211543 A1 7/2019 Abernathy et al.
2019/0249410 A1 8/2019 Richards
2019/0257071 A1 8/2019 Green
2020/0018067 A1 1/2020 Small et al.
2021/0140167 A1 5/2021 Adams et al.

FOREIGN PATENT DOCUMENTS

JP 2000328650 A 11/2000
JP 2003313945 A 11/2003
WO 9622428 A1 7/1996

OTHER PUBLICATIONS

Extended European Search Report for Application No. 20837920.6, dated Sep. 13, 2022, 9 pages, Munich, Germany.
Examination Report from EP Application No. 20851404.2, dated Jan. 2, 2024, 5 pages.
Notification of Reasons for Refusal, and translation thereof, from JP Application No. 2022-527862, dated Feb. 19, 2024, 8 pages.
Notification of Reasons for Refusal, and translation thereof, from JP Application No. 2022-527863, dated Apr. 2, 2024, 19 pages.

* cited by examiner

BEAM TO COLUMN CONNECTION

CROSS-REFERENCE TO RELATED APPLICATIONS

The present application claims the benefit of, and priority to, U.S. Provisional Application Ser. No. 62/934,967, which was filed Nov. 13, 2019, the entirety of which is incorporated herein by reference for all purposes.

FIELD

The present disclosure is directed to beam to column connections including at least one channel attached to at least one of the beam and column to facilitate the connection of the beam to the column. The channel provides a structure whose dimensions are more easily kept within relatively tight tolerance to ensure proper fit between the beam and column during erection of a building framework.

BACKGROUND

It has been found in a moment-resisting building having a structural steel framework, that most of the energy of an earthquake, or other extreme loading condition, is absorbed and dissipated, in or near the beam-to-column joints of the building.

In the structural steel construction of moment-resisting buildings, towers, and similar structures, most commonly in the past, the flanges of beams were welded to the face of columns by full-penetration, single bevel, groove welds. Thus, the joint connection was comprised of highly-restrained welds connecting a beam between successive columns. Vertical loads, that is, the weight of the floors and loads superimposed on the floors, were and still are assumed by many to be carried by vertical shear tabs or pairs of vertical, structural angle irons arranged back-to-back, bolted or welded to the web of the beam and bolted or welded to the face of the column.

The greater part of the vertical load placed upon a beam was commonly assumed to be carried by a shear tab bolted or welded to the web of the beam and bolted or welded to the face of the flange of the column at each end of the beam. Through the use of face-to-face gusset plates welded to the column, the greater part of the vertical load is carried by the gusset plates.

Experience has shown that the practice of welding the beam's flanges directly to the column is uncertain and/or unsuitable for resistance to earthquakes, explosions, tornadoes and other disastrous events. Such connection means and welding practice has resulted in sudden, fractured welds, the pulling of divots from the face of the column flange, cracks in the column flange and column web, and various other failures. Such highly-restrained welds do not provide a reliable mechanism for dissipation of earthquake energy, or other large forces, and can lead to brittle fracture of the weld and the column, particularly the flange of the column and the web of the column in the locality of the beam-to-column joint, (known as the "panel zone").

It is desirable to achieve greater strength, ductility and joint rotational capacity in beam-to-column connections in order to make buildings less vulnerable to disastrous events. Greater connection strength, ductility and joint rotational capacity are particularly desirable in resisting sizable moments in both the lateral and the vertical plane. That is, the beam-to-column moment-resisting connections in a steel frame building can be subjected to large rotational demands in the vertical plane due to interstory lateral building drift. Engineering analysis, design and full-scale specimen testing have determined that prior steel frame connection techniques can be substantially improved by strengthening the beam-to-column connection in a way which better resists and withstands the sizable beam-to-column, joint rotations which are placed upon the beam and the column. That is, the beam-to-column connection must be a strong and ductile, moment-resisting connection.

Reference is made to co-assigned U.S. Pat. Nos. 5,660,017, 6,138,427, 6,516,583, and 8,205,408 (Houghton et al.) for further discussion of prior practice and the improvement of the structural connection between beams and columns through the use of gusset plates. These patents illustrate the improvements that have been manifested commercially in the construction industry by Houghton and others in side plate technology. Initially, side plate construction was introduced to greatly improve the quality of the beam-to-column connection. Further improvements included the provision of side plate technology using full length beams to achieve greater economy and to facilitate more conventional erection techniques.

SUMMARY

In one aspect, a joint connection structure of a building framework generally comprising a column assembly including a column and a pair of gusset plates connected to the column on opposite sides of the column and extending laterally outward from the column. A beam assembly includes a beam having upper and lower flanges and an end portion received between the gusset plates. The beam assembly is bolted to the column assembly. A channel attached to one of the column and beam facilitates connection of the beam assembly to the column assembly. The channel defines an elongate slot for attaching the channel to said one of the column and beam.

In another aspect, a prefabricated column assembly generally comprises a column including a flange having side edges. A channel attached directly to the flange includes a base section and a pair of arms projecting outward from sides of the base section. The base section extends laterally past the side edges of the flange. A pair of gusset plates attached directly to the channel on opposite sides of the column extend laterally outward from the column.

In still another aspect, a prefabricated beam assembly generally comprises a beam including a flange having side edges. A channel attached directly to the flange includes a base section and a pair of arms projecting outward from sides of the base section. The base section extends laterally past the side edges of the flange.

In a further aspect of the present invention, a prefabricated column assembly generally comprises a column including a flange. First connecting members are bolted to an outer surface of the flange, and second connecting members are bolted to an inner surface of the flange. A pair of gusset plates extending laterally outward from the column. Bolts attaching the gusset plates to the first and second connecting members on opposite sides of the column.

Other features of the present invention will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
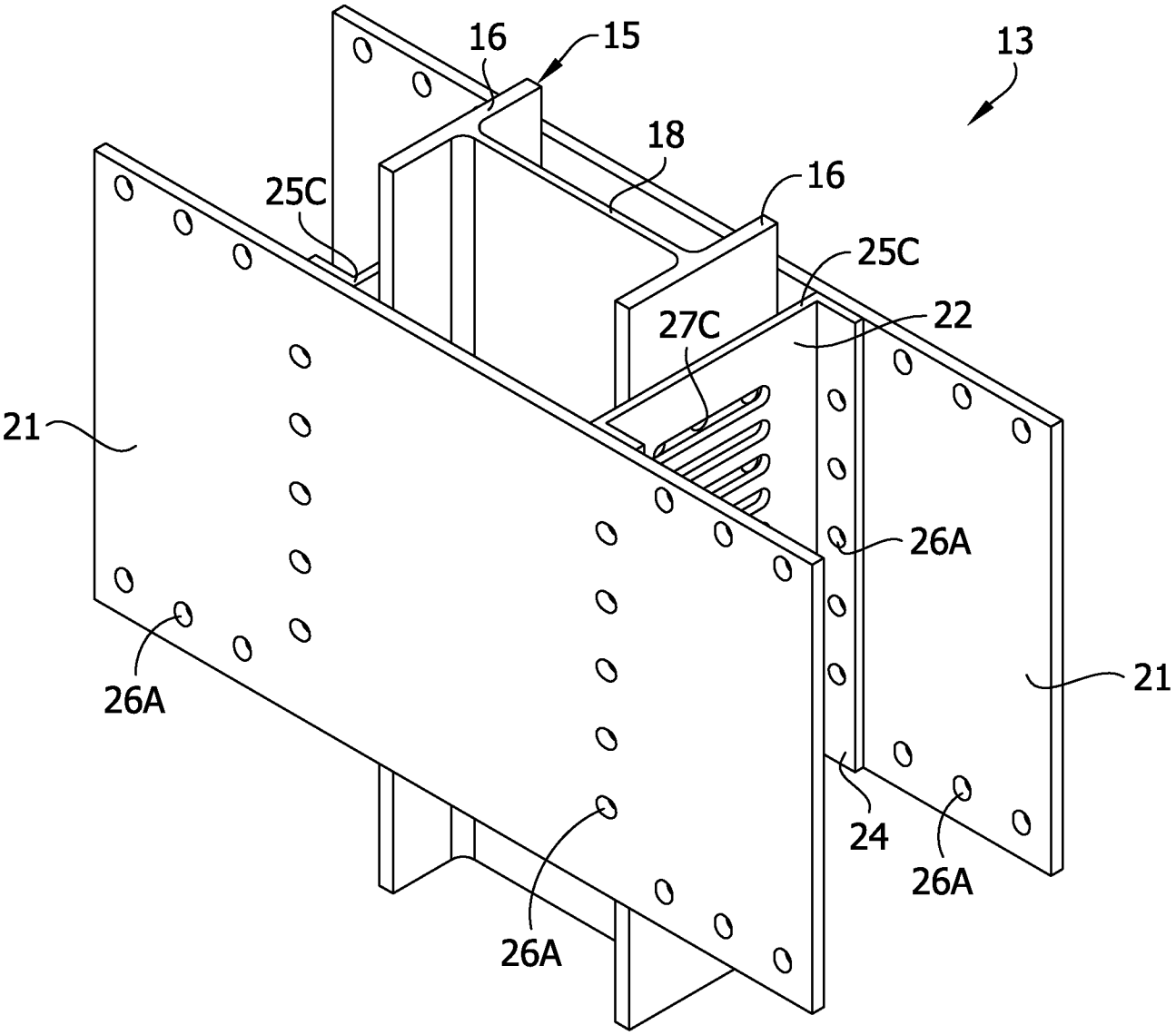
FIG. 1 is a fragmentary perspective of a column assembly for use in a beam-to-column joint connection structure.
Figure 2:
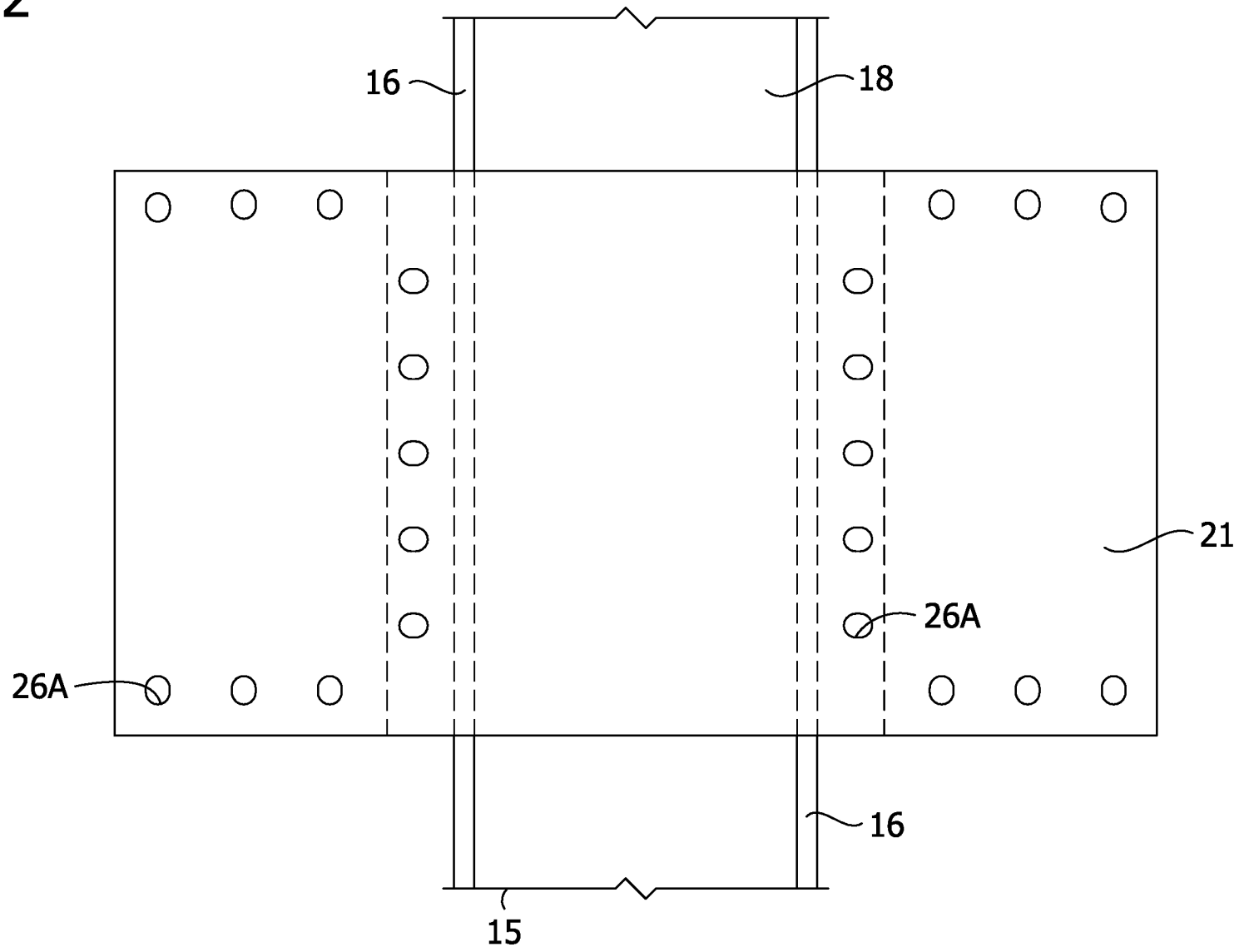
FIG. 2 is a front view of the column assembly in FIG. 1.

Referring to FIGS. 1-12, a beam-to-column moment-resisting joint connection structure of the present disclosure is shown. The joint connection structure may be used in the construction of a building framework. In the illustrated embodiment, the joint connection joins a column assembly 13 (FIG. 1) including a column 15 to a full-length beam assembly 17 (FIG. 5) including a full-length beam 19. In the illustrated embodiment, the column 15 is an I-beam or H-beam column whereby the column includes flanges 16 and web 18 extending between the flanges. However, the column 15 could have other configurations, such as a hollow tube of any suitable cross sectional shape (e.g., HSS column), without departing from the scope of the disclosure. Similarly, the full-length beam 19 is an I-beam or H-beam including flanges and a web extending between the flanges. However, the beam could have other configurations, such as a hollow tube of any suitable cross sectional shape (e.g., HSS beam). As used herein "full-length" refers to a beam which is a unitary piece having a length that is sufficient to extend the full length between adjacent columns 15 in the building framework. However, a beam need not be "full-length" to fall within the scope of the present invention.

Referring to FIGS. 1-4, a spaced apart pair of parallel, vertically and horizontally extending gusset plates 21 sandwich the column 15, and the beam 19 when the beam assembly 17 (shown in FIG. 5) is attached to the column assembly 13. A channel 25C (broadly, a "connecting member") is disposed on a beam-facing surface 28 (FIG. 4) of each flange 16 of the column 15. Thus, the column assembly 13 includes a pair of channels 25C attached to respective beam-facing surfaces 28 of the flanges 16 (broadly, a "side surface of the column"). Each channel 25C has a length extending along a length of the column 15, and a width extending generally perpendicular to the length of the column and generally parallel to a width of the column. The width of the column 15 extends between longitudinally extending side edges of the flanges 16. The width of the channels 25C is greater than the width of the column 15 such that the channels extend laterally outward past the longitudinally extending edges of the flanges 16 on opposite sides of the column.

Figure 3A:
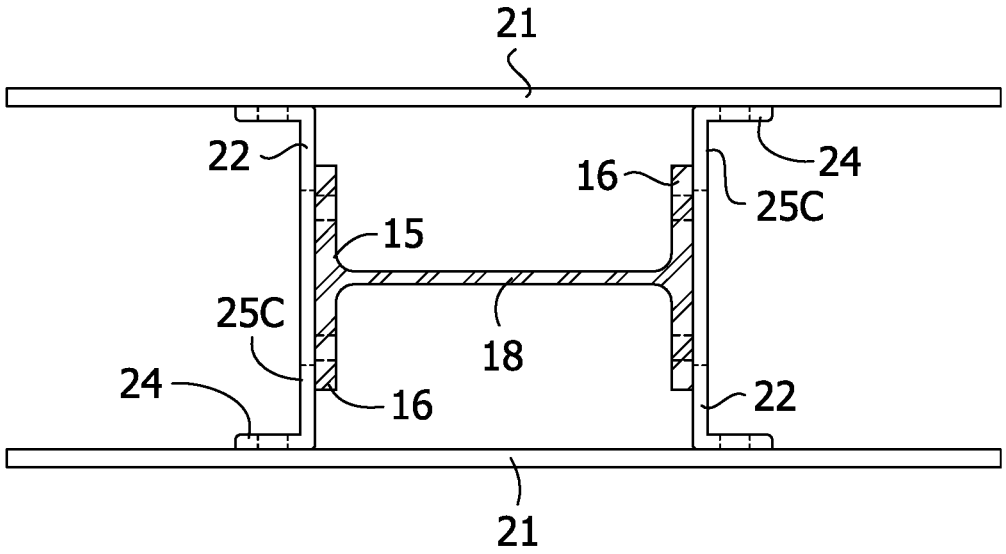
FIG. 3A is a top view of the column assembly in FIG. 1.
Figure 3B:
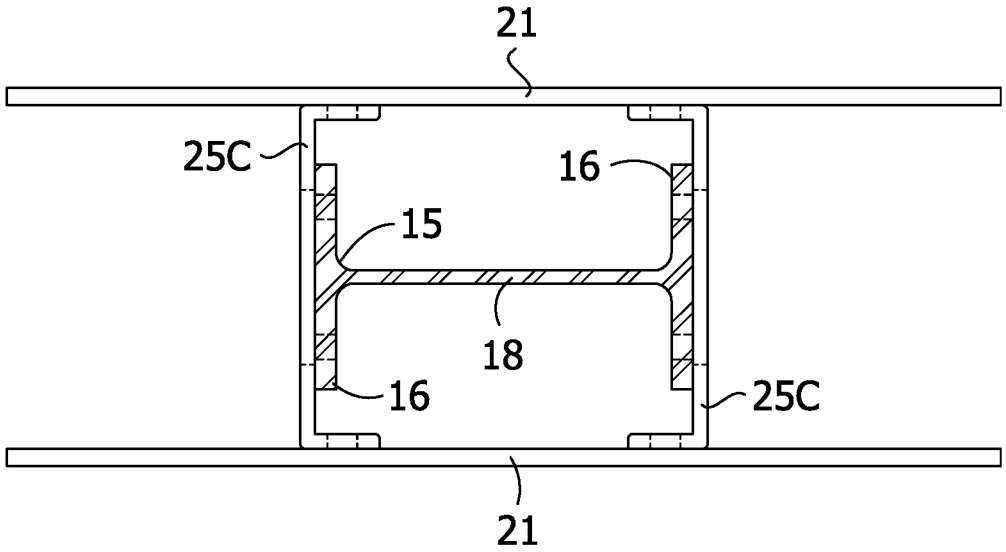
FIG. 3B is a top view of the column assembly showing channels of the column assembly in an alternate configuration.
Figure 4:
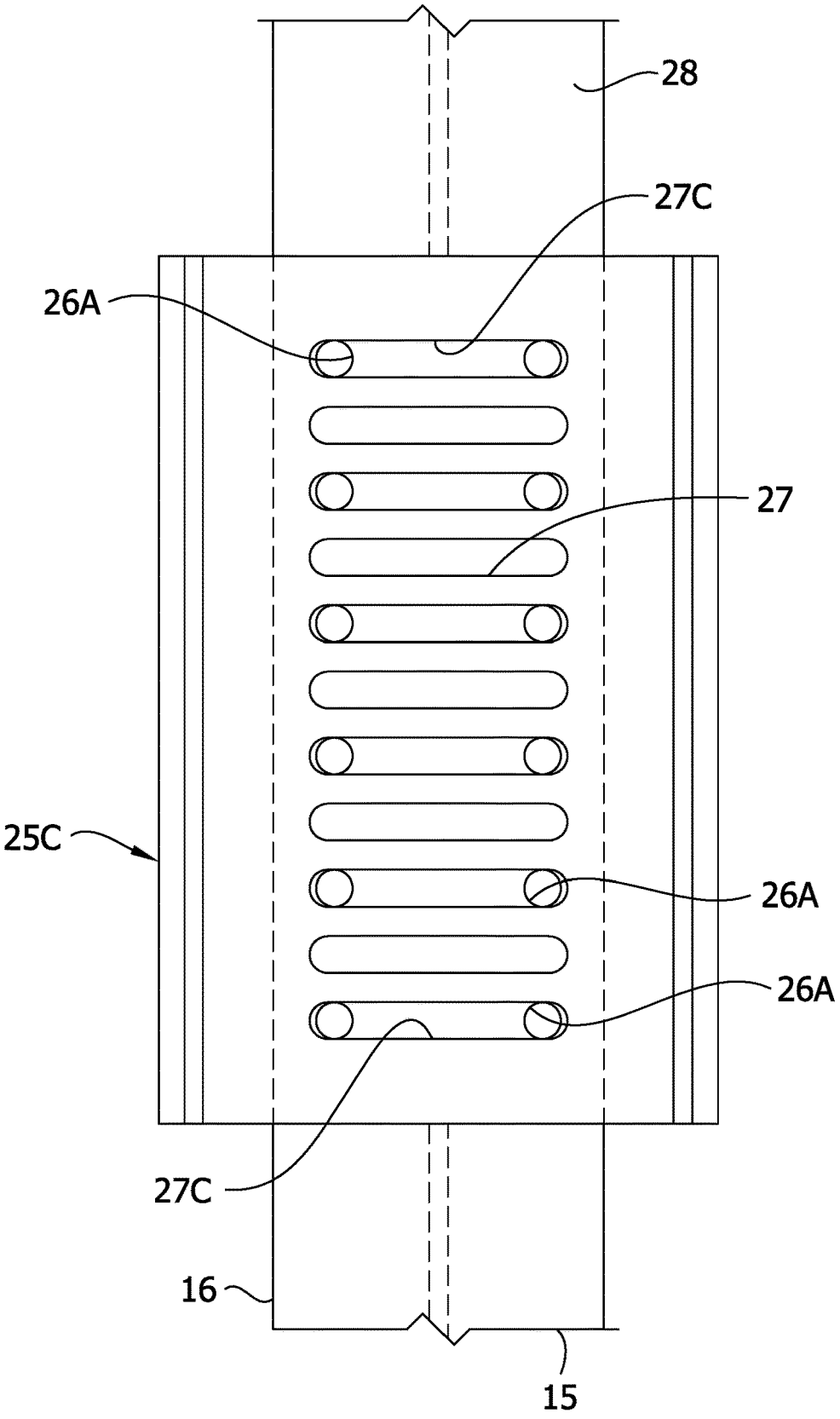
FIG. 4 is a side view of the column assembly in FIG. 1
Figure 5:
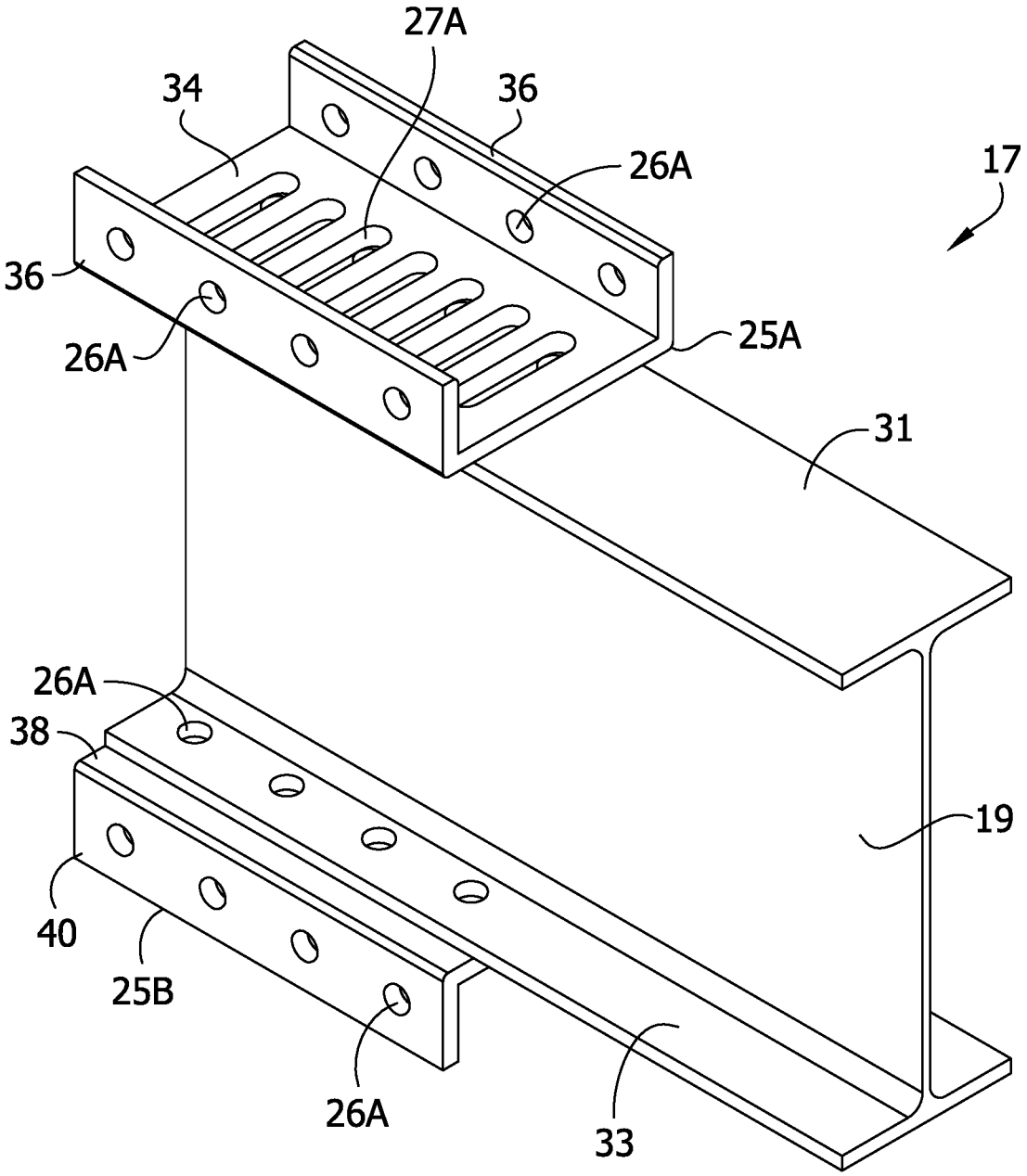
FIG. 5 is a fragmentary perspective of a full-length beam assembly for use with the column assembly in FIG. 1.
Figure 6:
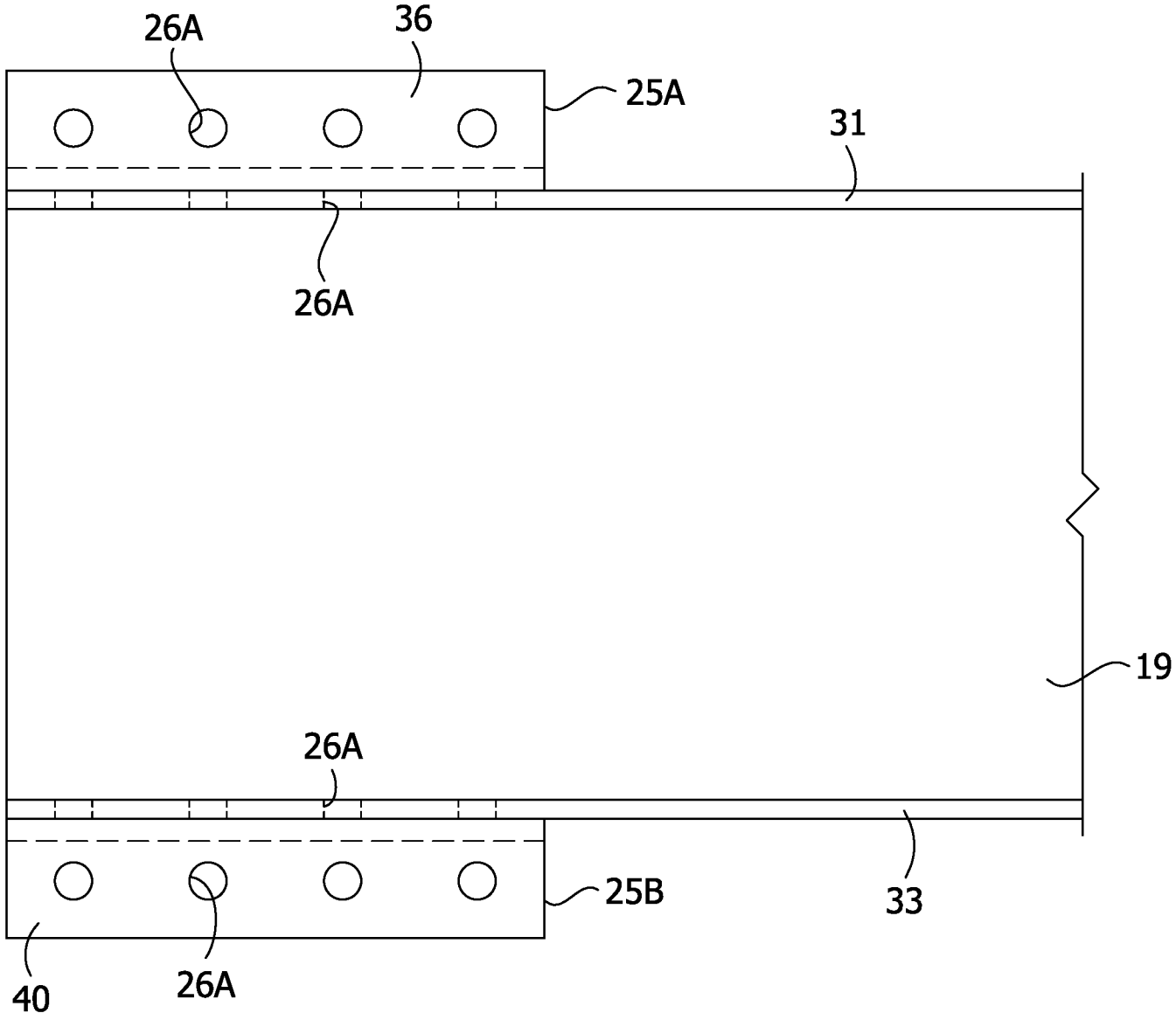
FIG. 6 is a front view of the beam assembly in FIG. 5.
Figure 7A:
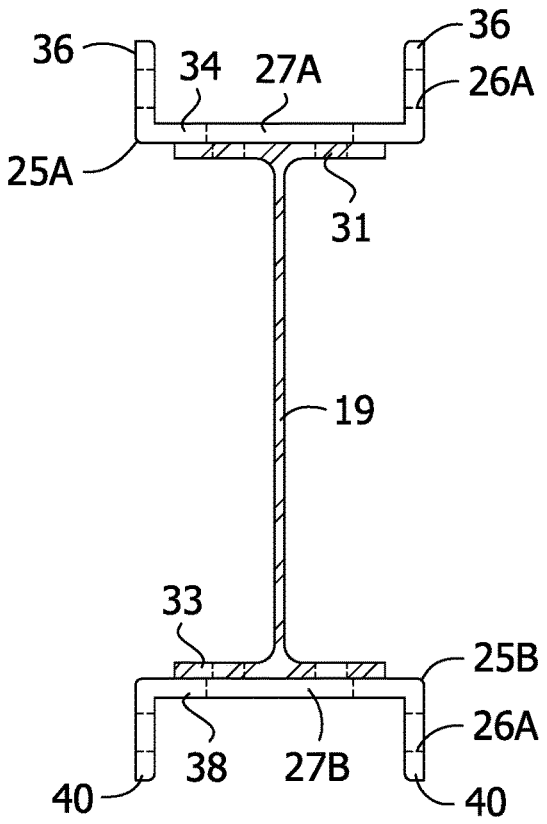
FIG. 7A is a side view of the beam assembly in FIG. 5.
Figure 7B:
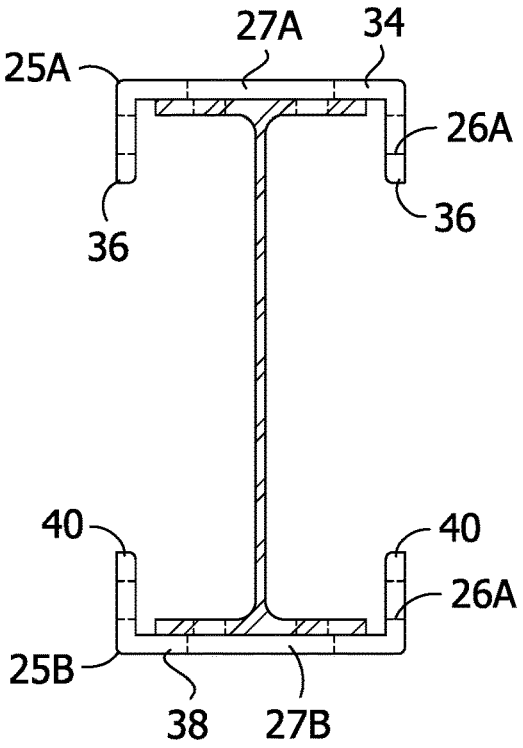
FIG. 7B is a side view of the beam assembly showing channels of the beam assembly in an alternate configuration.
Figure 8:
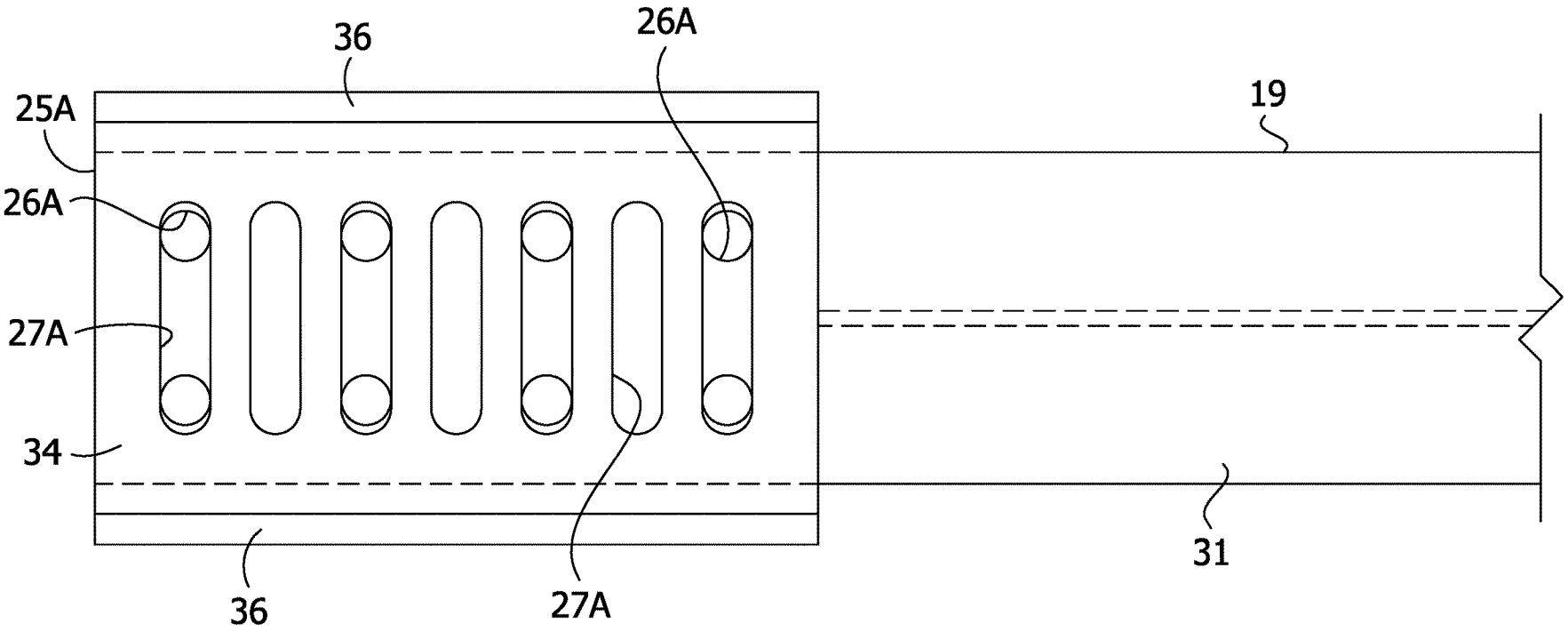
FIG. 8 is a top view of the beam assembly in FIG. 5.

Referring to FIGS. 1 and 3A, the channels 25C connect the gusset plates 21 to opposite sides of the column 15. In the illustrated embodiment, the channels 25C have a U-shaped cross section defined by a vertical extending base section 22 attached to one of the beam-facing surfaces 28 of the column 15, and a pair of arms 24 bent away from the base section. The arms 24 project outward from the base section 22 in a direction extending generally perpendicular to the length of the column. The base section 22 of the channel 25C may be attached to the column 15 in any suitable manner. In one embodiment, the base section 22 of each channel 25C is bolted to the respective beam-facing surface 28 of the column 15 by bolts (not shown) extending through bolt holes 26A in the column aligned with elongate slots 27C in the channel 25C (FIG. 4). In the illustrated embodiment, horizontally extending and vertically spaced apart slots 27C are formed in the base section 22 of the channels 25C and are positionable to align with circular bolt holes 26A in the beam-facing surface 28 of the column flanges 16. In one embodiment, a slot 27C is configured to align with a pair of horizontally spaced bolt holes 26A in the column flange 16. Thus, the column flanges 16 include vertically spaced apart pairs of bolt holes 26A. The horizontal extension of the slots 27C accounts for variations in the lateral spacing between the two bolt holes 26A in a horizontal pair. Thus, the slots 27C ensure that the bolt holes 26A will be aligned within an opening in the channel 25C for receiving bolts to attach the channel to the column 15. Therefore, the slots 27C provide advantages over circular bolt holes which do not forgive misalignment with the circular bolt holes 26A in the flange 16 of the column 15.

Additionally, at least one of the slots 27C in a channel 25C may be intentionally out of alignment with the horizontal pairs of bolt holes 26A in the associated flange 16 of the column 15 (FIG. 4). A misaligned slot 27C may be configured to function as a yield point for the joint connection such that under an extreme load the joint connection will fail at the channel 25C, and more particularly at one or more of the misaligned slots 27C of the channel, before the column 15 or the beam 19. In the illustrated embodiment, aligned and misaligned slots 27C are alternately disposed along the length of the channel 25C. Accordingly, the vertical spacing of the bolt holes 26A in the flanges 16 generally corresponds to the vertical distance between every other slot 27C in the channel 25C. Other arrangements and slot configurations may be used within the scope of the invention.

As can be seen from the figures, the channels 25C, rather than the column 15 itself, provide the structure for attaching the gusset plates 21 to the column 15. In particular, an outer surface of the arms 24 of the channel 25C are bolted to an inner surface of a respective gusset plate 21 by vertically spaced bolts (not shown) extending through aligned bolt holes 26A in the arms of the channel and the respective gusset plate. In the illustrated embodiment, the gusset plates 21 extend past both flanges of the column 15 in a direction parallel to the beam 19 such that they sandwich beams on two sides of the column. Thus, a channel 25C is disposed on both flanges 16 of the column 15. However, it will be understood that the column assembly 13 may include a channel 25C on only one of the flanges 16. One advantage of the channels 25C is that they can be produced to very close tolerances (i.e., a closer tolerance than the column 15) to insure that the gusset plates 21 are properly spaced from each other to allow for connection of the beam assembly 17 to the column assembly 13. This better ensures that the beam assembly 17 can be received between the gusset plates with appropriate clearance for attaching the beam assembly to the column assembly 13 at a construction site. The channels 25C may be formed as one piece of material or as many pieces fixed rigidly together at controlled spacings.

Figure 9:
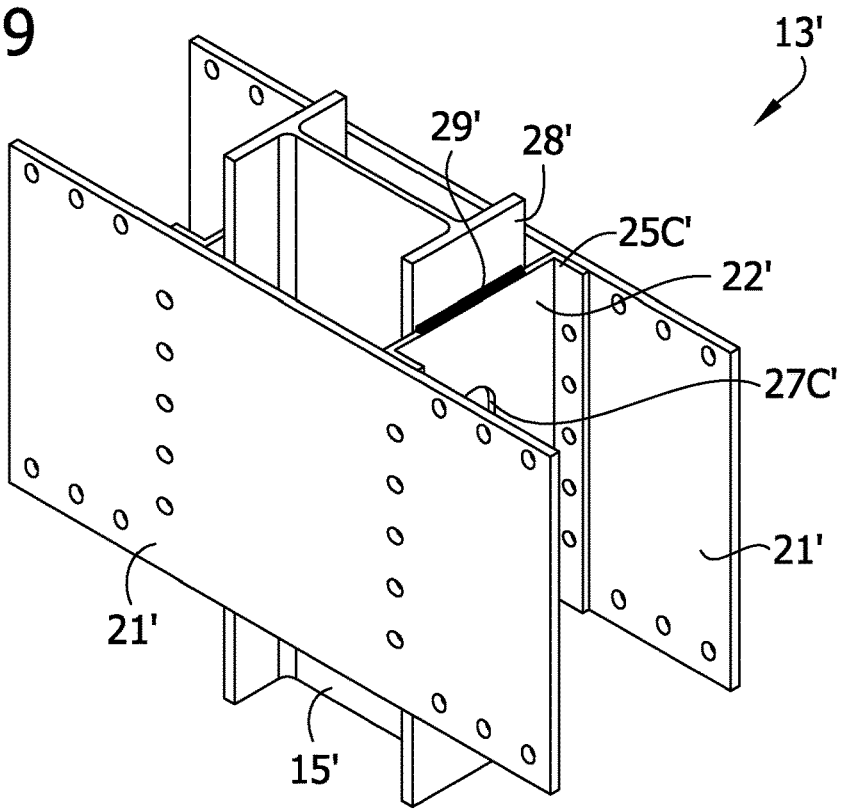
FIG. 9 is a fragmentary perspective of a column assembly of another embodiment for use in a beam-to-column joint connection structure.
Figure 10:
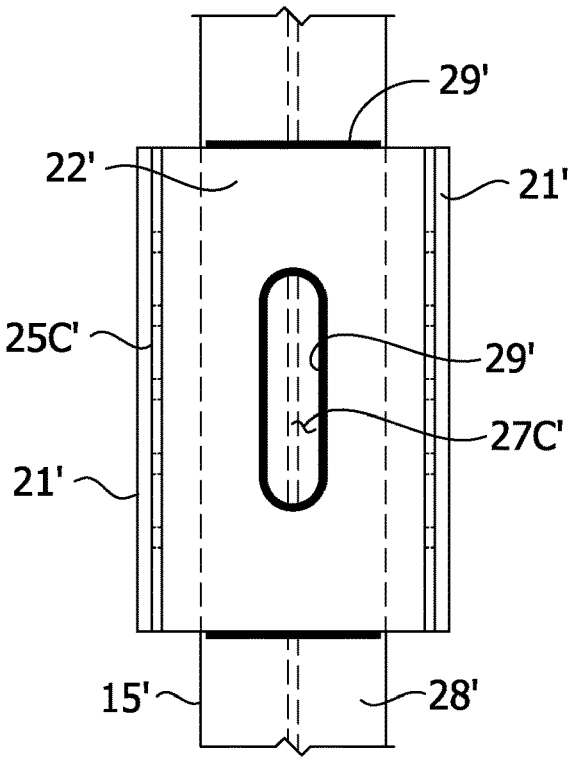
FIG. 10 is a side view of the column assembly in FIG. 9.

Alternatively, instead of the plurality of vertically spaced slots 27C, a column assembly 13' of another embodiment may include a channel 25C' having a single closed oblong radiused opening 27C' extending along the length of the base section 22' of the channel 25C' (FIGS. 9 and 10). In this embodiment, the channel 25C' may be welded to the column 15' at welds 29'. The welds may extend along transversely extending (top and bottom) longitudinal edges of the base section 22 and the beam-facing surface 28' of the column flange 16'. A weld 29' may also be disposed in the closed oblong radiused opening 27A. The gusset plates 21' may be bolted to the column 15'.

Referring to FIGS. 5-8, a channel 25A (broadly, "a connecting member") may be disposed on an upper flange 31 (broadly, a "top surface") of the beam 19 generally at an end of the beam. The channel 25A has a length extending along a length of the beam 19, and a width extending generally perpendicular to the length of the beam 19 and generally parallel to a width of the beam. The width of the beam 19 extends between opposite longitudinal extending edges of a flange (e.g., upper flange 31 or lower flange 33) of the beam 19. The width of the channel 25A is greater than the width of the beam 19 such that the channel extends laterally past the longitudinally extending edges of the upper flange 31 of the beam 19 on opposite sides of the beam. The channel 25A is U-shaped in cross section as defined by a horizontal base section 34 attached to the upper flange 31 of the beam 19, and a pair of vertical arms 36 bent upward from the base section. The arms 36 project from the base section 34 in a direction extending generally perpendicular to the length of the beam. The base section 34 of the channel 25A may be attached to the beam 19 in any suitable manner. In one embodiment, the base section 34 of the channel 25A is bolted to the upper flange of the beam 19 by bolts (not shown) extending through bolt holes 26A in the beam aligned with elongate slots 27A in the channel 25A. In the illustrated embodiment, horizontally extending and horizontally spaced apart slots 27A are formed in the base section 34 of the channel 25A and are positionable to align with circular bolt holes 26A in the upper flange 31. The bolt holes 26A are arranged in pairs that are spaced apart along the length of the beam 19. Each slot 27A extends along a direction generally perpendicular to the length of the beam 19, and the slots are spaced apart from an adjacent slot along a direction generally parallel to the length of the beam. In one embodiment, a slot 27A is configured to align with one of the pairs of horizontally spaced bolt holes 26A in the upper flange 31.

The channel 25A connects the gusset plates 21 to the upper flange 31 of the beam 19 when the beam is received between the gusset plates. The horizontal extension of the slots 27A accounts for variations in the lateral spacing between the two bolt holes 26A in a horizontal pair. Thus, the slots 27A ensure that the bolt holes 26A will be aligned within an opening in the channel 25A for receiving bolts to attach the channel to the beam 19. Therefore, the slots 27A provide advantages over circular bolt holes which do not forgive misalignment with the circular bolt holes 26A in the upper flange 31 of the beam 19.

Additionally, at least one of the slots 27A in the channel 25A may be intentionally out of alignment with the horizontal pairs of bolt hole pairs 26A in the upper flange 31 of the beam 19. A misaligned slot 27A may be configured to function as a yield point for the joint connection such that under an extreme load, the joint connection will fail at the channel 25A before the beam 19 or column 15. In the illustrated embodiment, aligned and misaligned slots 27A are alternately disposed along the length of the channel 25A. Accordingly, the horizontal spacing of the bolt holes 26A in the upper flange 31 generally corresponds to the horizontal distance between every other slot 27A in the channel 25A. Other arrangements and slot configurations may be used within the scope of the invention.

As can be seen from the figures, the channel 25A, rather than the beam 19 itself, provides the structure for attaching the gusset plates 21 to the beam. In particular, an outer surface of the arms 36 of the channel 25A are bolted to an inner surface of a respective gusset plate 21 by horizontally spaced bolts (not shown) extending through aligned bolt holes 26A in the arms of the channel and the respective gusset plate. Accordingly, the channel 25A provides the structure for attaching the gusset plates 21 to the beam 19. One advantage of the channel 25A is that it can be produced to very close tolerances (i.e., a closer tolerance than the beam 19) to insure that the connection points for attaching to the gusset plates 21 are properly spaced from each other to allow for connection of the beam assembly 17 to the column assembly 13. This better ensures that the beam assembly 17 can be received between the gusset plates with appropriate clearance for attaching the beam assembly to the column assembly 13 at a construction site. The channels 25A-25C can be formed from one piece of material or many pieces fixedly connected together at controlled spacings.

Figure 11:
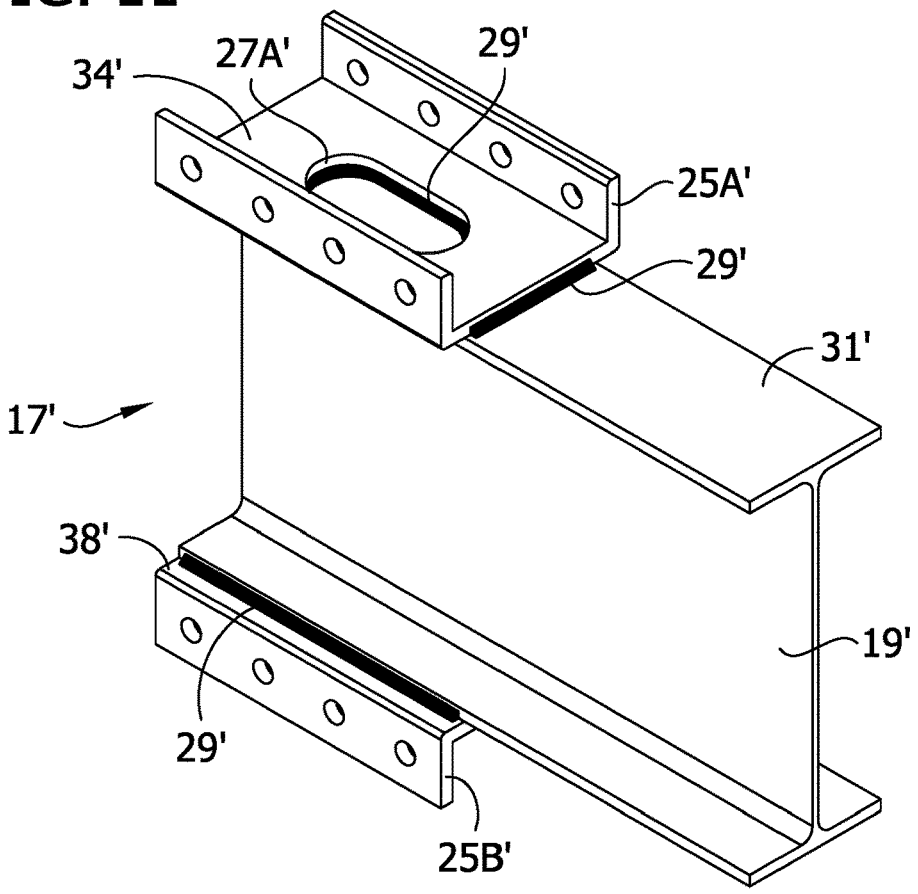
FIG. 11 is a fragmentary perspective of a full-length beam assembly of another embodiment for use with the column assembly in FIG. 9.
Figure 12:
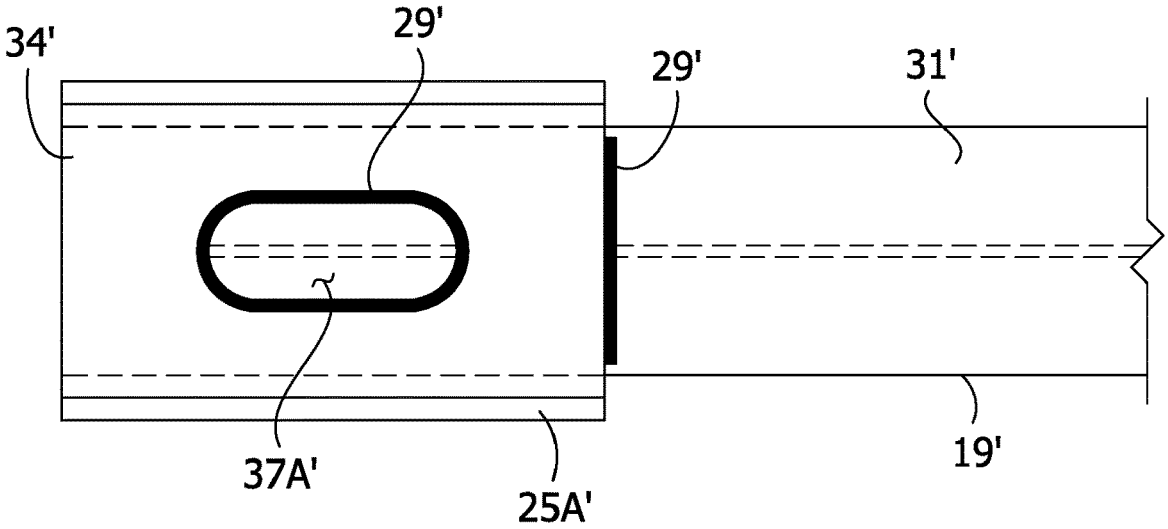
FIG. 12 is a top view of the beam assembly in FIG. 11.
Figure 13:
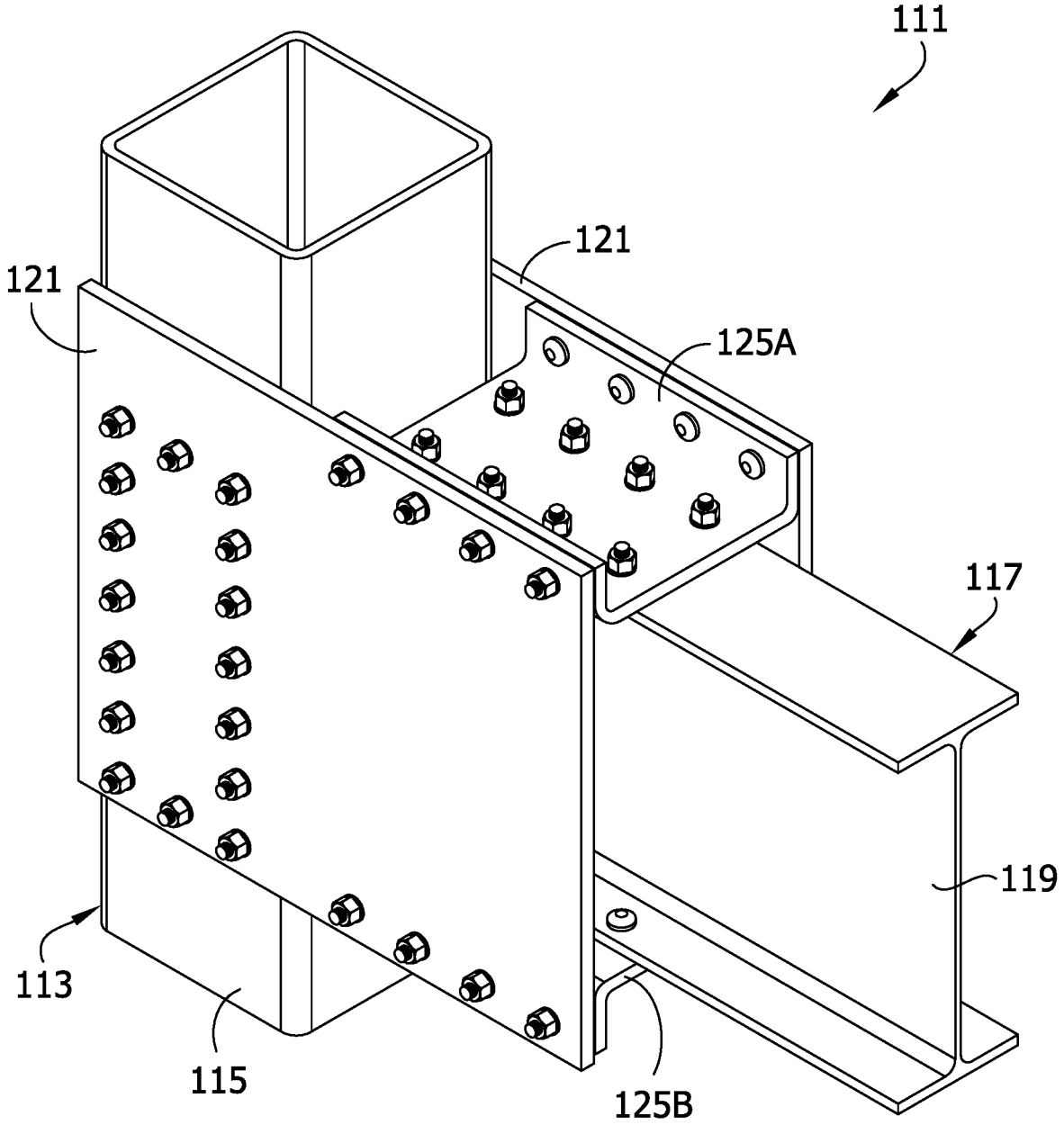
FIG. 13 is a fragmentary perspective of a beam-to-column joint connection structure of another embodiment.
Figure 14:
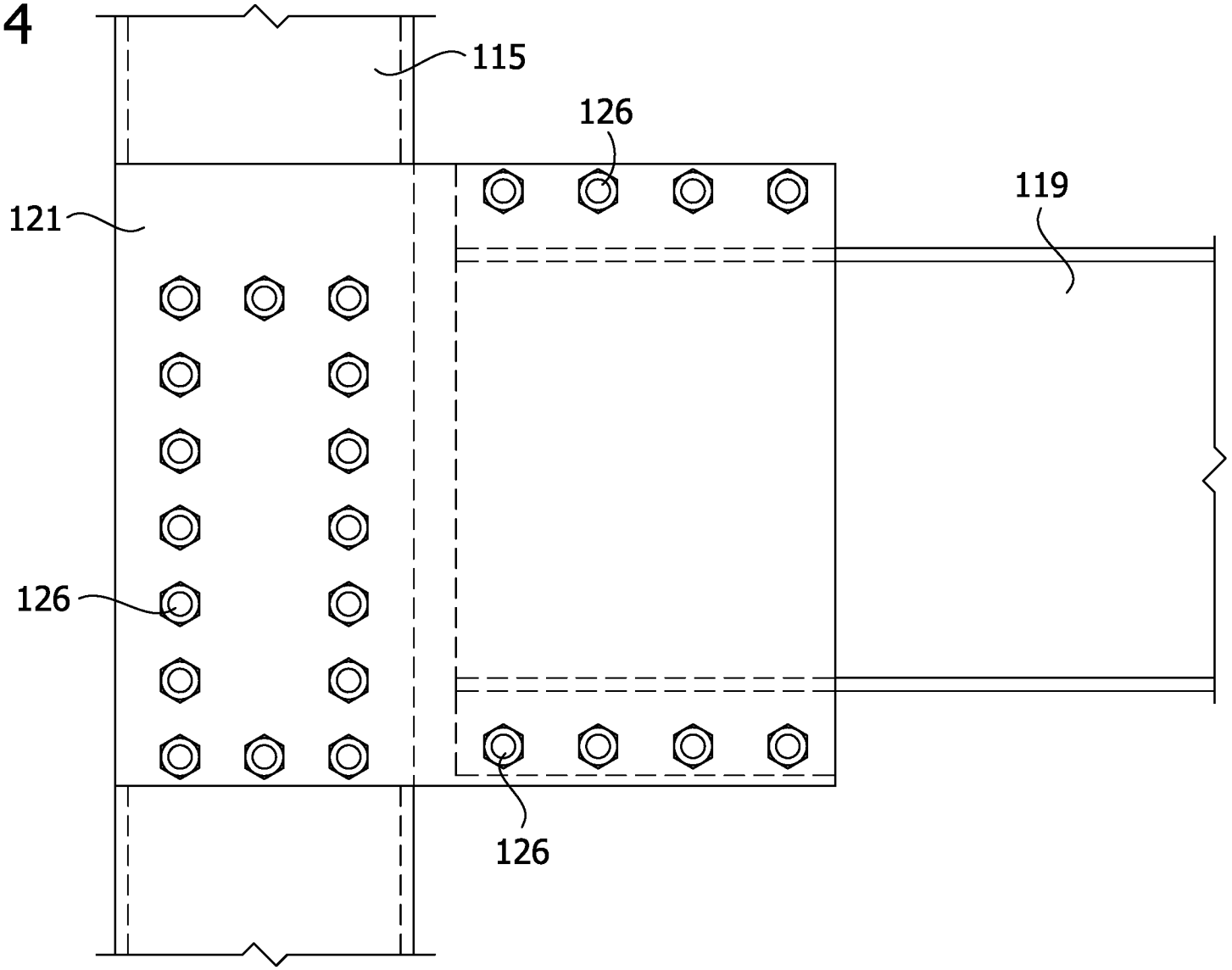
FIG. 14 is a front view of the beam-to-column joint connection structure in FIG. 13.
Figure 15:
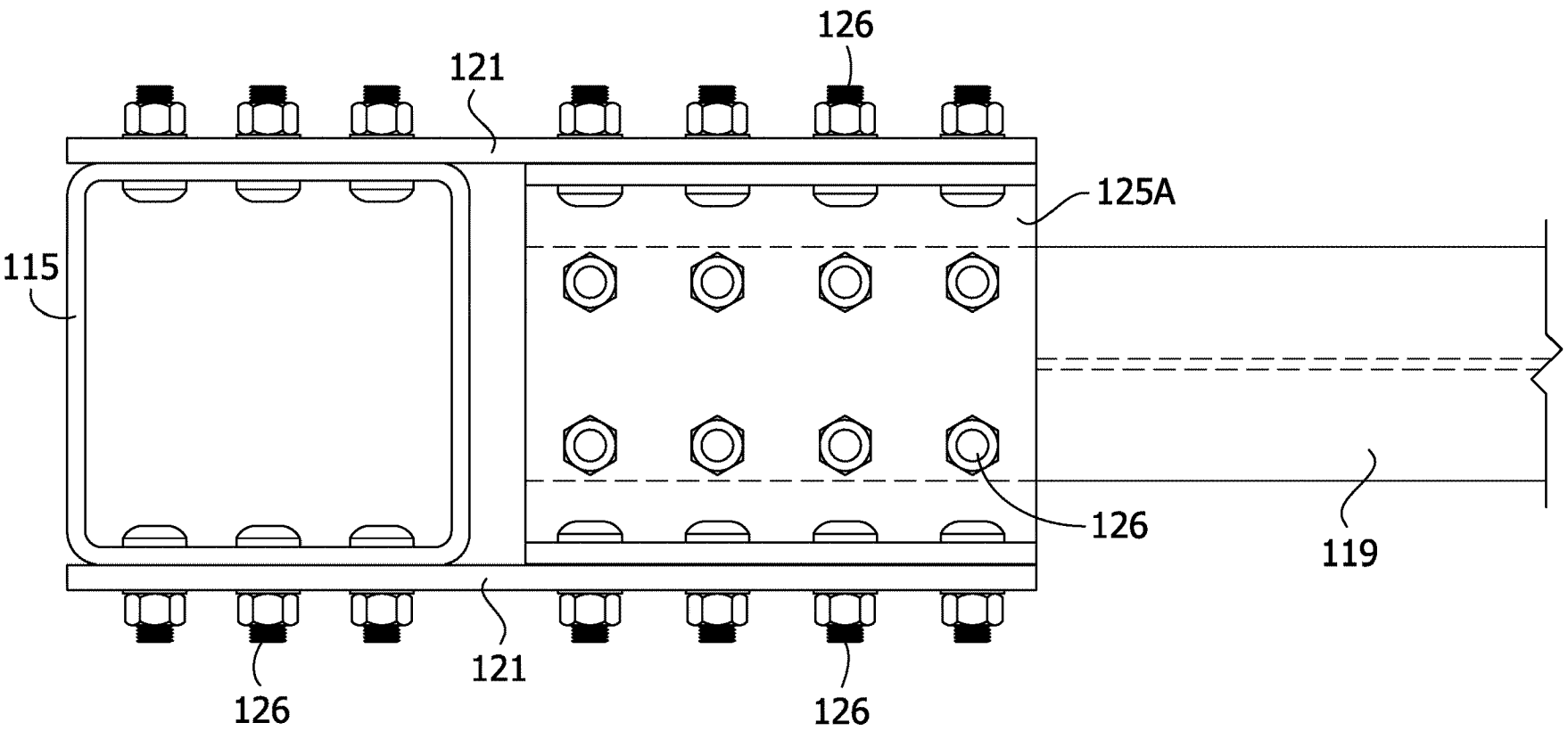
FIG. 15 is a top view of the beam-to-column joint connection structure in FIG. 13.
Figure 16:
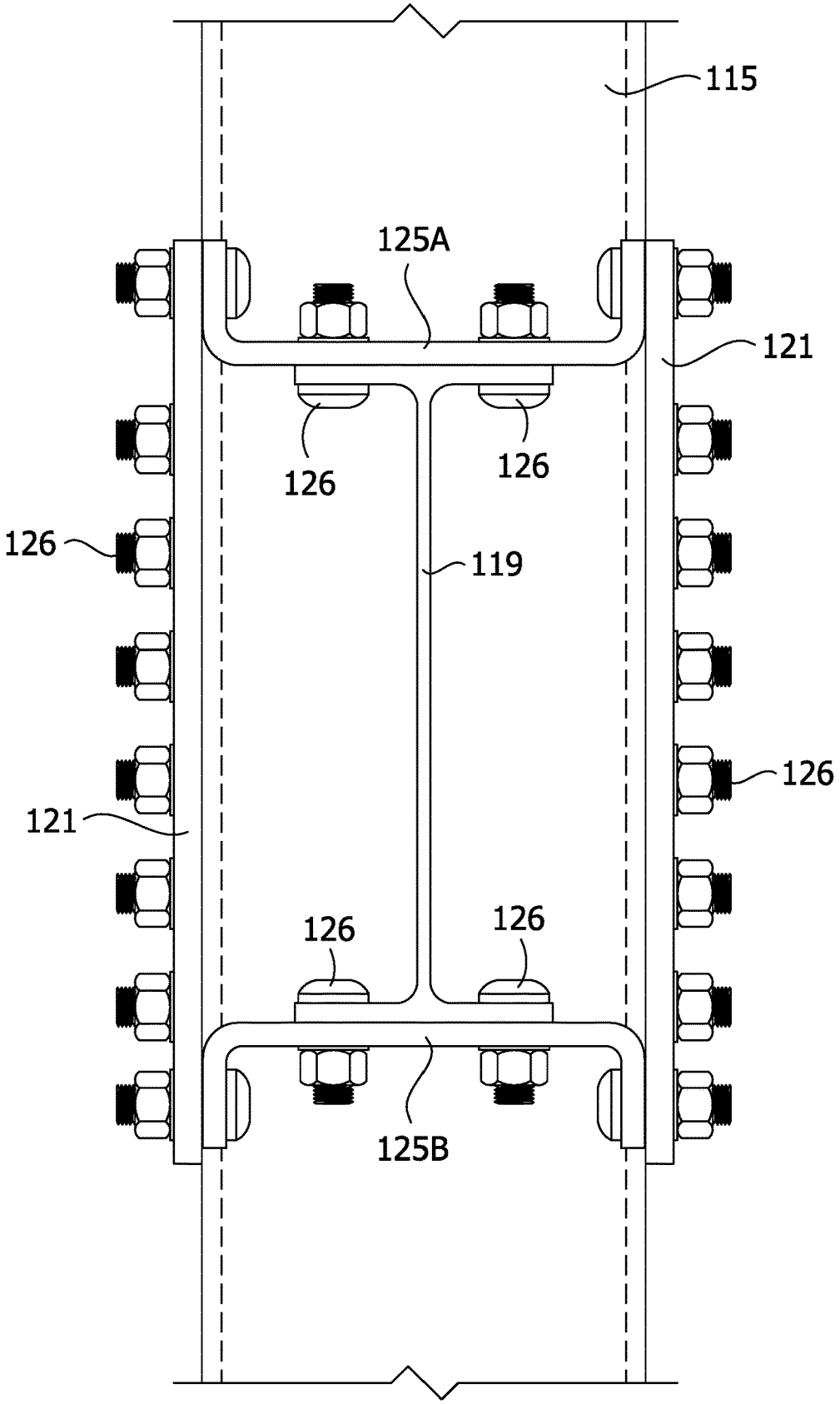
FIG. 16 is a side view of the beam-to-column joint connection structure in FIG. 13.
Figure 17:
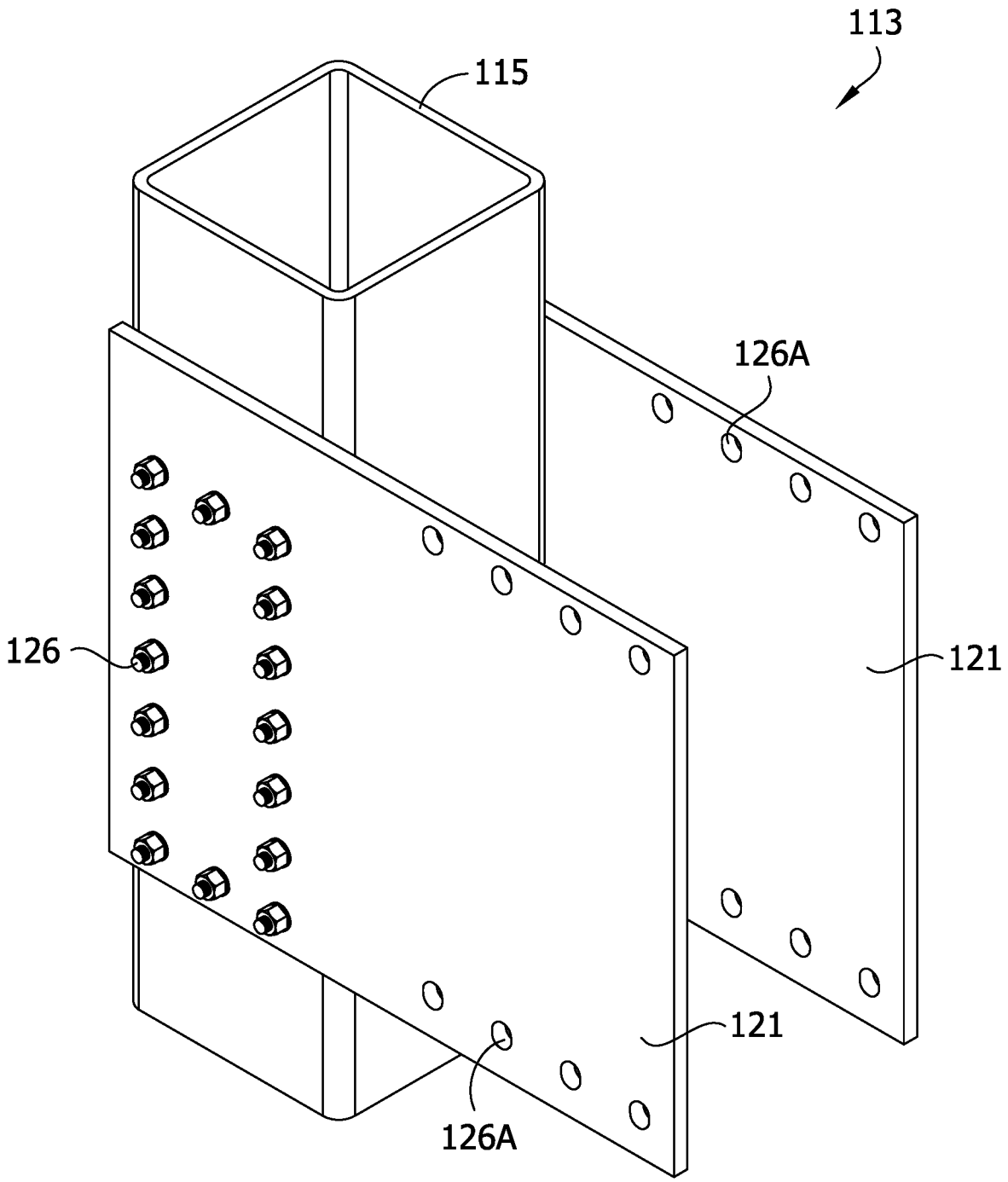
FIG. 17 is a fragmentary perspective of a column assembly of the beam-to-column joint connection structure in FIG. 13.
Figure 18:
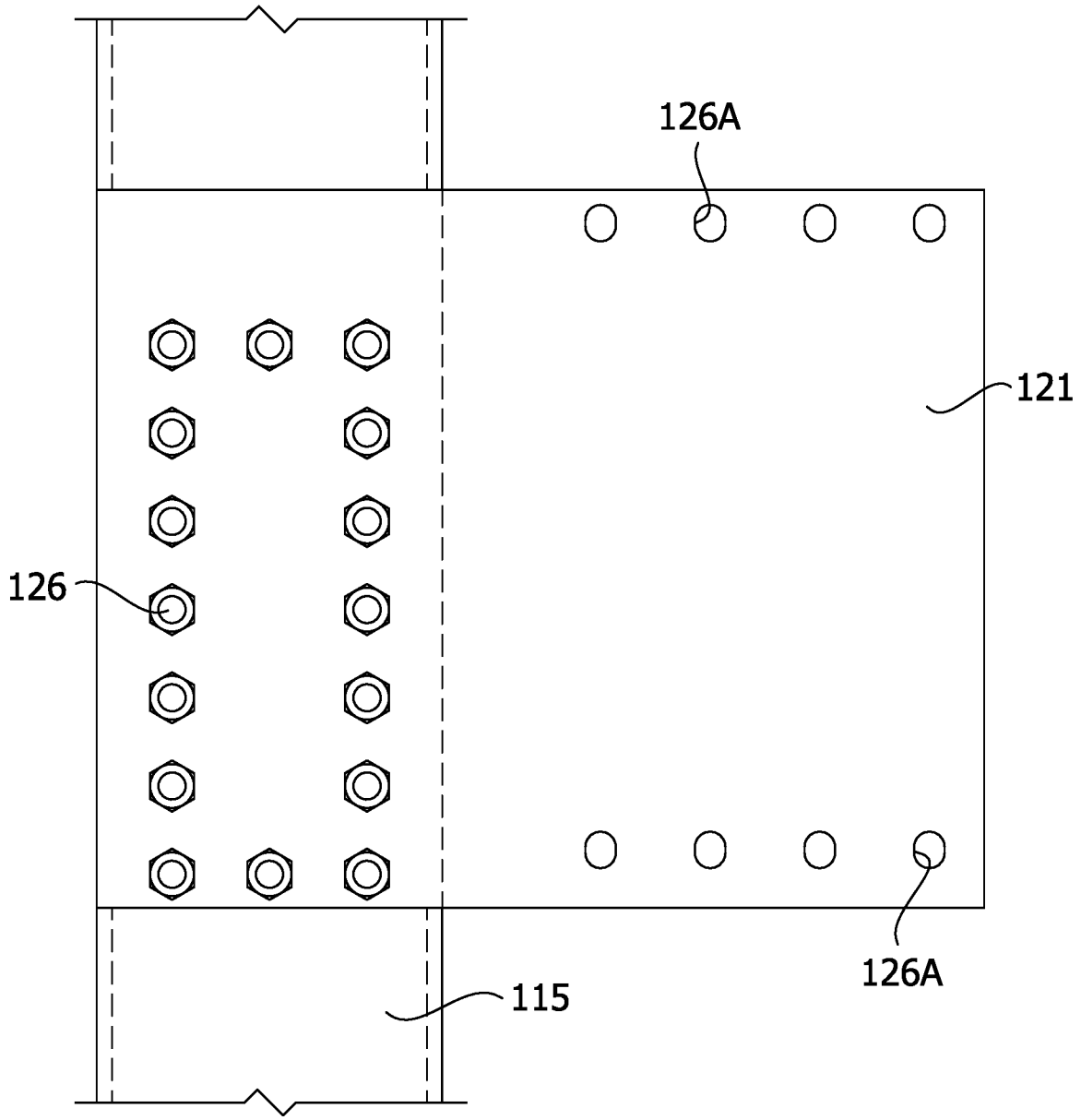
FIG. 18 is a front view of the column assembly in FIG. 17.
Figure 19:
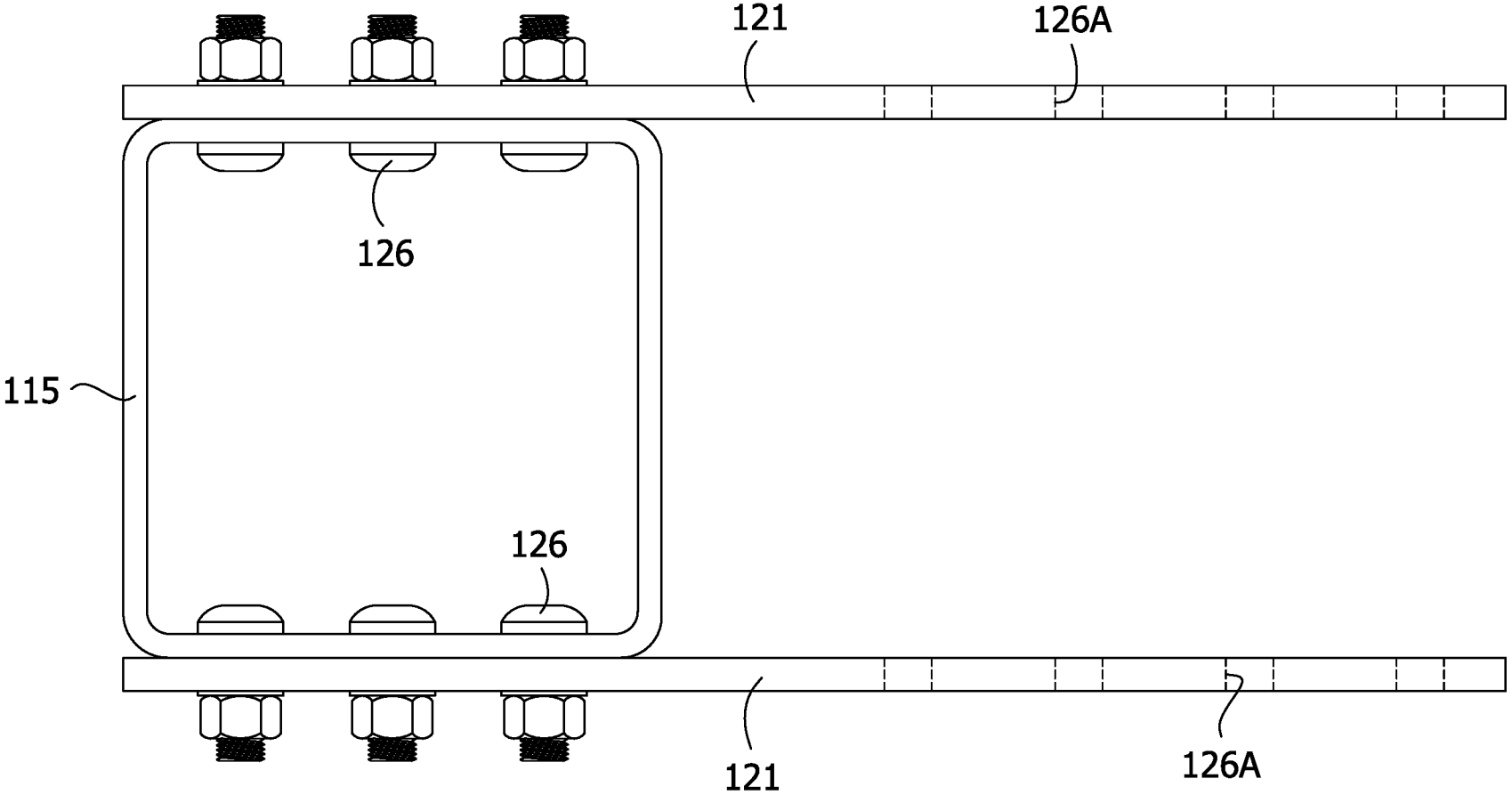
FIG. 19 is a top view of the column assembly in FIG. 17.
Figure 20:
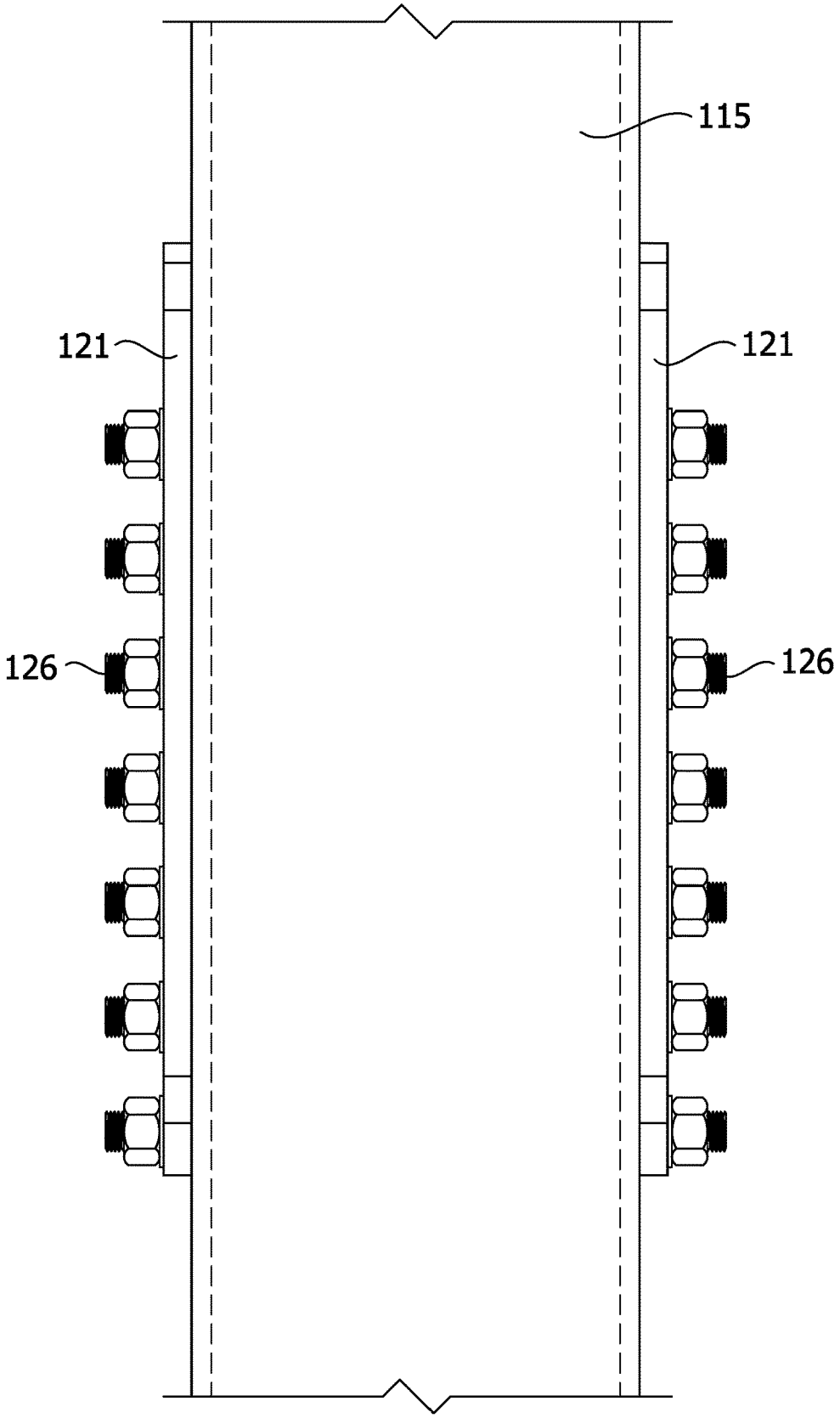
FIG. 20 is a side view of the column assembly in FIG. 17.
Figure 21:
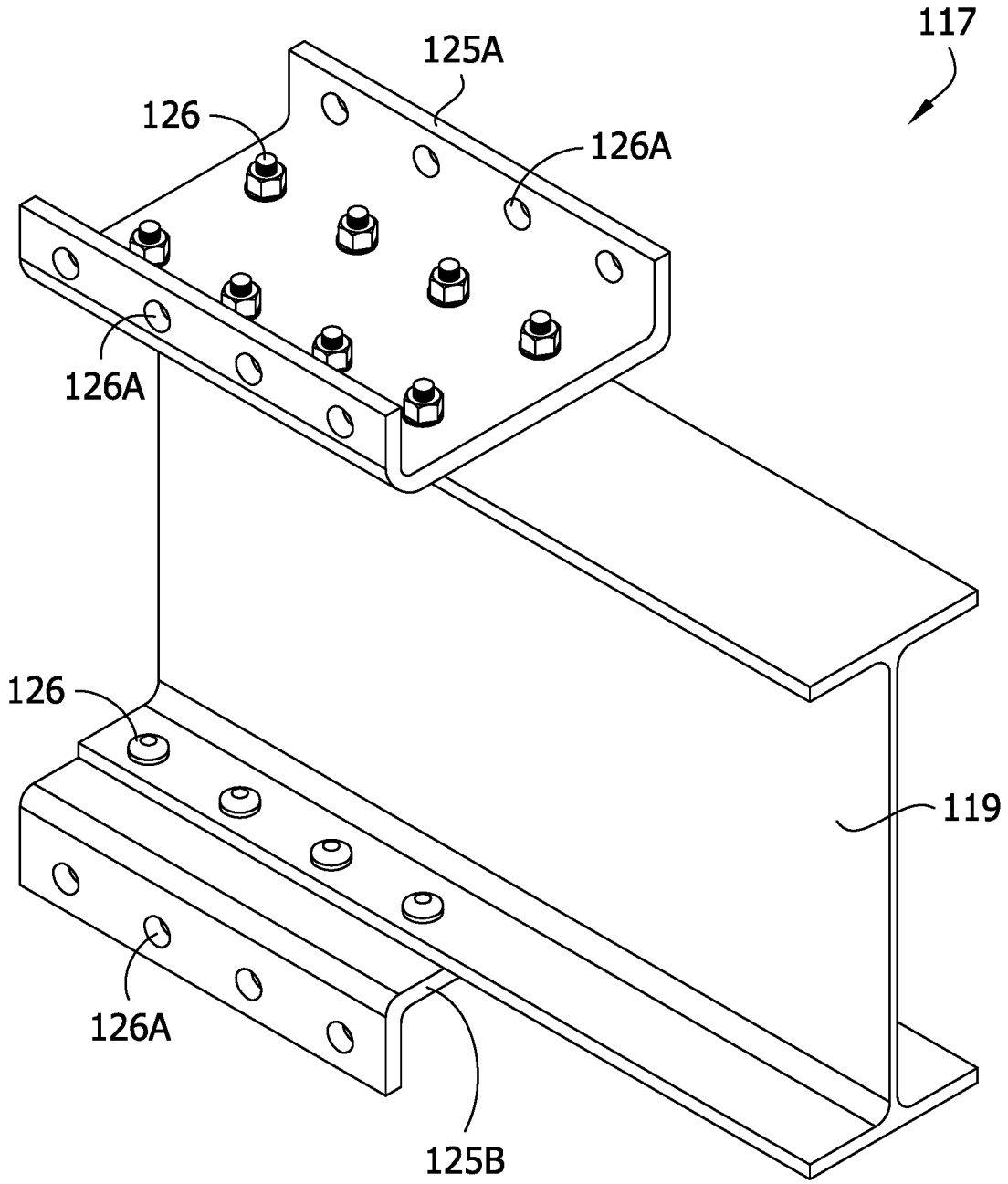
FIG. 21 is a fragmentary perspective of a full-length beam assembly of the beam-to-column joint connection structure of FIG. 13.
Figure 22:
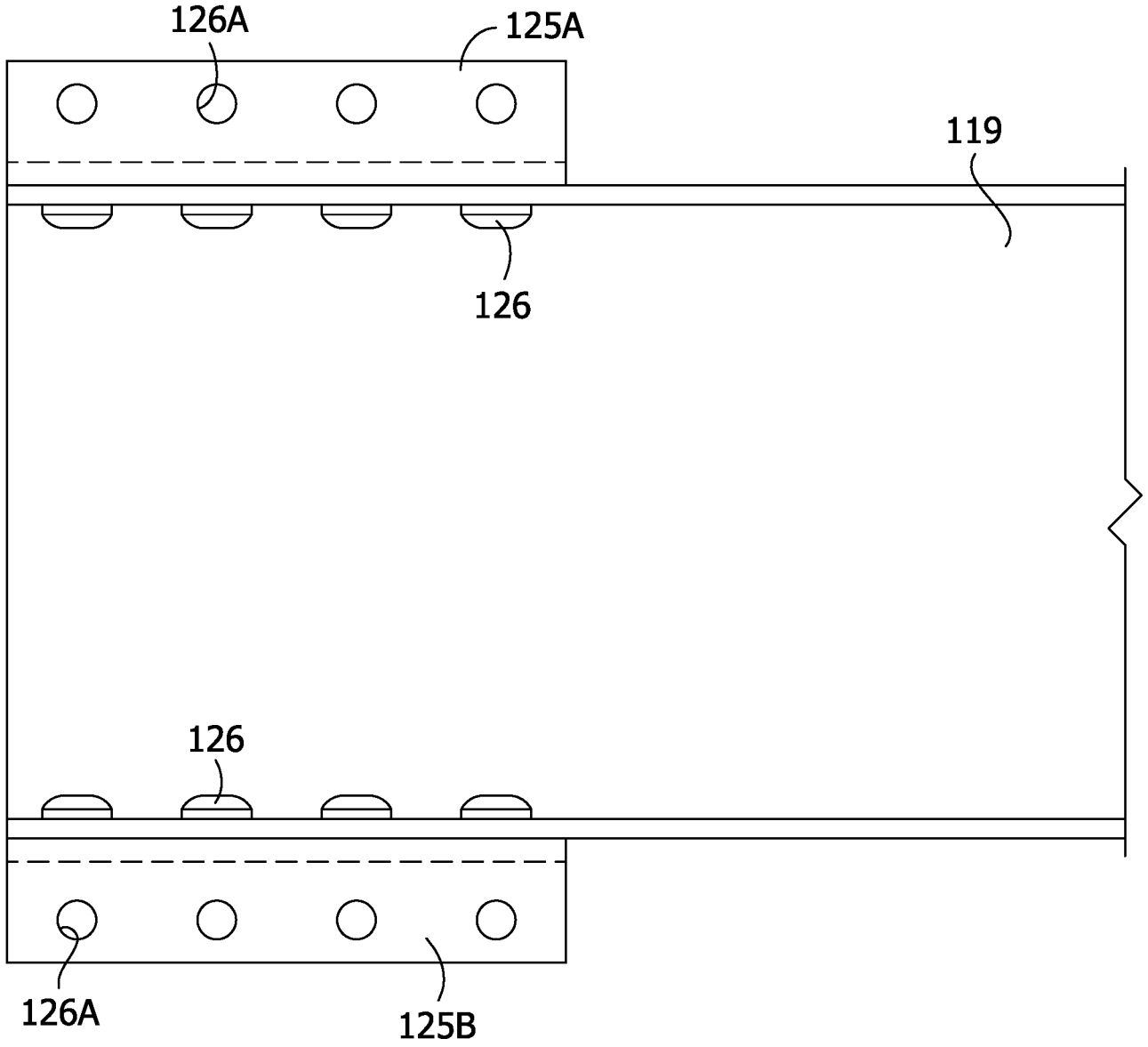
FIG. 22 is a front view of the beam assembly in FIG. 21
Figure 23:
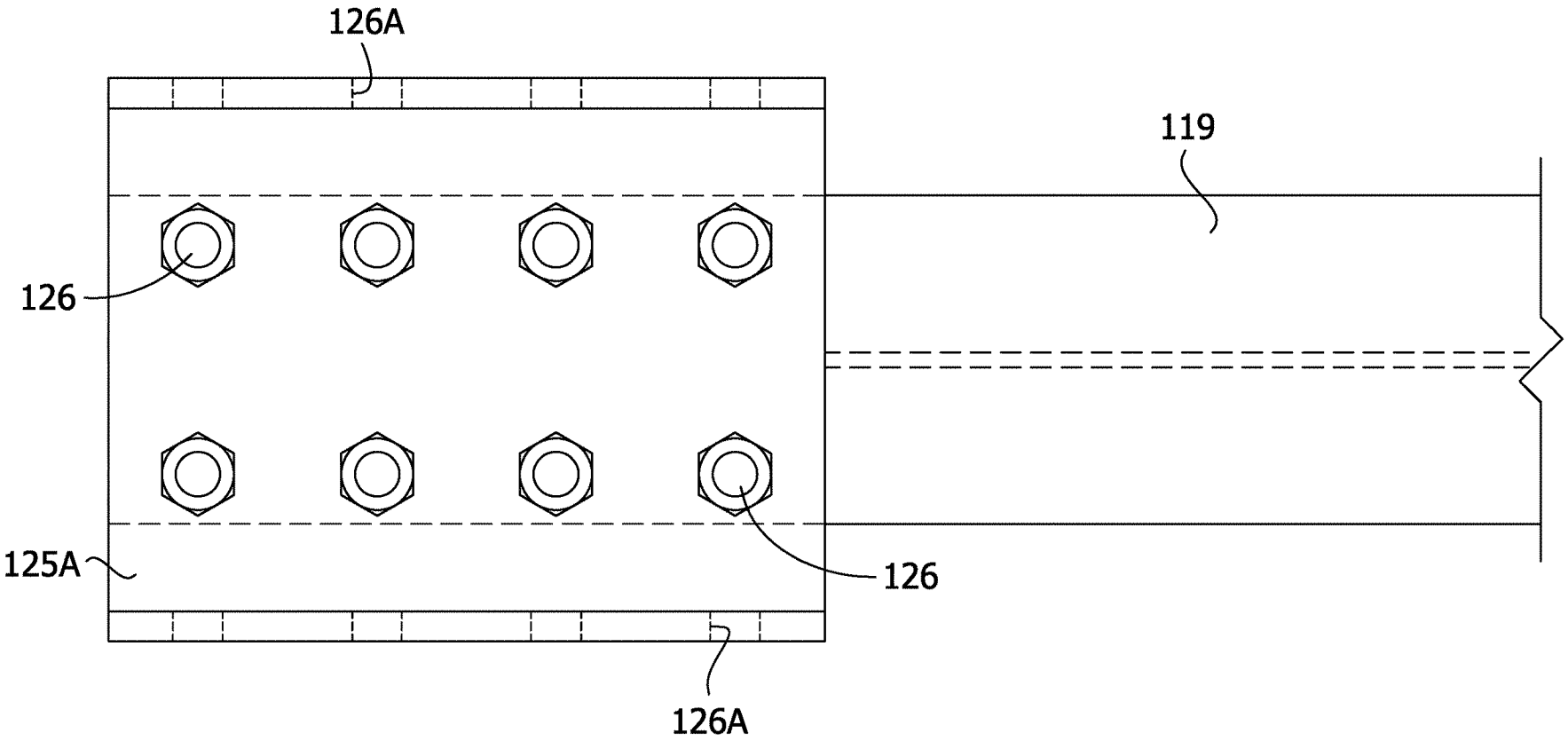
FIG. 23 is a top view of the beam assembly in FIG. 21.
Figure 24:
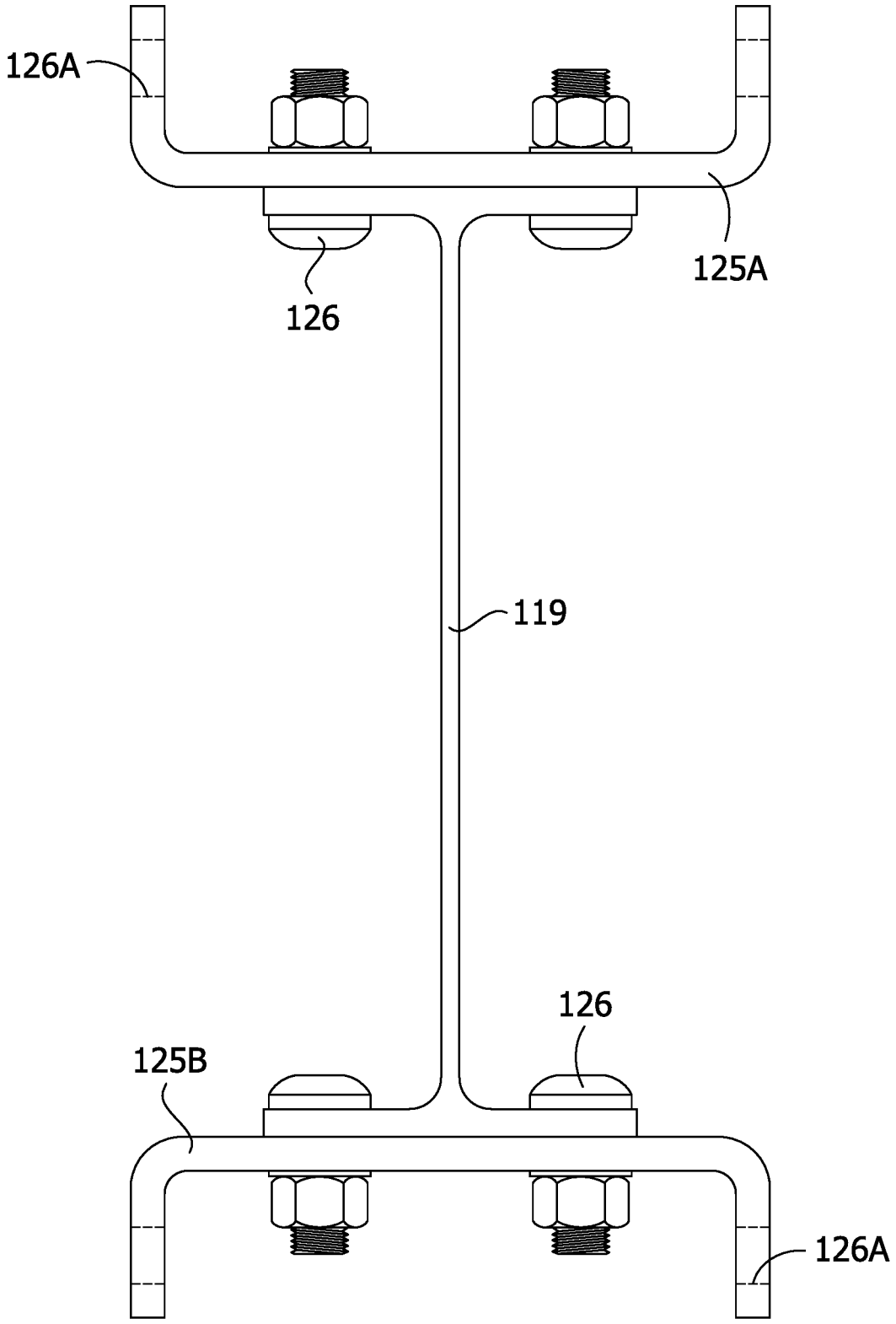
FIG. 24 is a side view of the beam assembly in FIG. 21.
Figure 25:
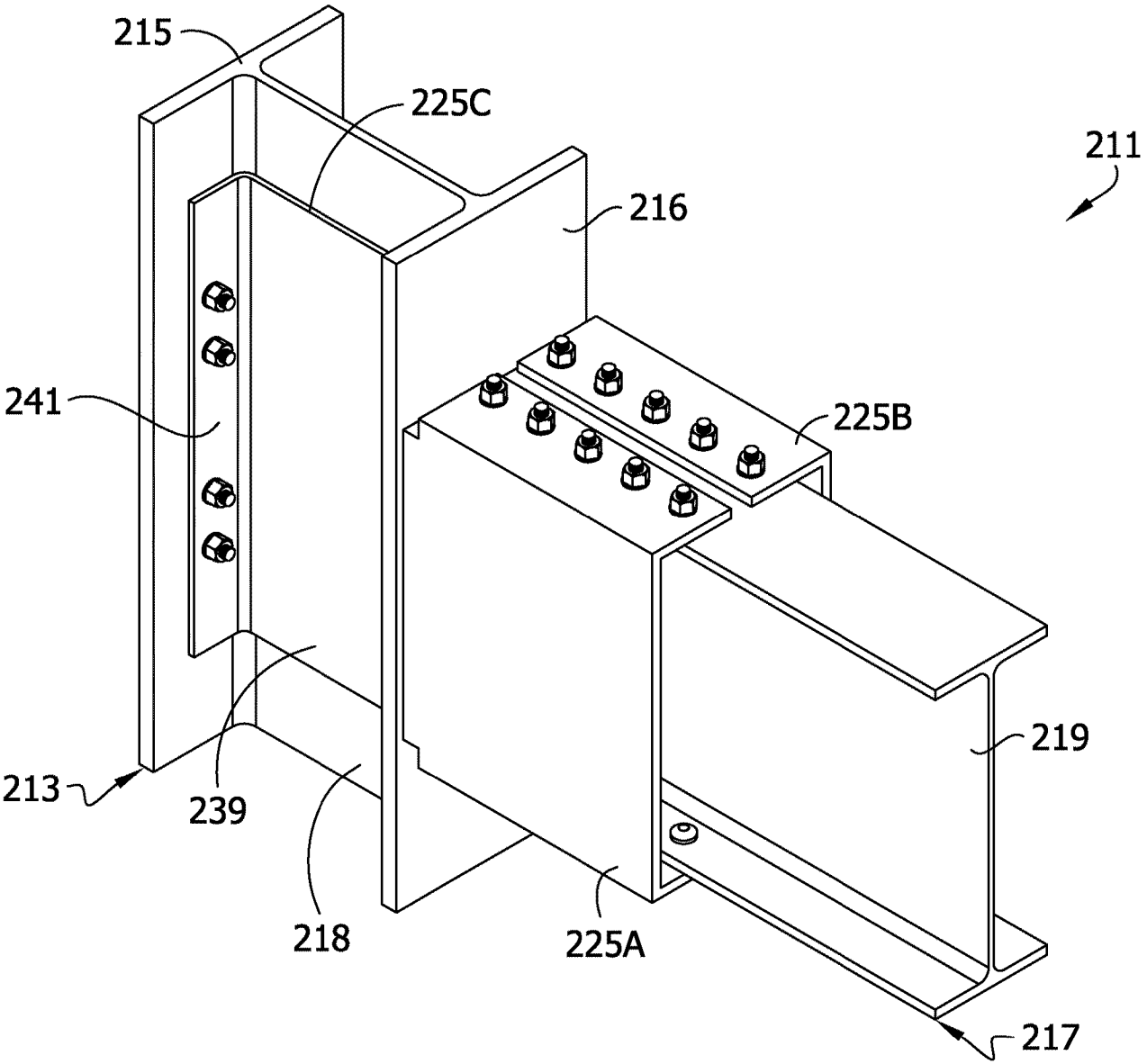
FIG. 25 is a fragmentary perspective of a beam-to-column joint connection structure of another embodiment.
Figure 26:
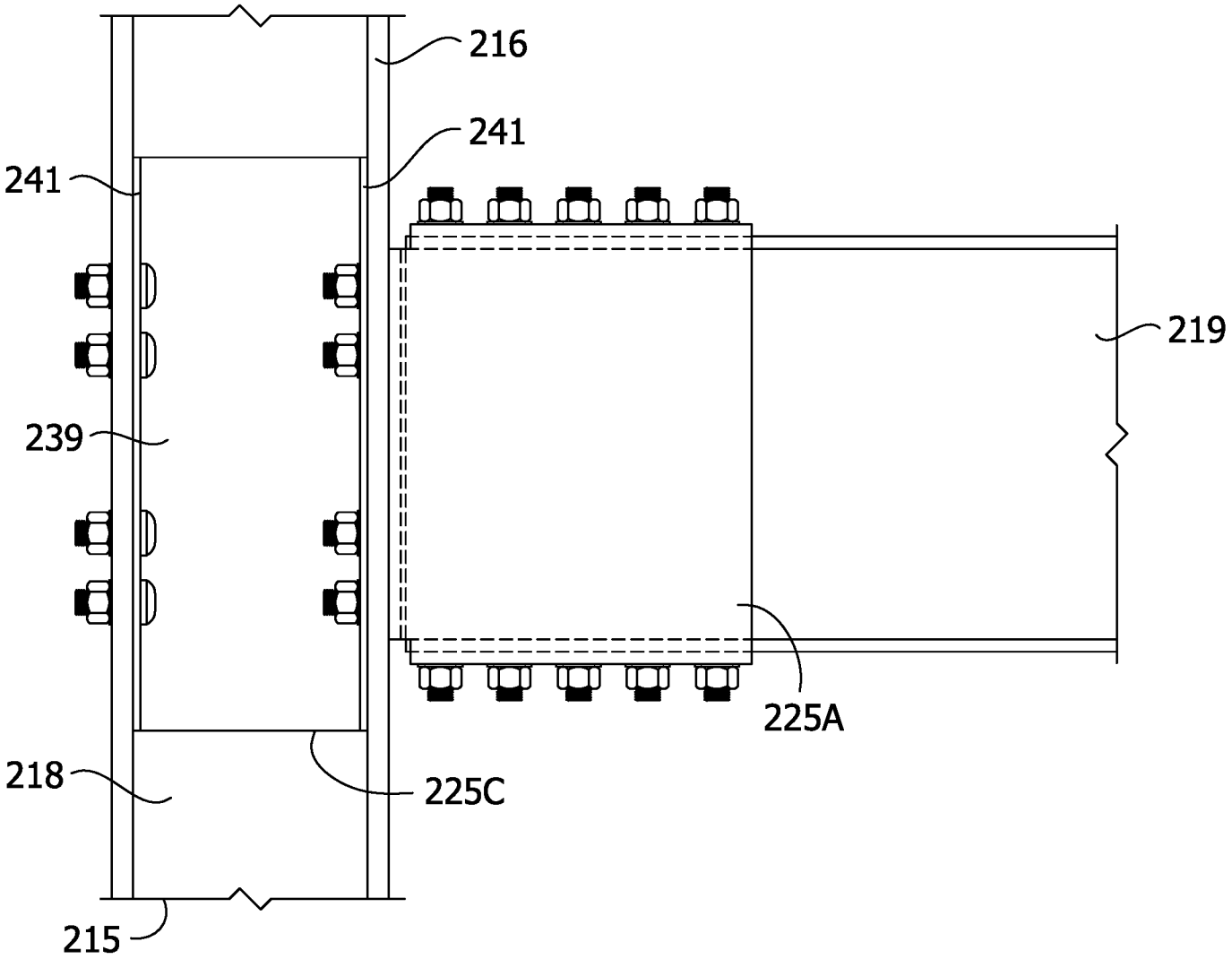
FIG. 26 is a front view of the beam-to-column joint connection structure in FIG. 25.
Figure 27:
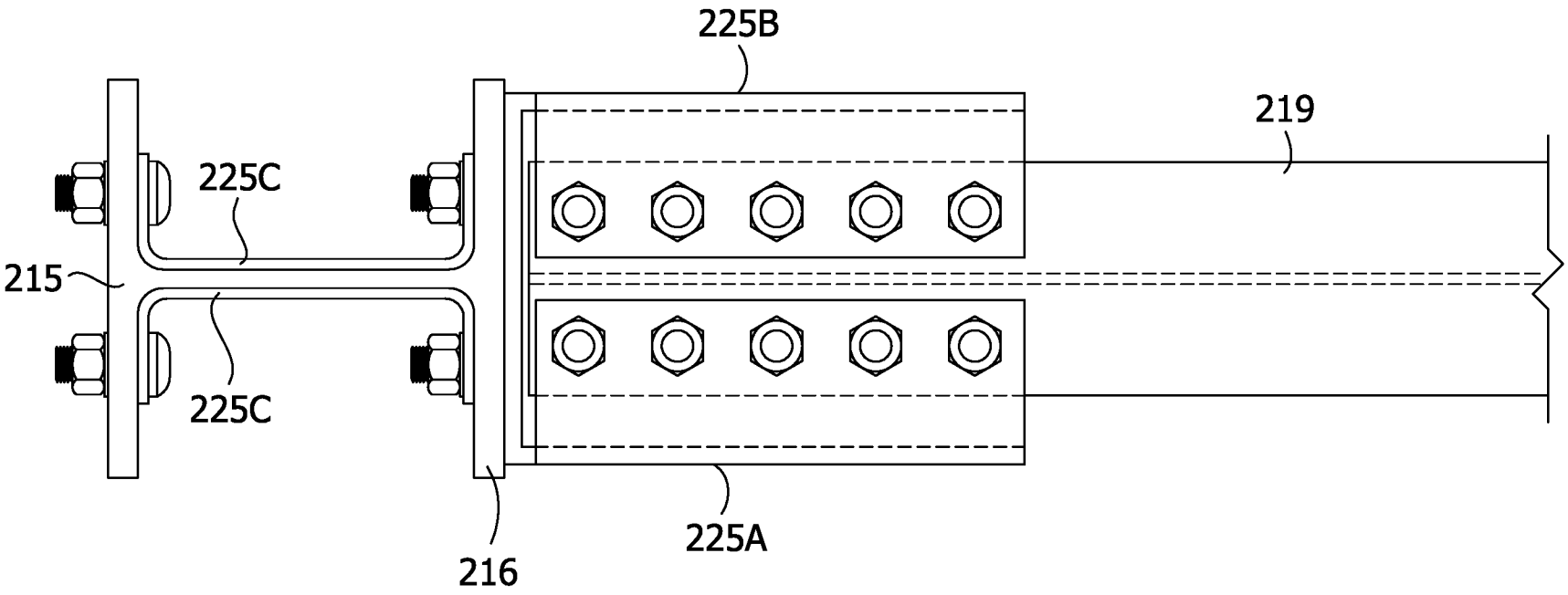
FIG. 27 is a top view of the beam-to-column joint connection structure in FIG. 25.
Figure 28:
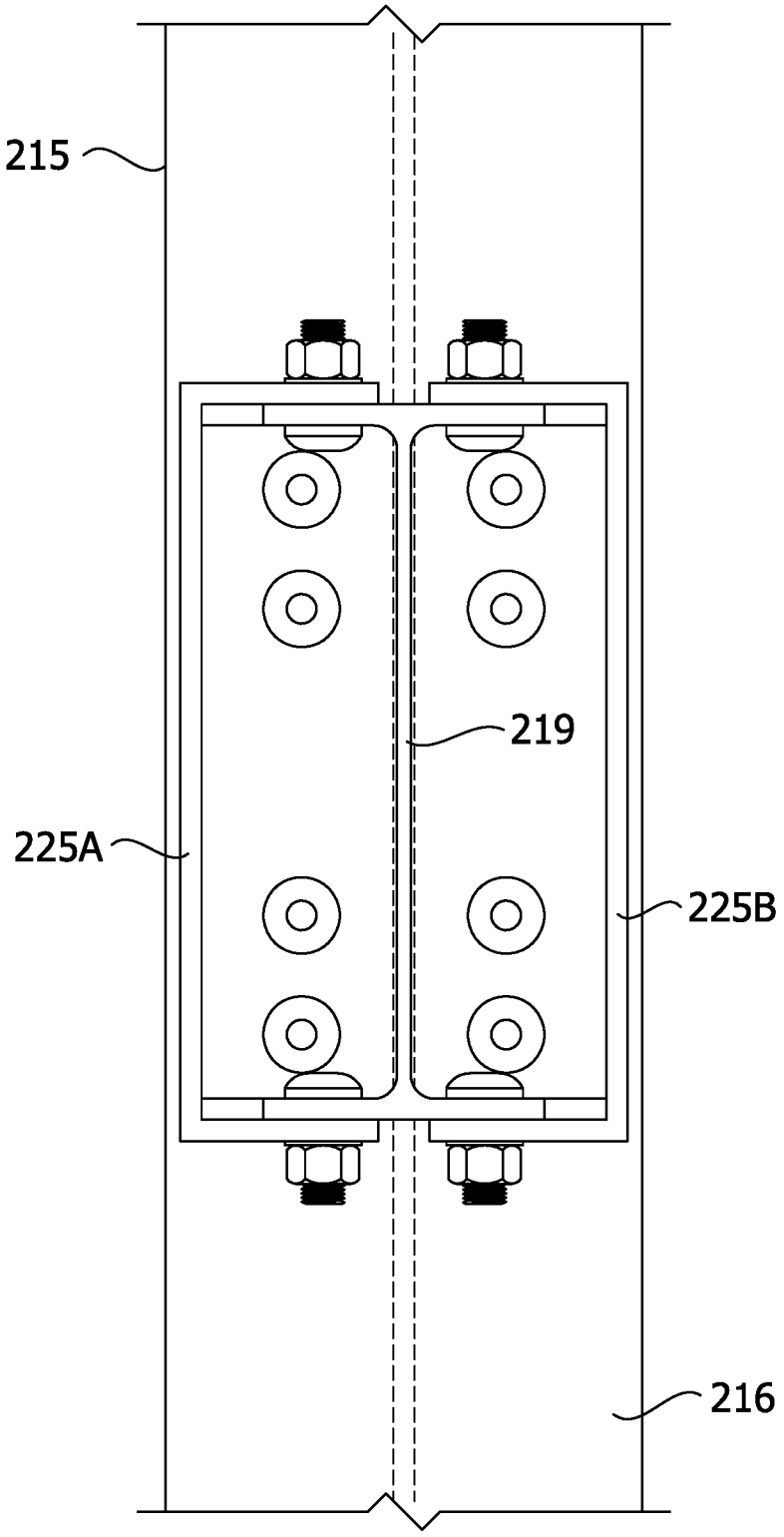
FIG. 28 is a side view of the beam-to-column joint connection structure in FIG. 25.
Figure 29A:
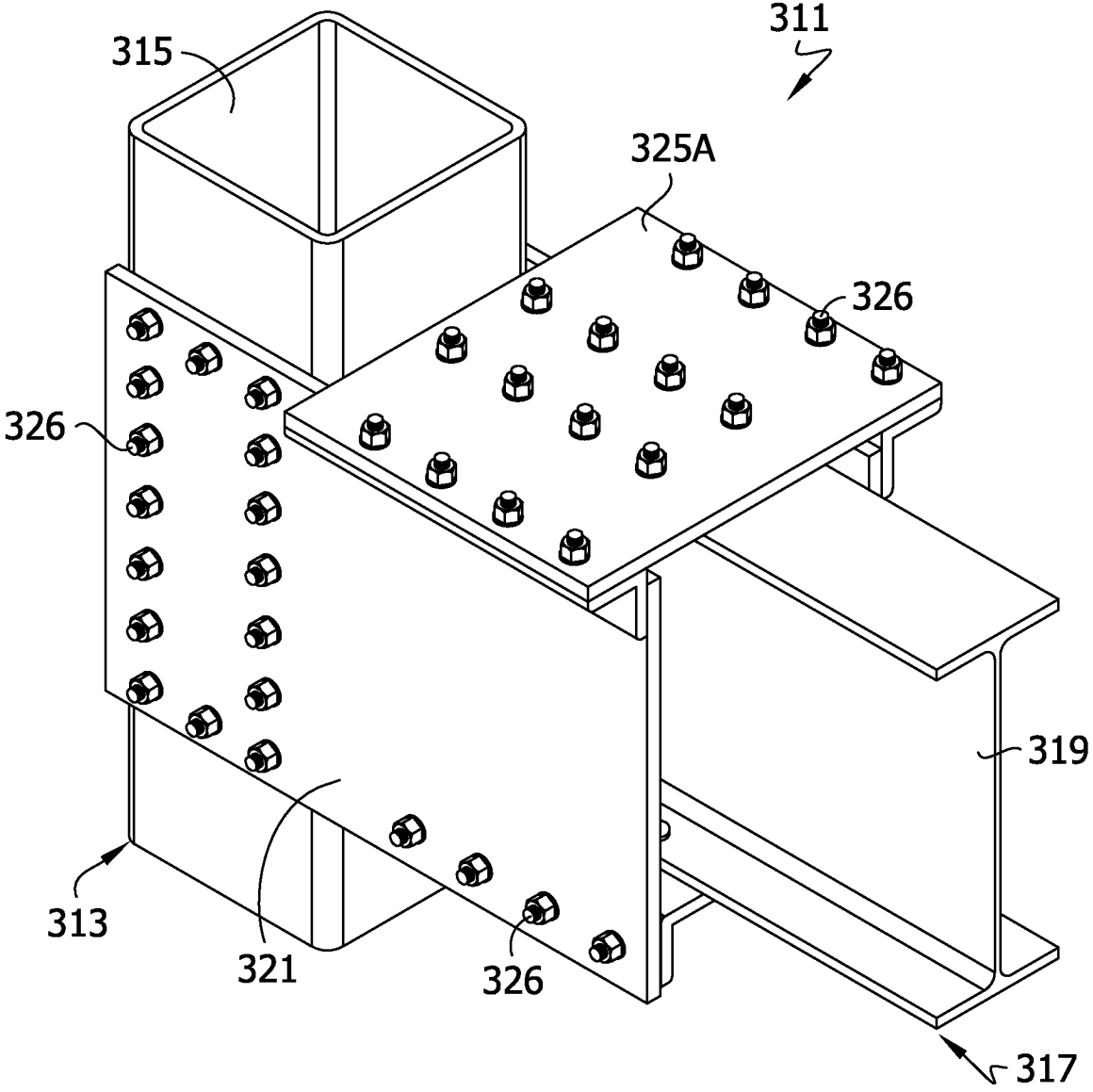
FIG. 29A is a front fragmentary perspective of a beam-to-column joint connection structure of another embodiment.
Figure 29B:
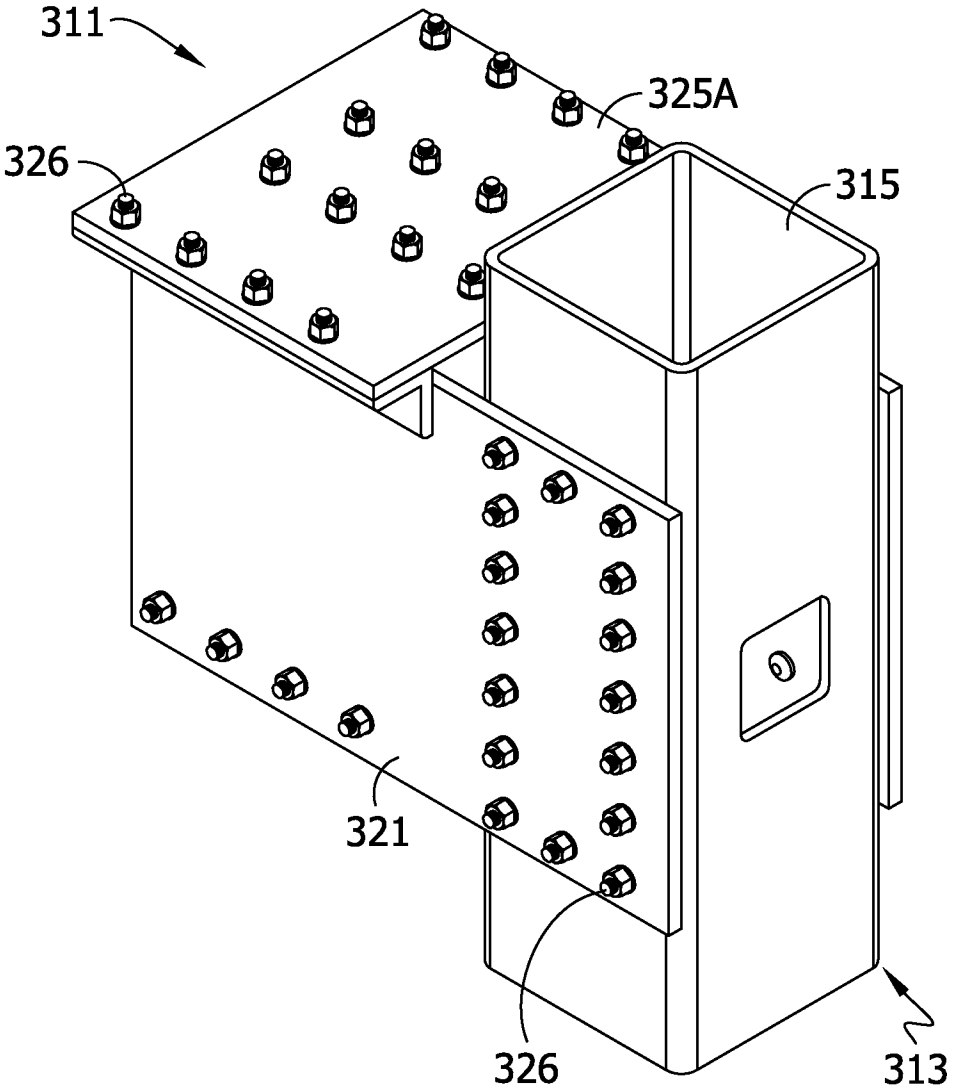
FIG. 29B is a rear fragmentary perspective of the beam-to-column joint connection structure in FIG. 29A.
Figure 30:
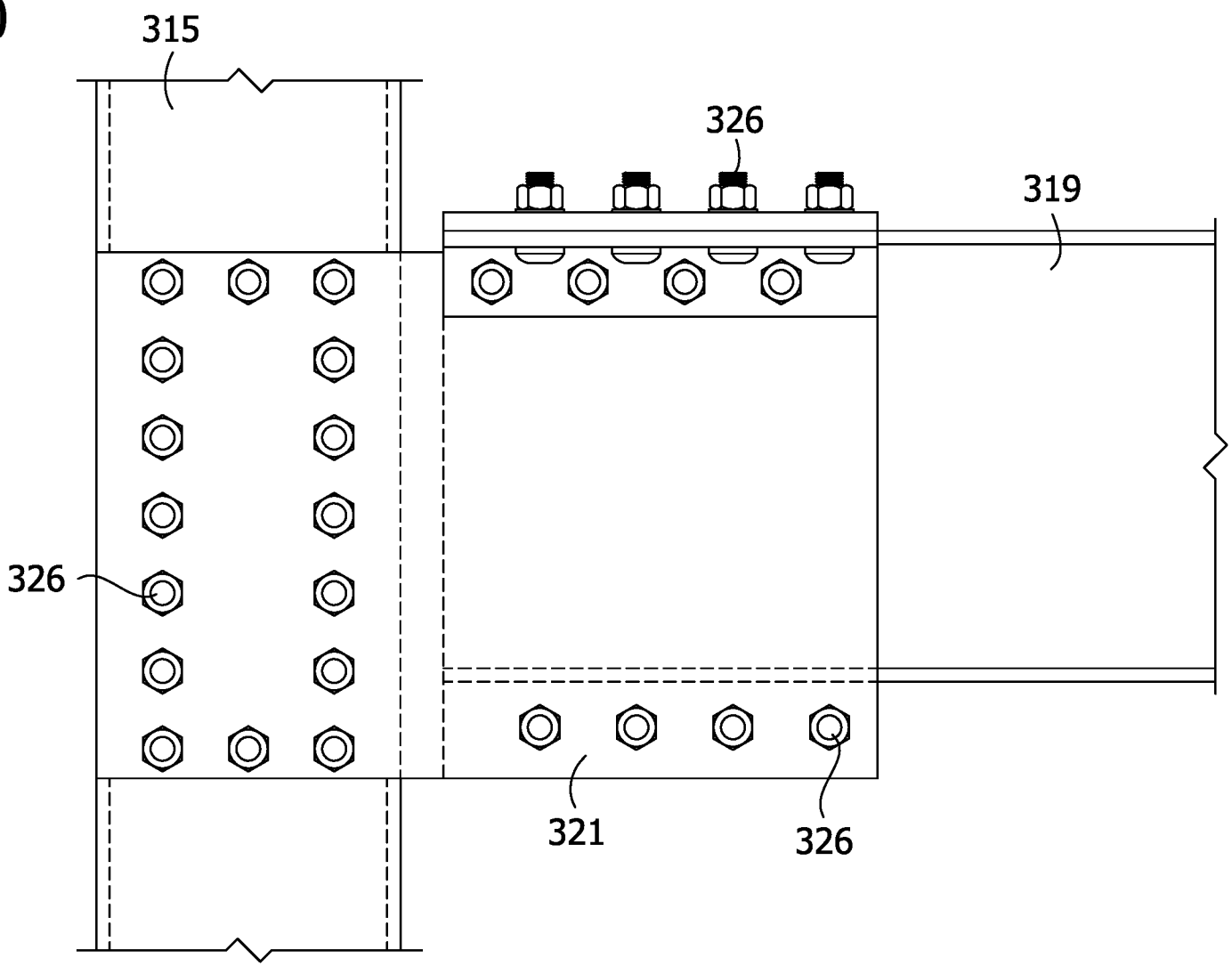
FIG. 30 is a front view of the beam-to-column joint connection structure in FIG. 29A.
Figure 31:
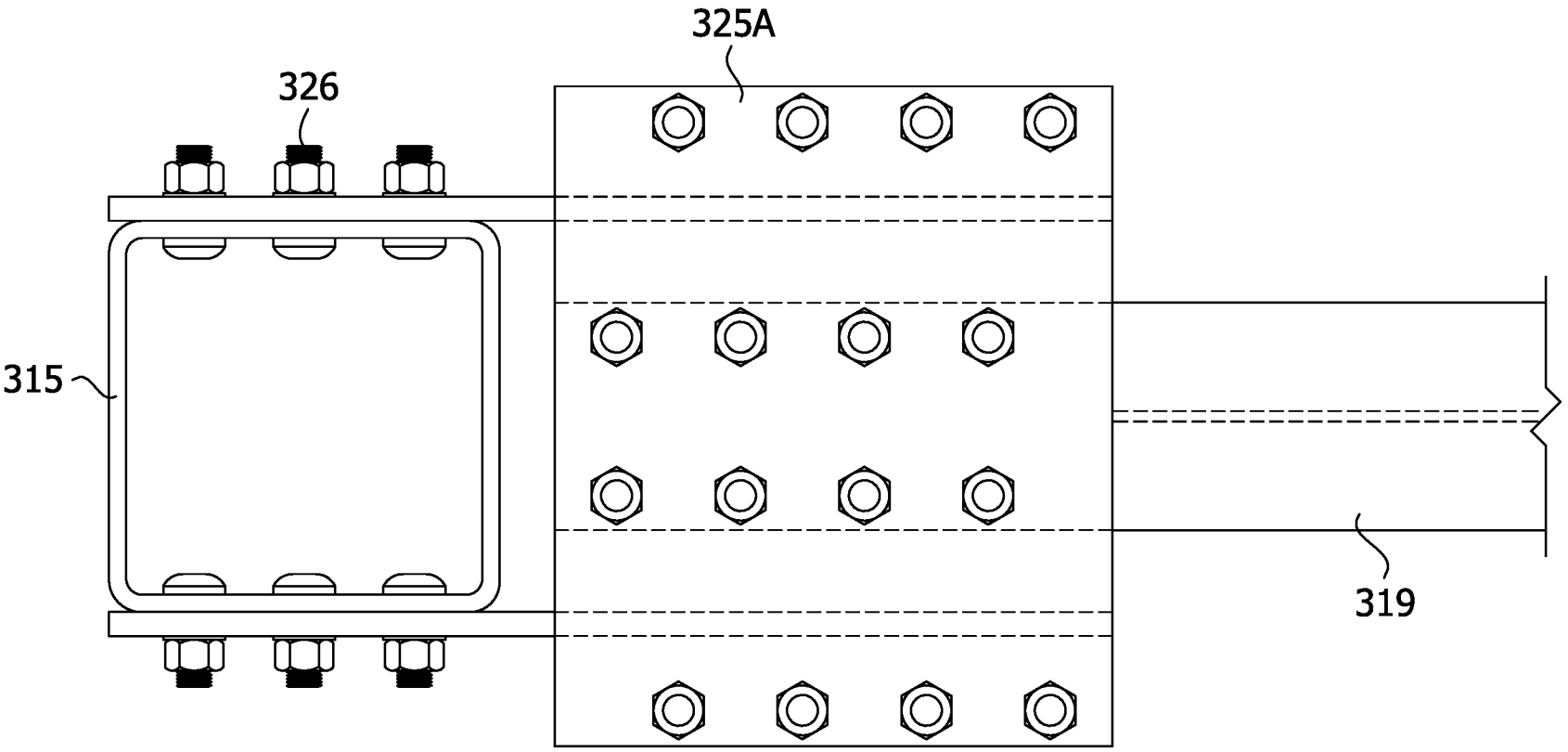
FIG. 31 is a top view of the beam-to-column joint connection structure in FIG. 29A.
Figure 32:
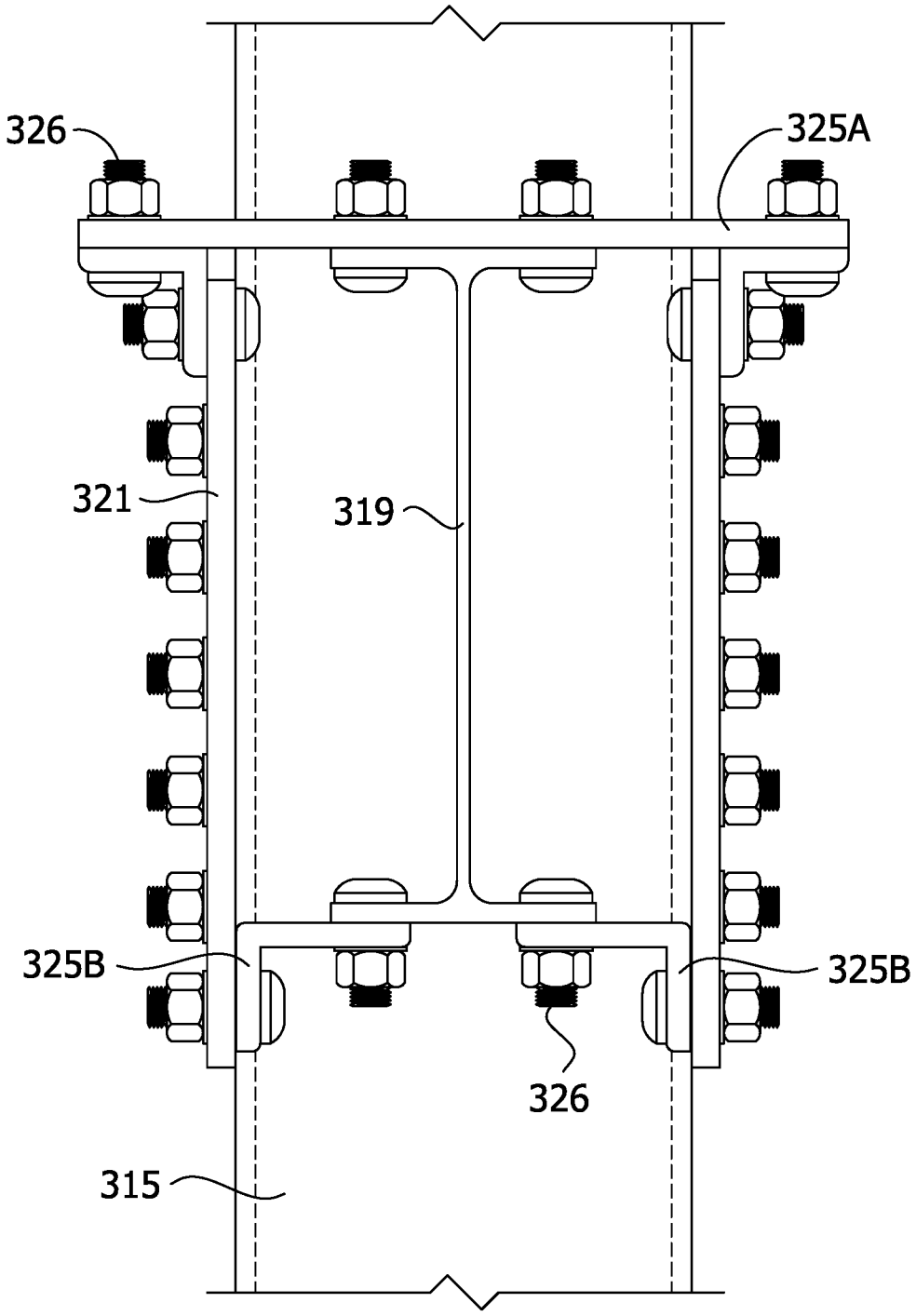
FIG. 32 is a right side view of the beam-to-column joint connection structure in FIG. 29A.
Figure 33:
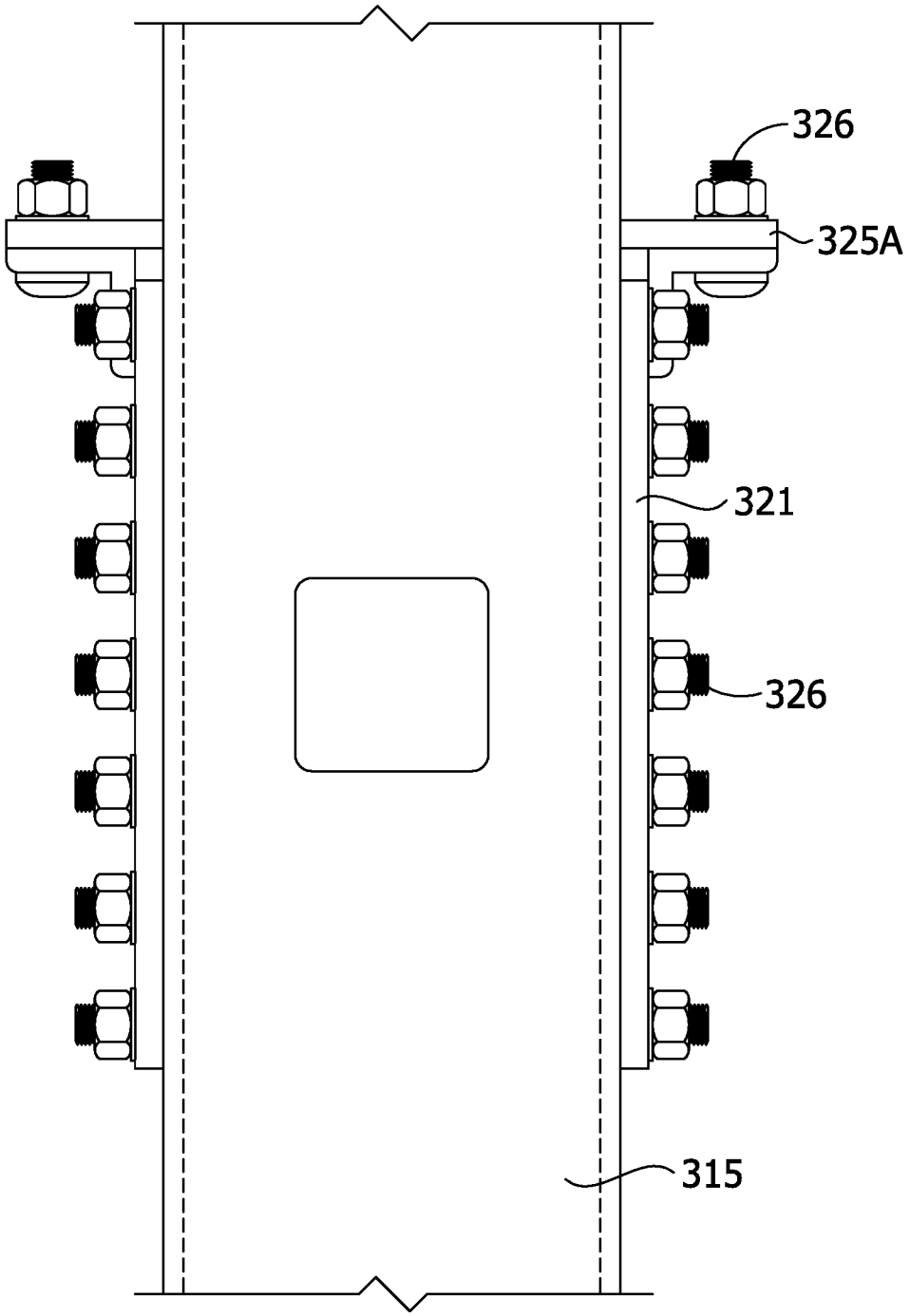
FIG. 33 is a left side view of the beam-to-column joint connection structure in FIG. 29A.
Figure 34A:
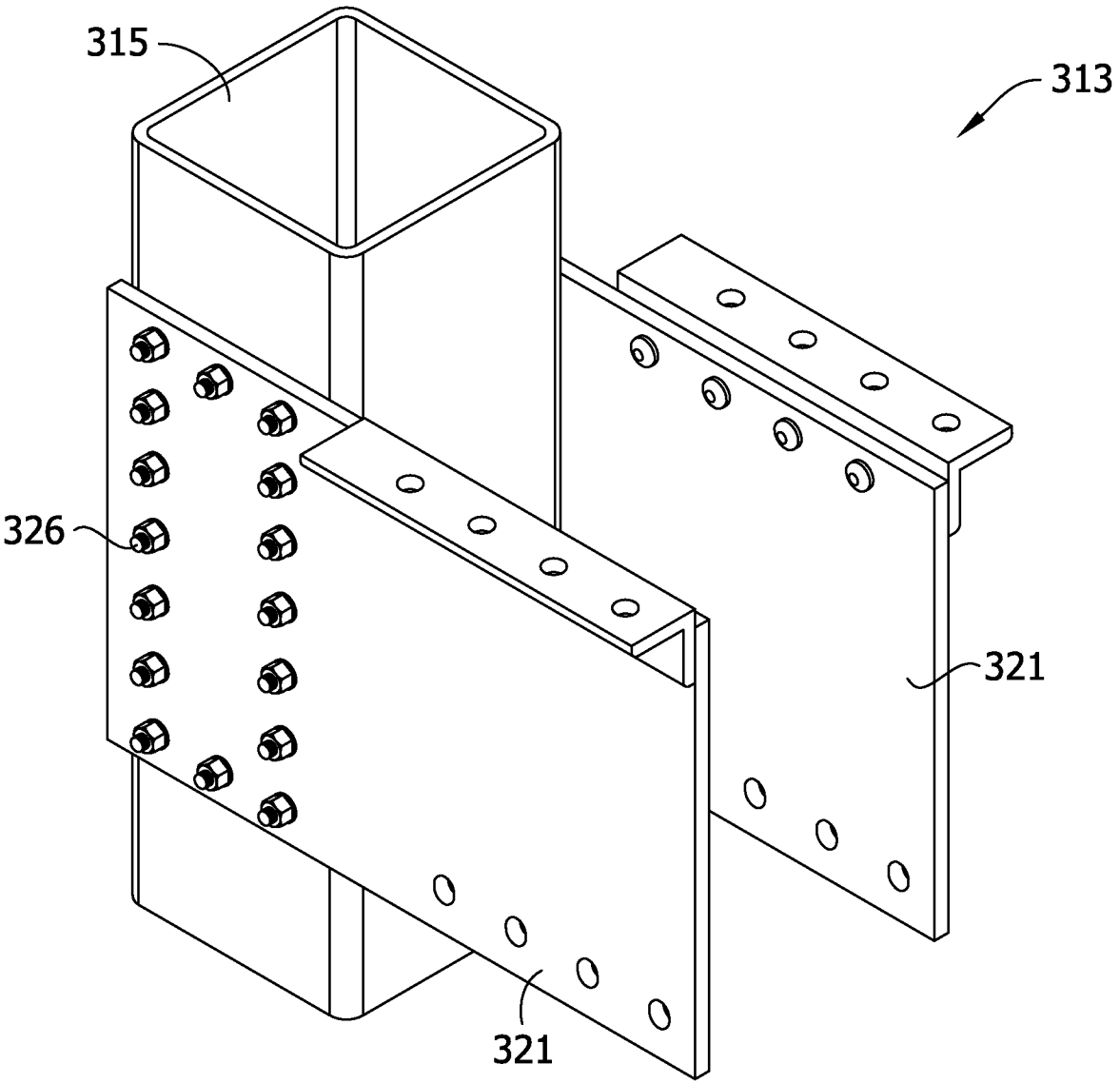
FIG. 34A is a front fragmentary perspective of a column assembly of the beam-to-column joint connection structure in FIGS. 29A and 29B.
Figure 34B:
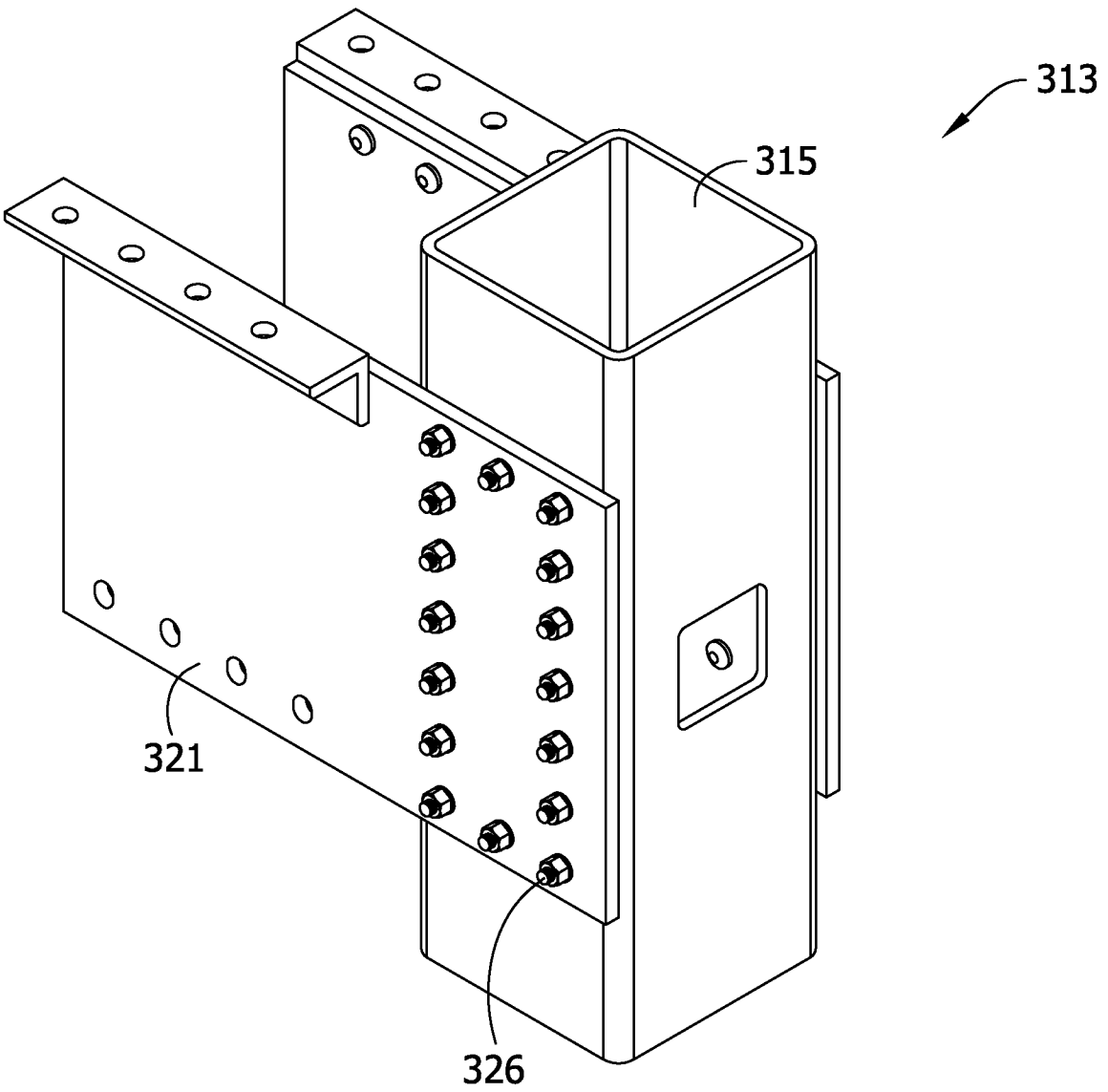
FIG. 34B is a rear fragmentary perspective of the column assembly in FIG. 34A.
Figure 35:
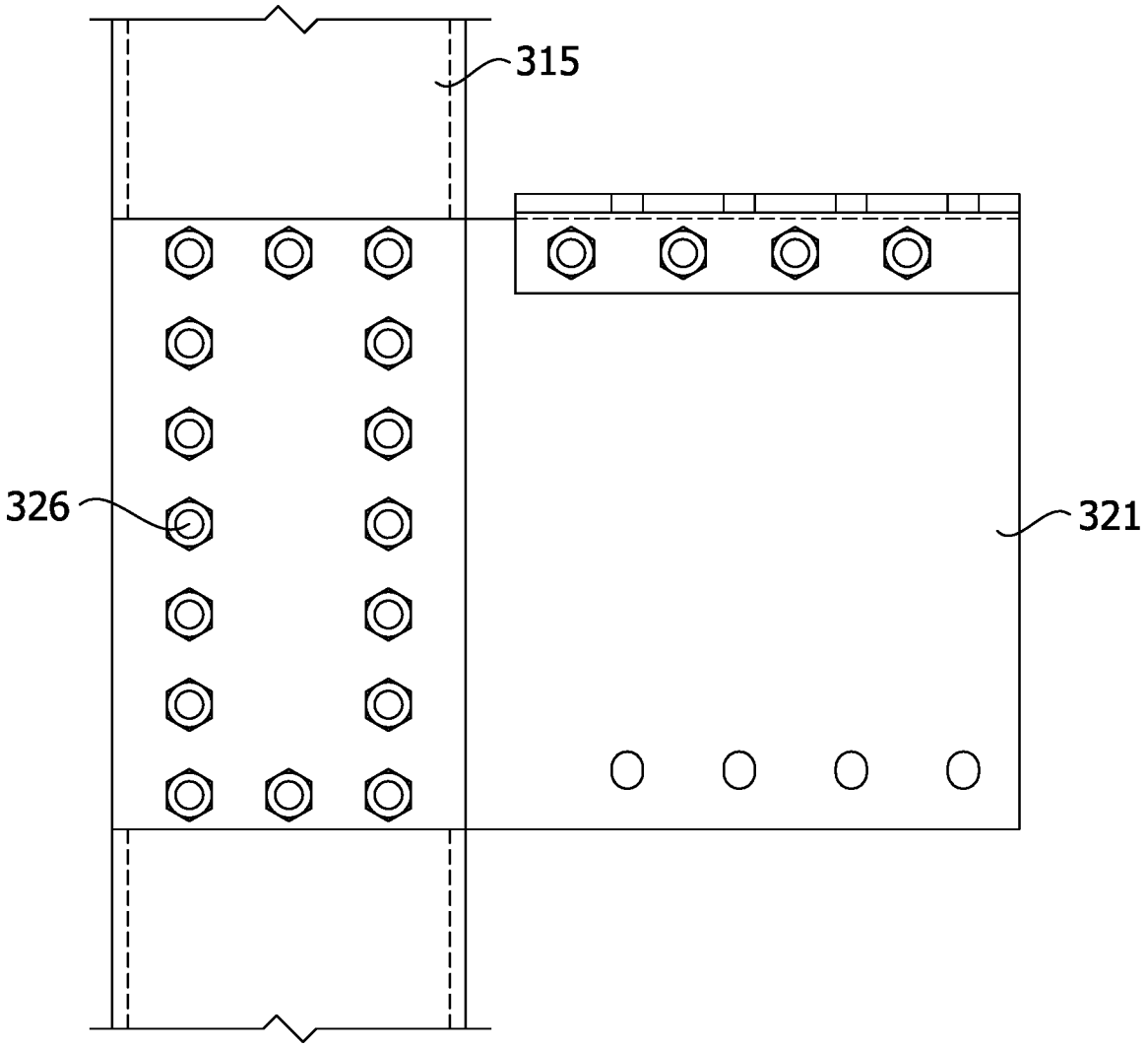
FIG. 35 is a front view of the column assembly in FIG. 34A.
Figure 36:
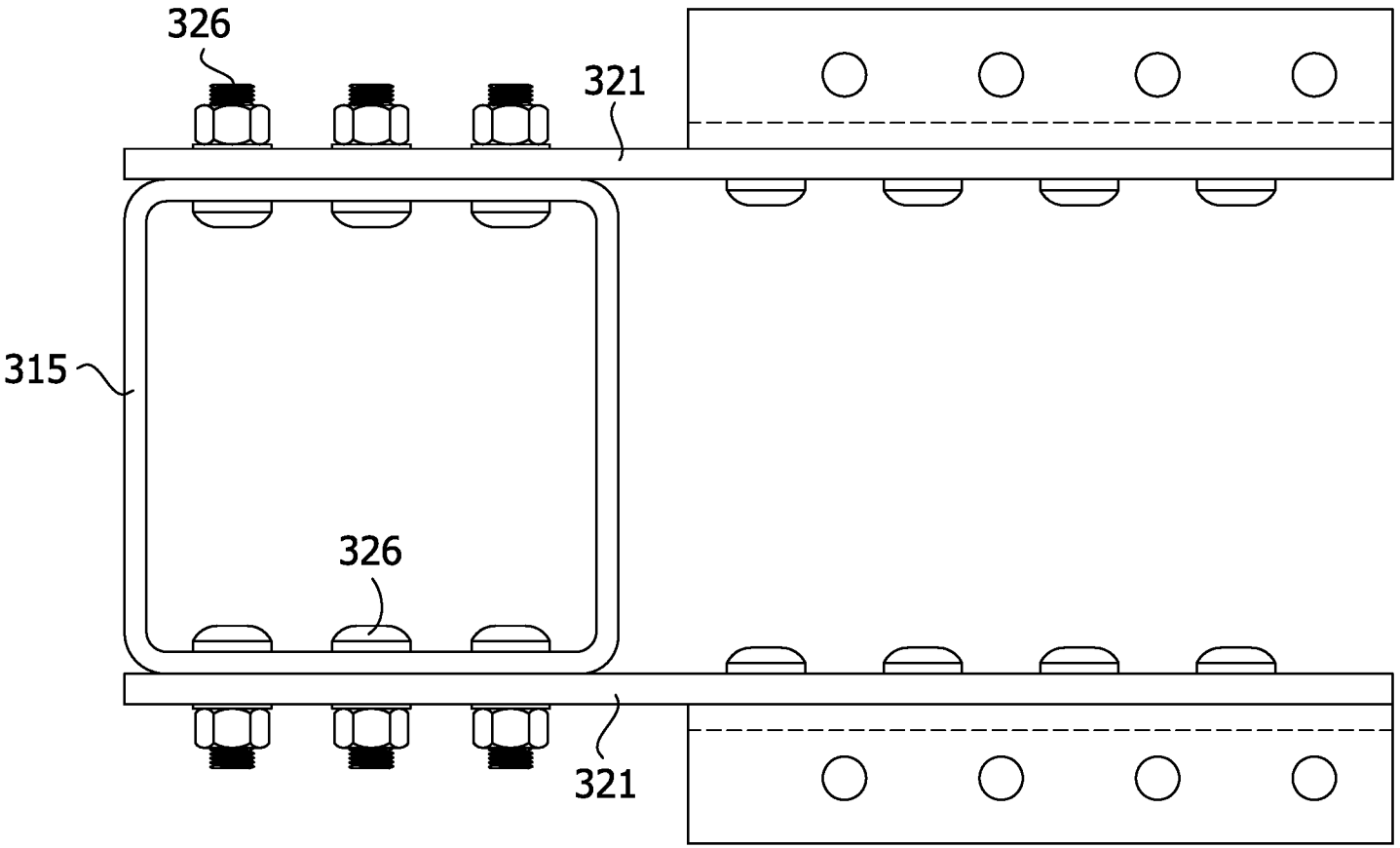
FIG. 36 is a top view of the column assembly in FIG. 34A.
Figure 37:
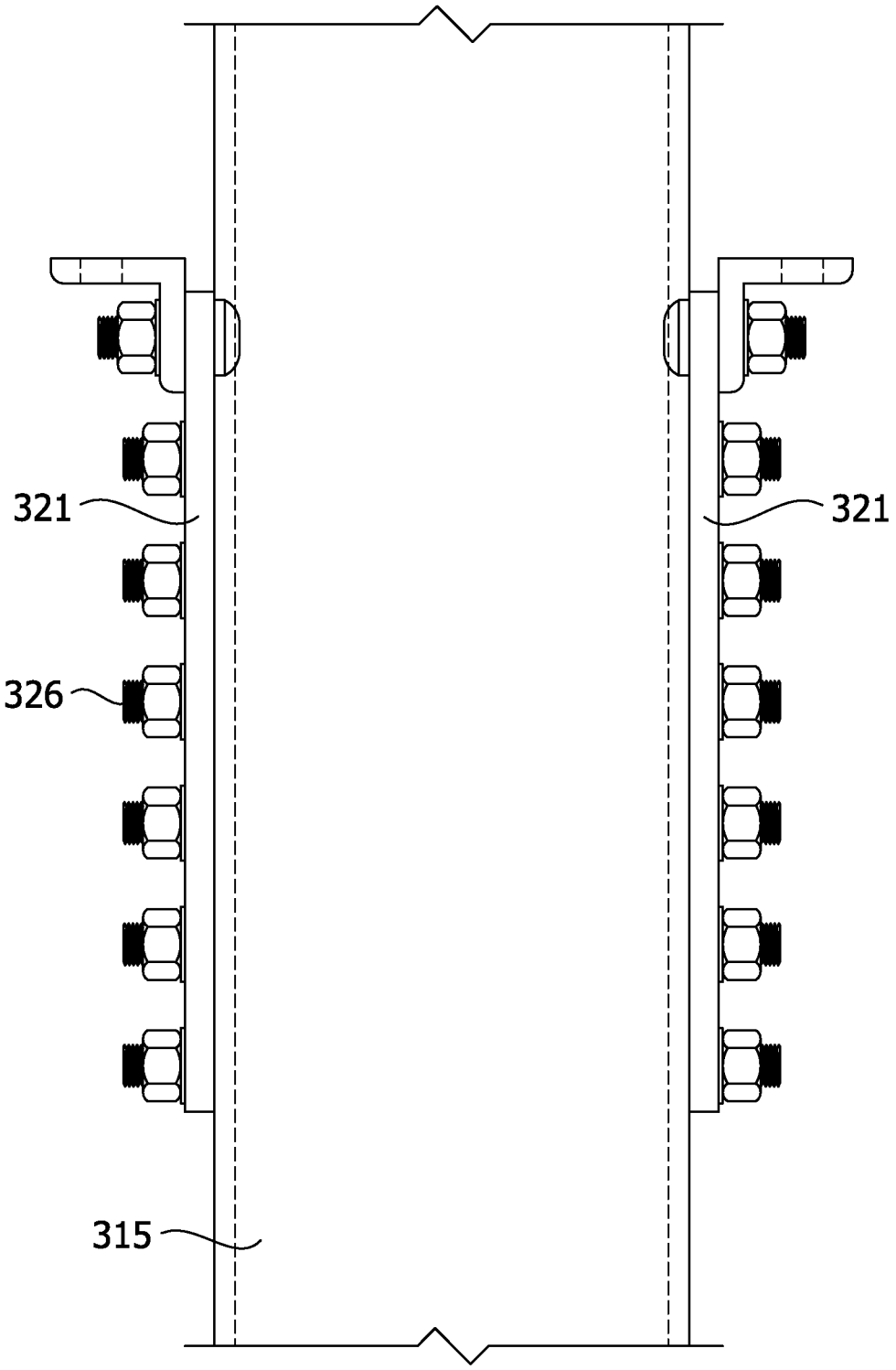
FIG. 37 is a right side view of the column assembly in FIG. 34A.
Figure 38:
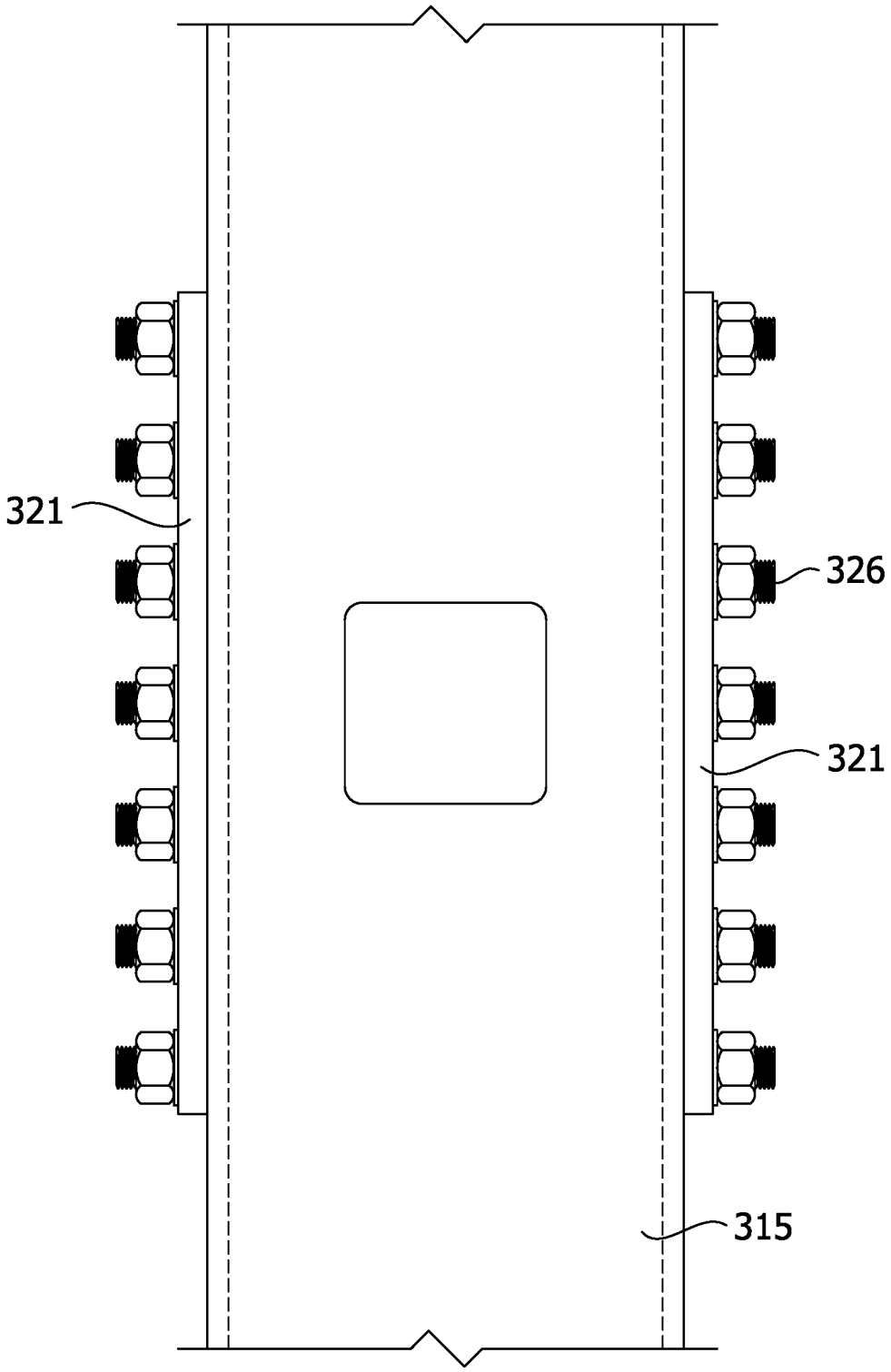
FIG. 38 is a left side view of the column assembly in FIG. 34A.
Figure 39:
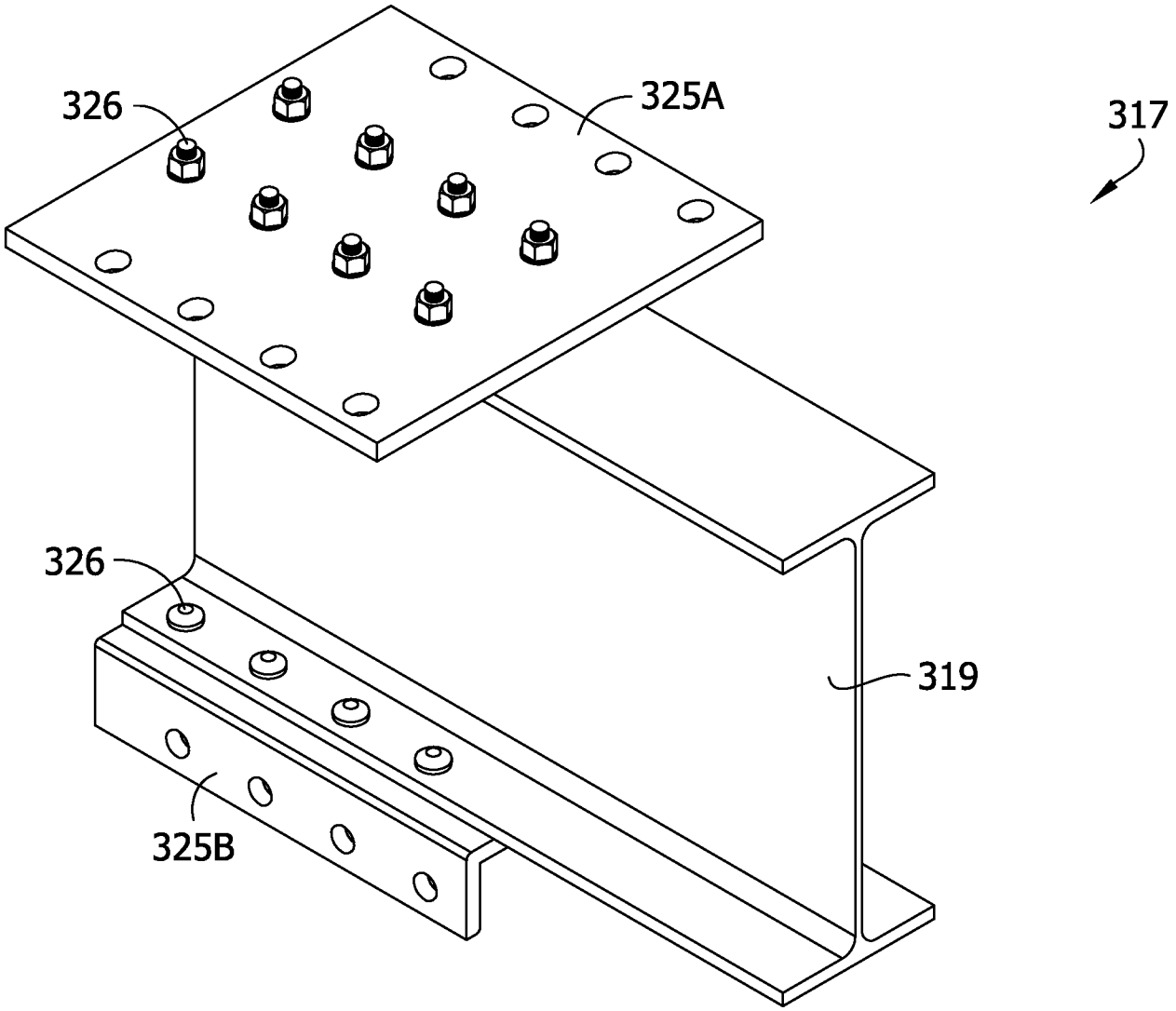
FIG. 39 is a fragmentary perspective of a full-length beam assembly of the beam-to-column joint connection structure in FIGS. 29A and 29B.
Figure 40:
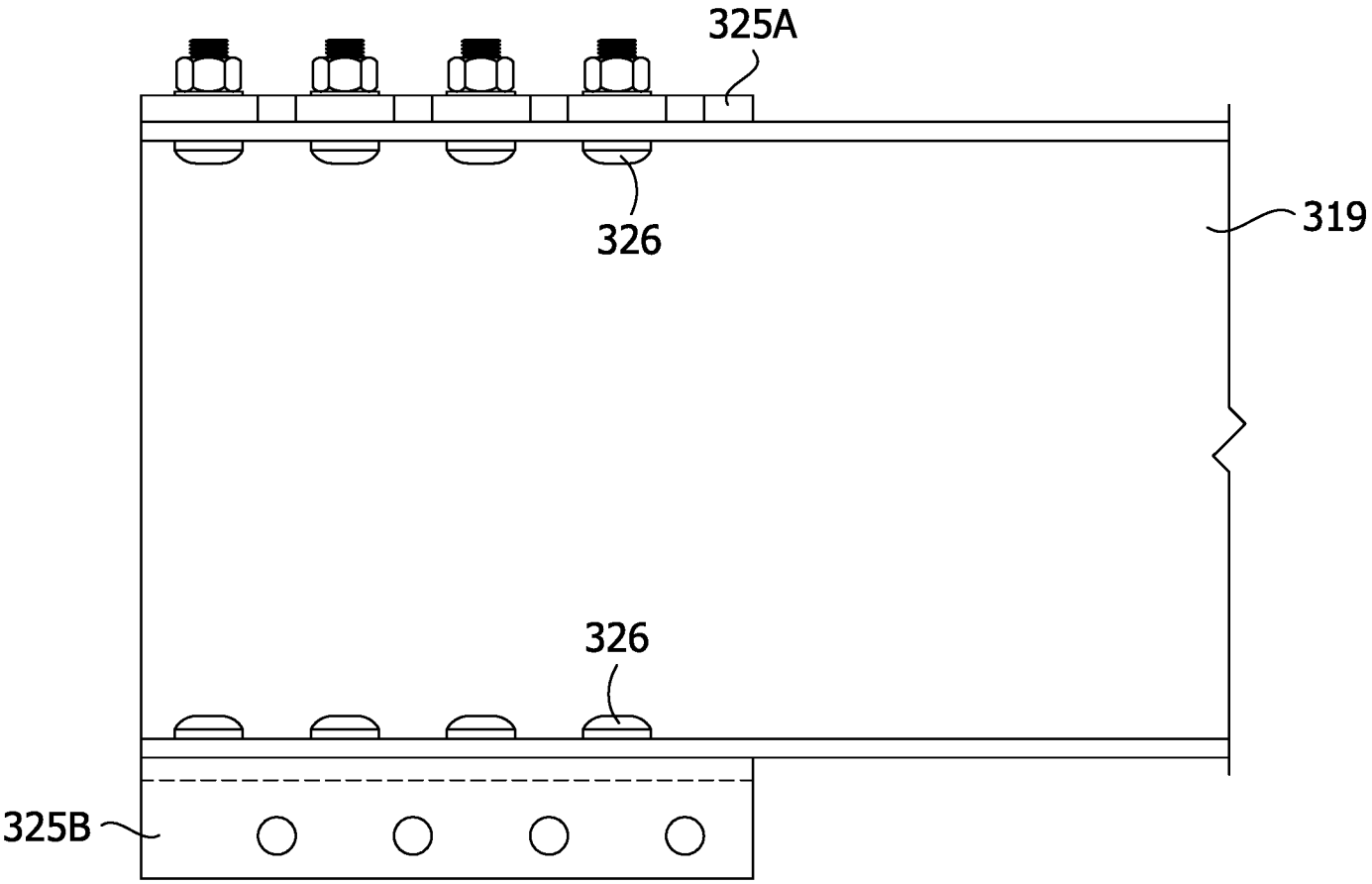
FIG. 40 is a front view of the beam assembly in FIG. 39.
Figure 41:
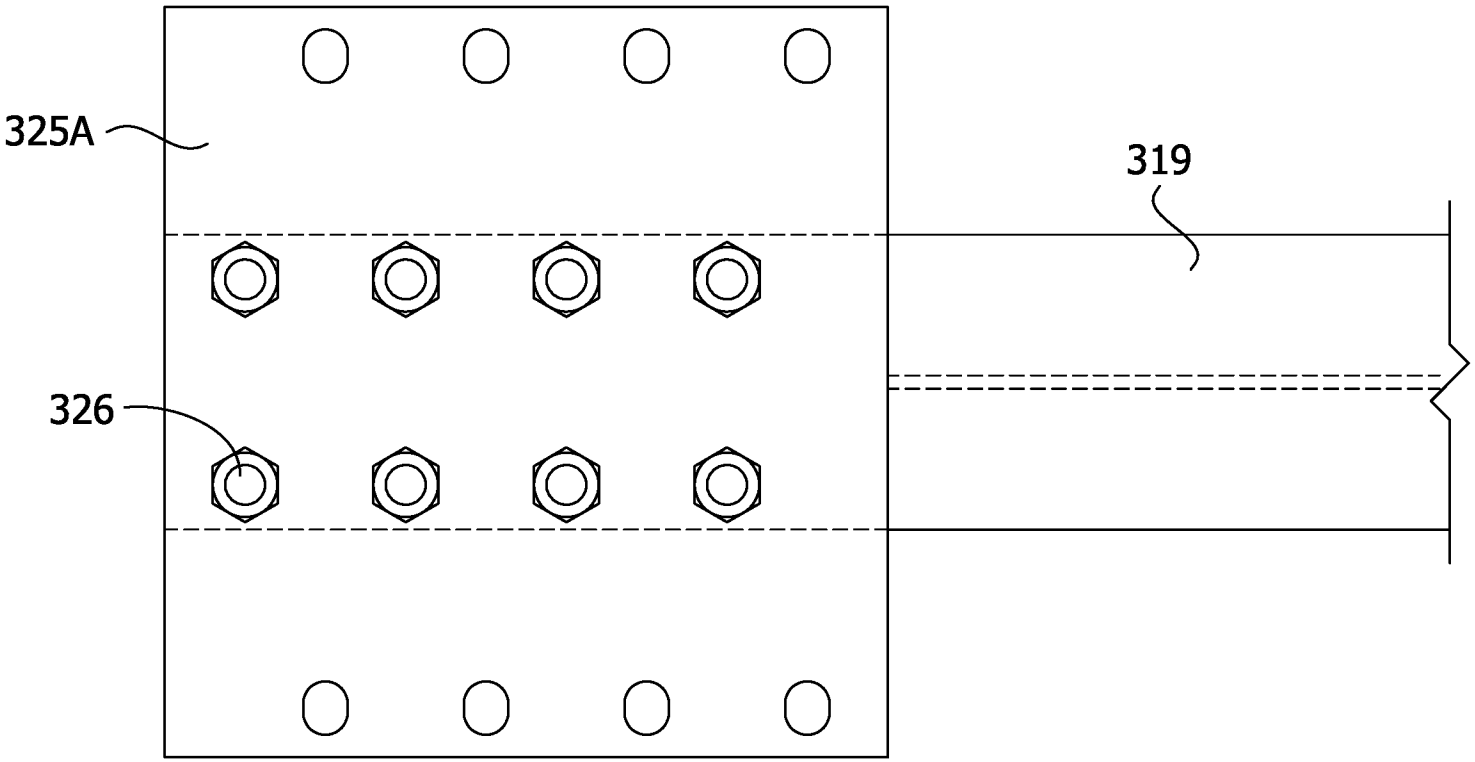
FIG. 41 is a top view of the beam assembly in FIG. 39.
Figure 42:
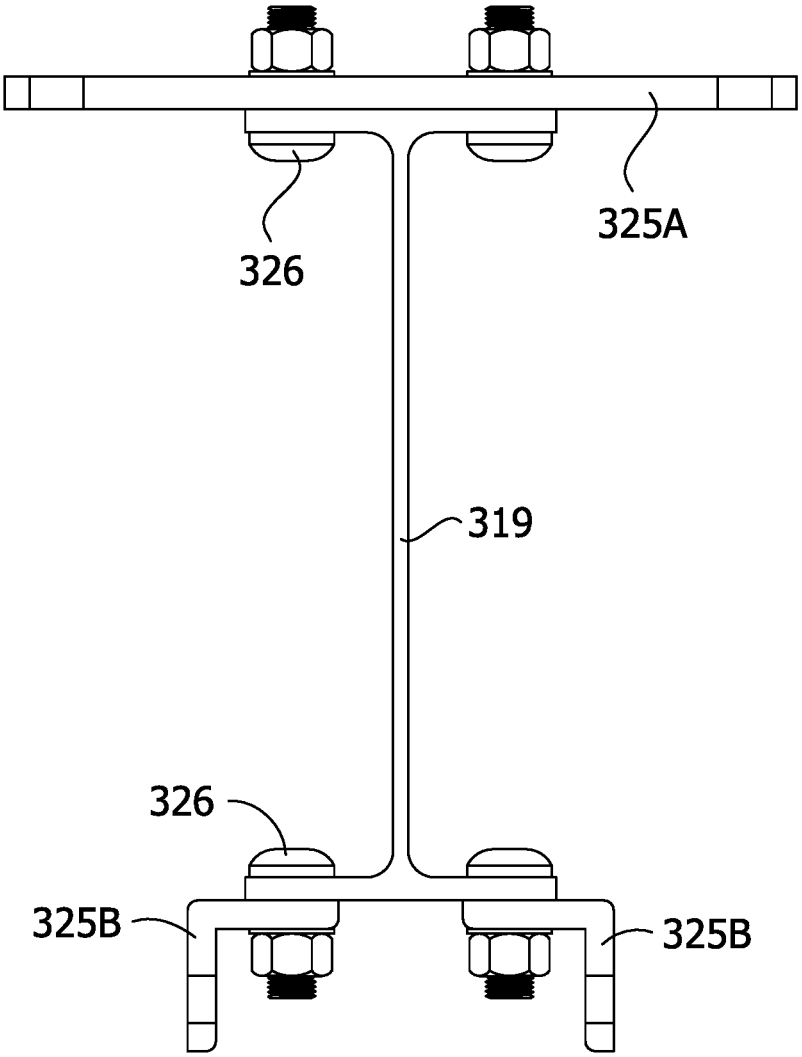
FIG. 42 is a side view of the beam assembly in FIG. 39.
Figure 43:
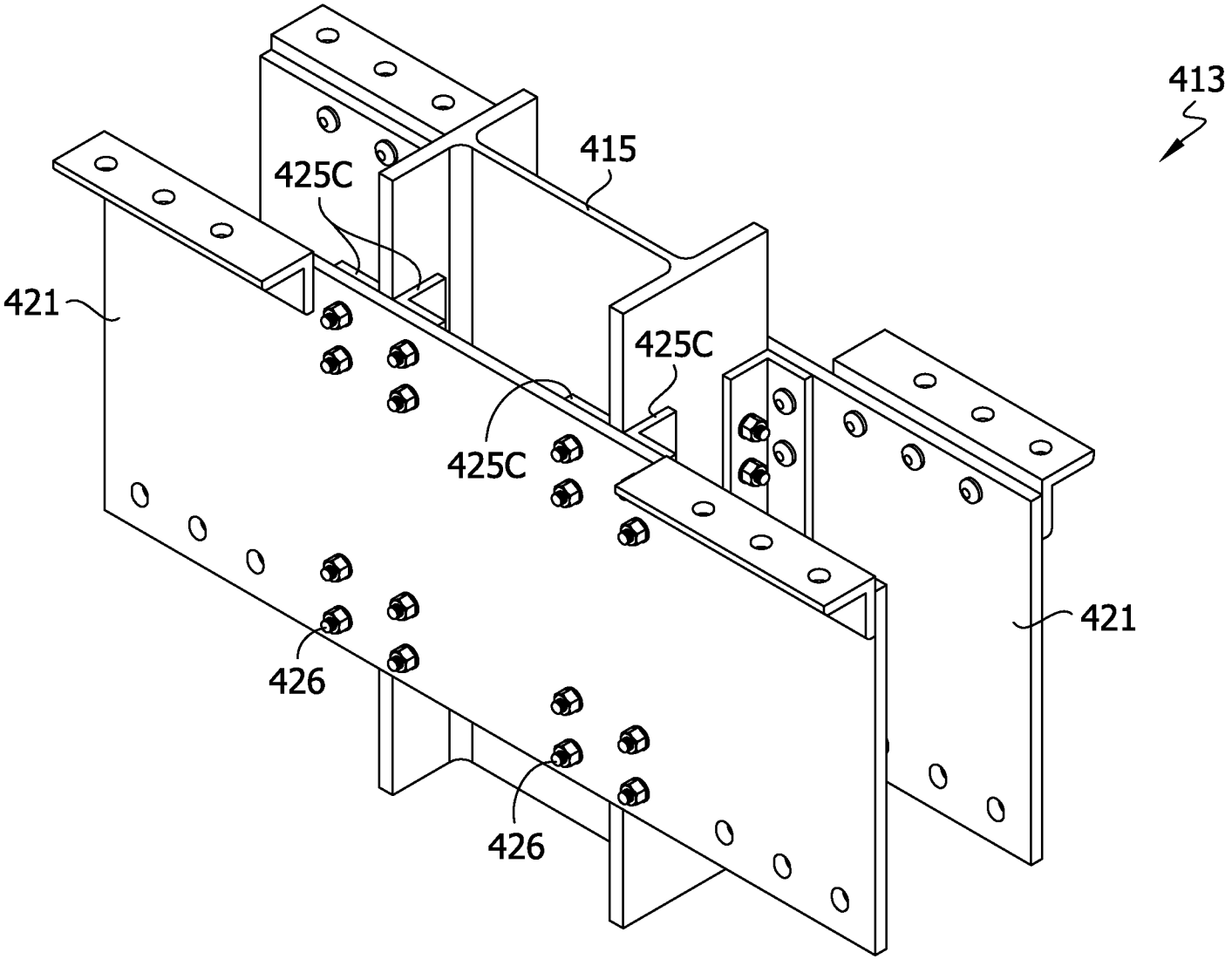
FIG. 43 is a fragmentary perspective of a column assembly of another embodiment for use in a beam-to-column joint connection structure.
Figure 44:
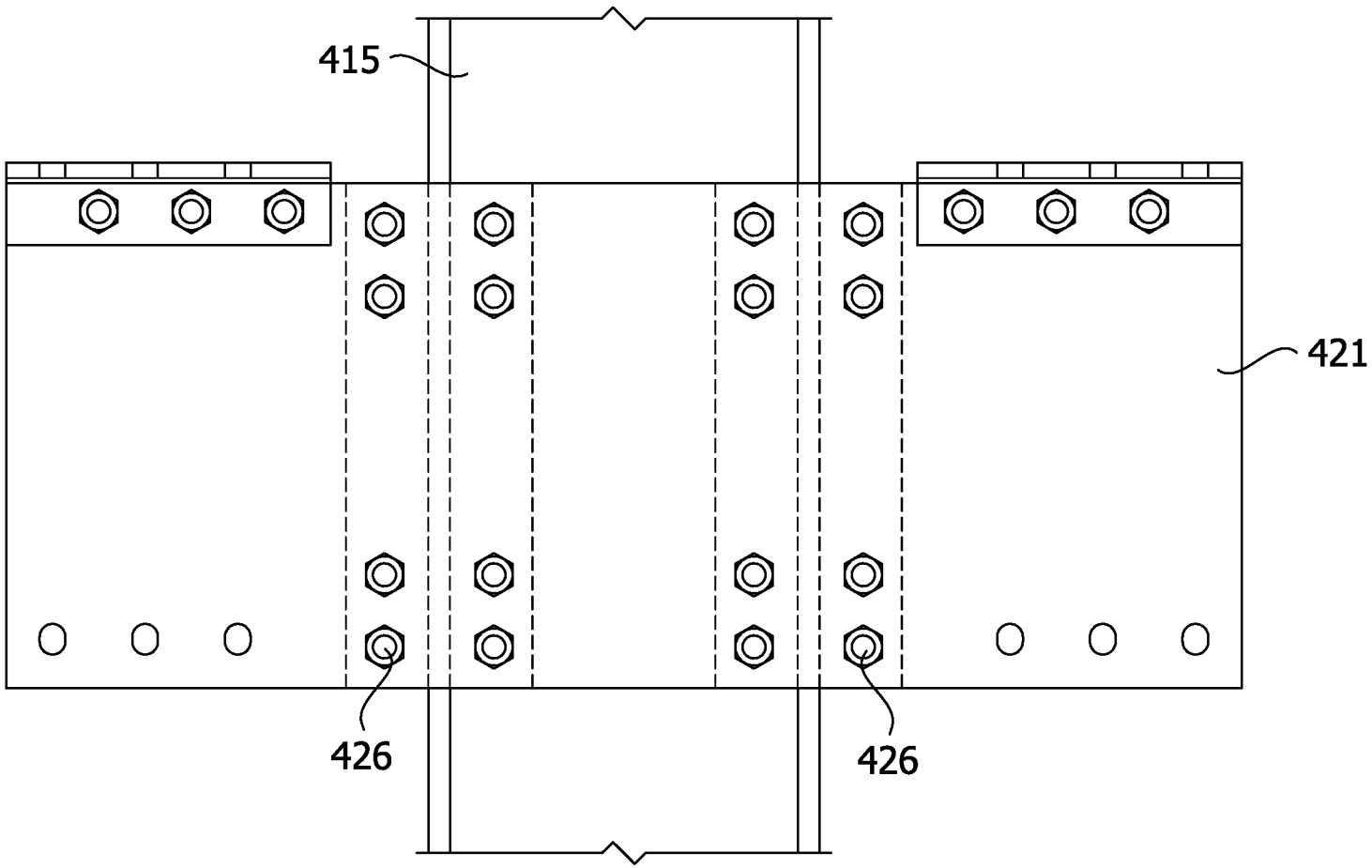
FIG. 44 is a front view of the column assembly in FIG. 43.
Figure 45:
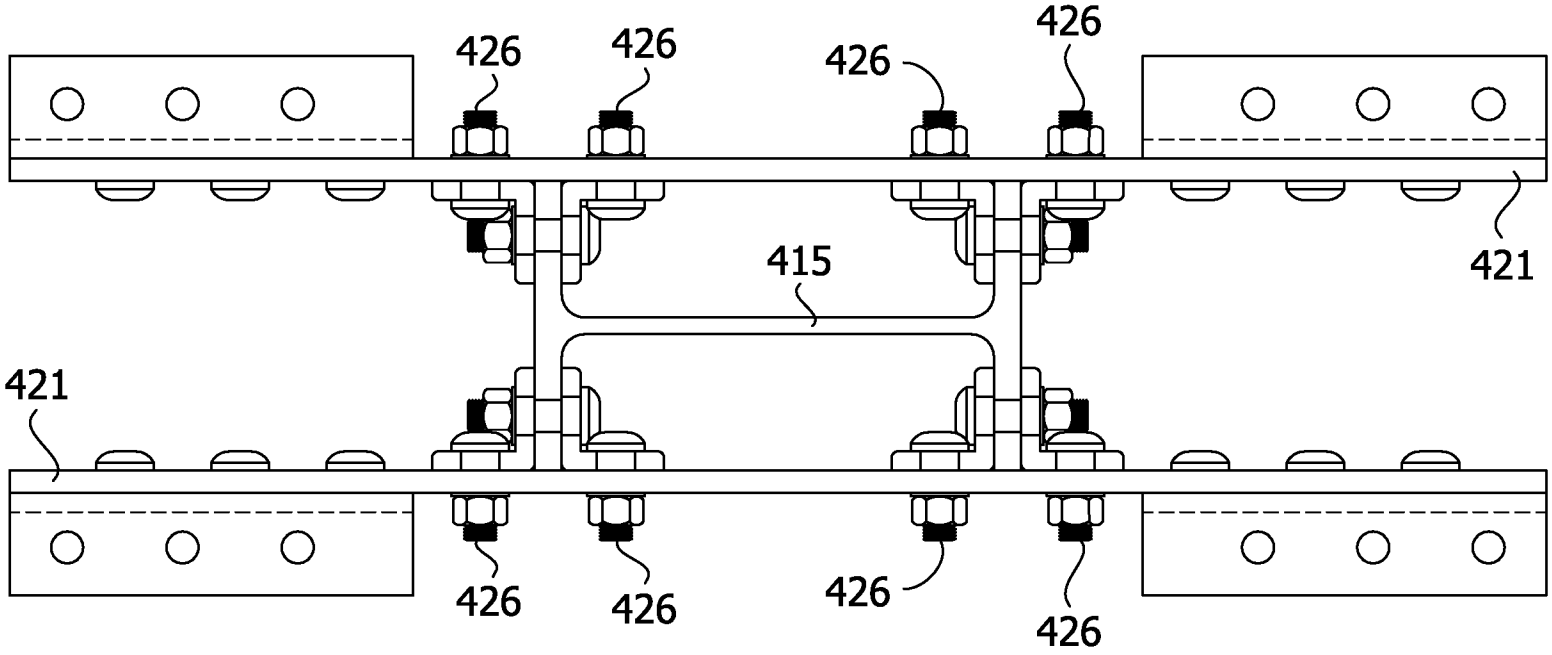
FIG. 45 is a top view of the column assembly in FIG. 43.
Figure 46:
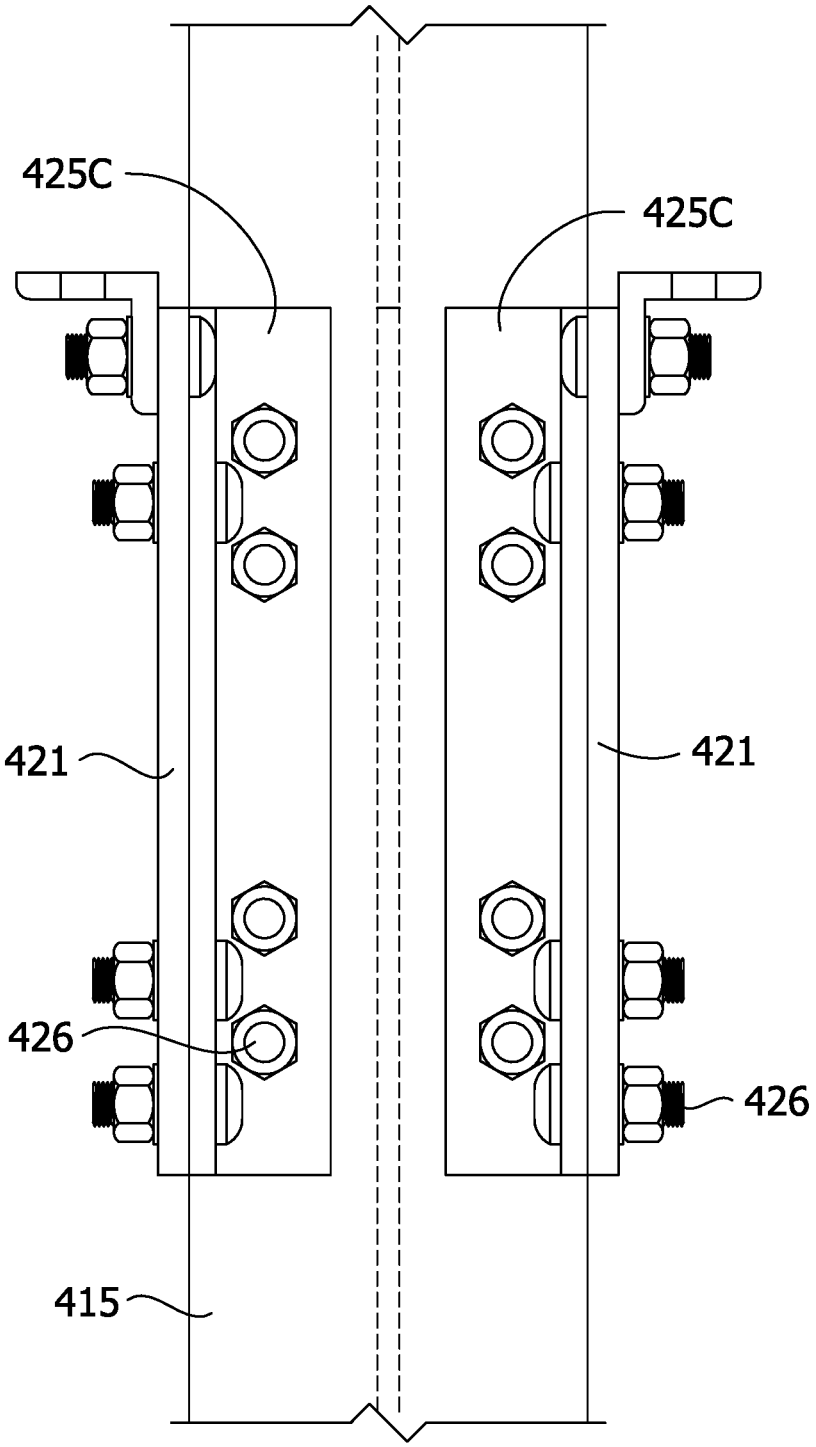
FIG. 46 is a right side view of the column assembly in FIG. 43.
Figure 47:
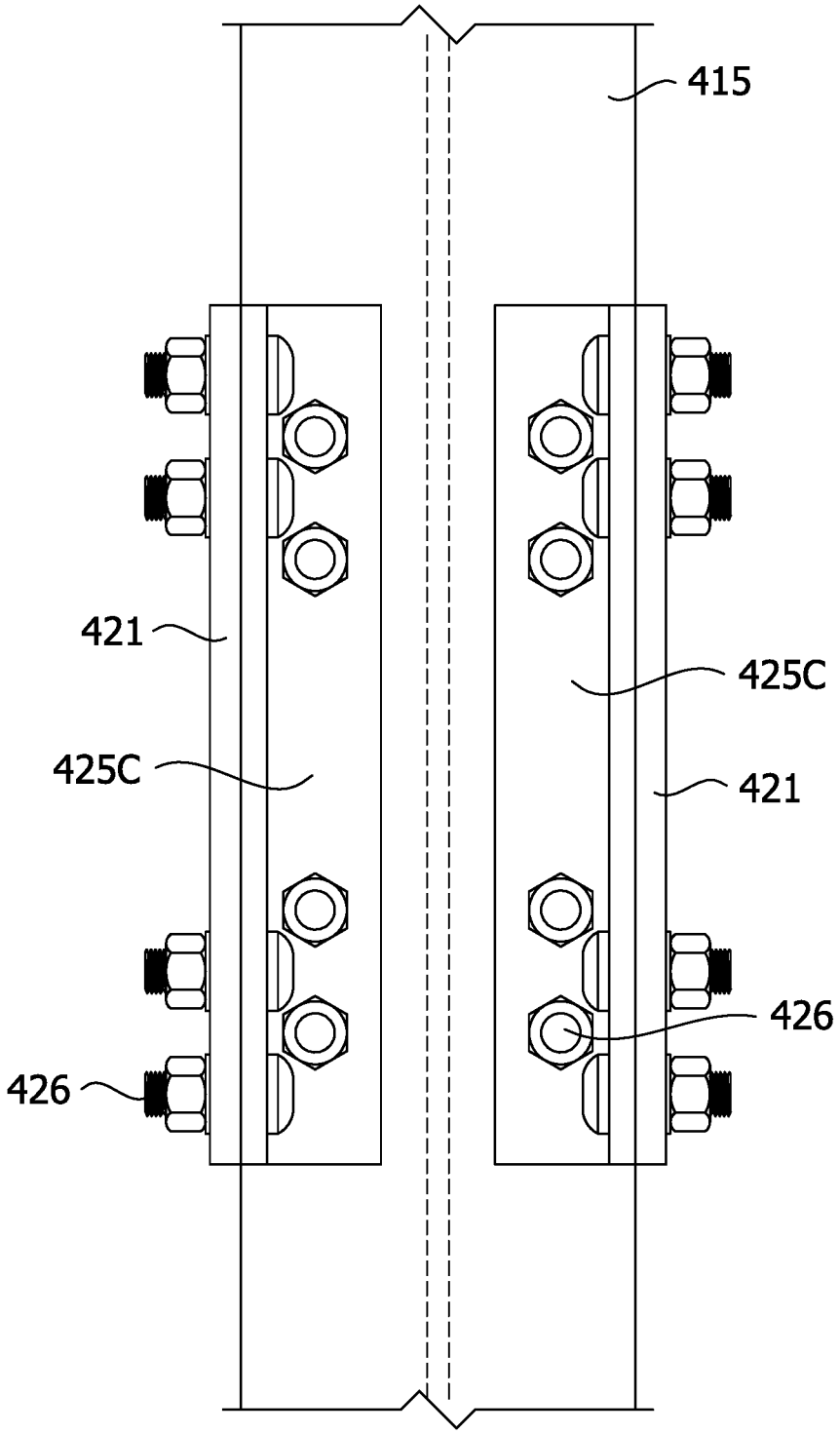
FIG. 47 is a left side view of the column assembly in FIG. 43 with angle irons of the column assembly removed.
Figure 48:
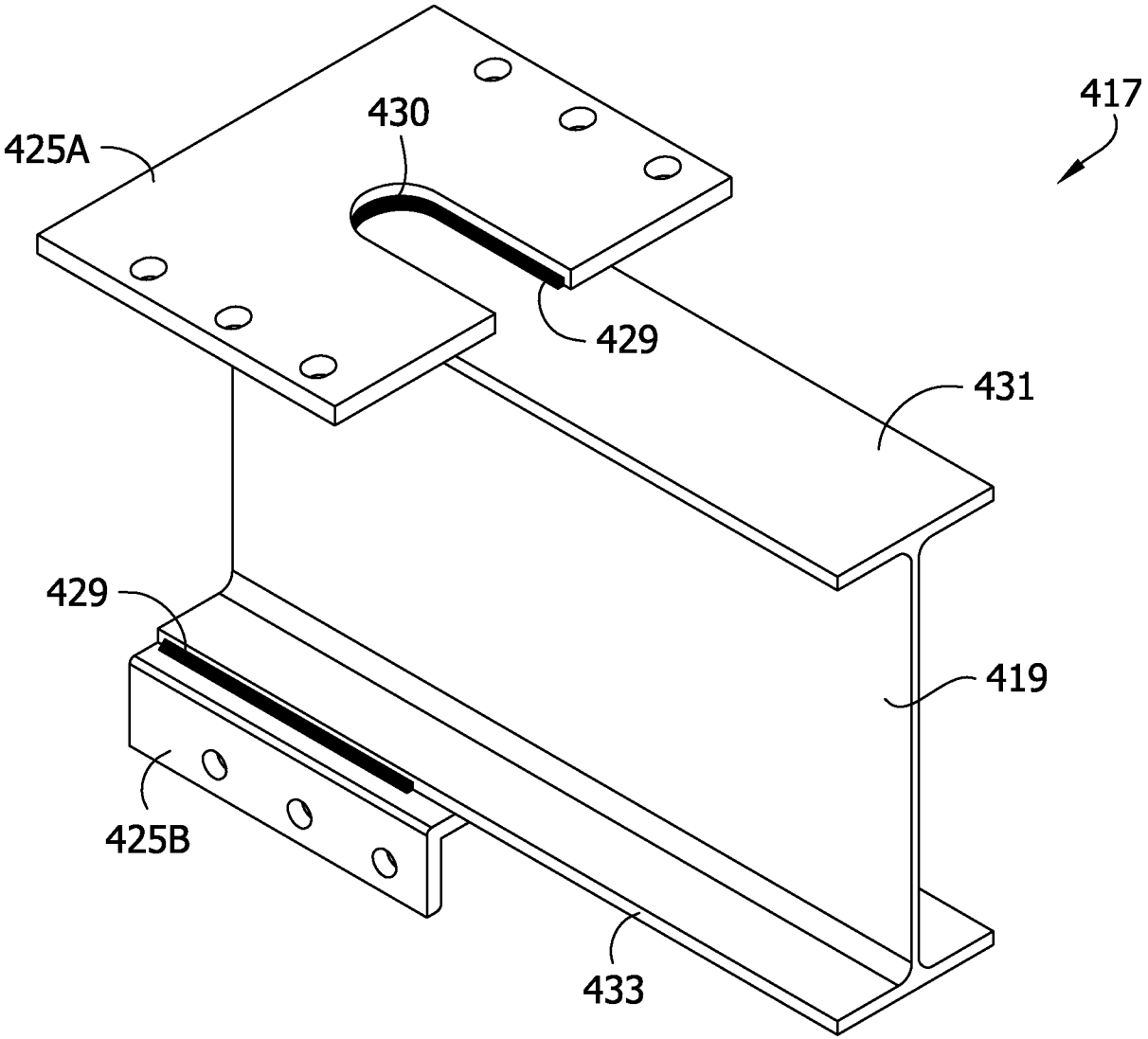
FIG. 48 is a fragmentary perspective of a full-length beam assembly for use with the column assembly in FIG. 43.
Figure 49:
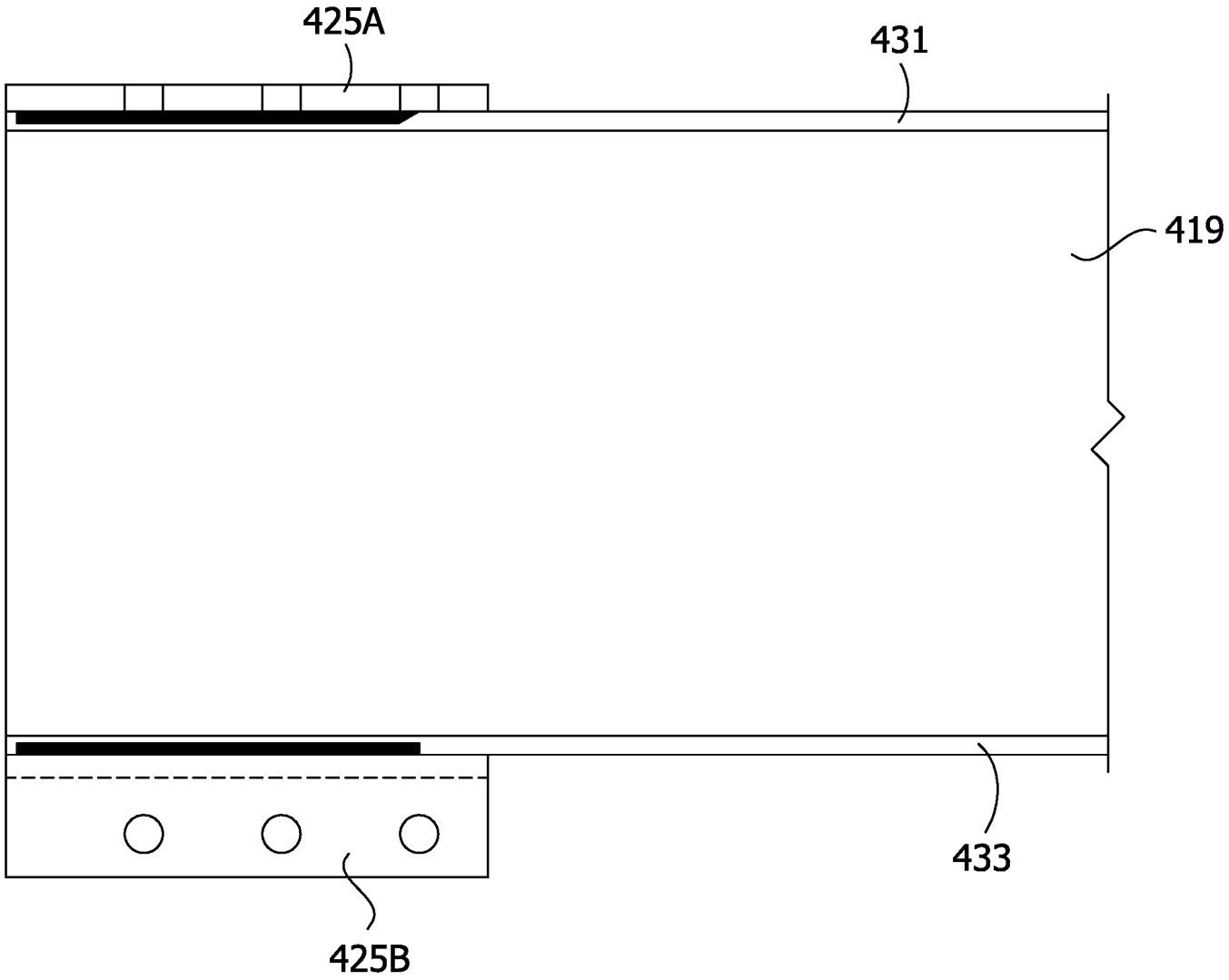
FIG. 49 is a front view of the beam assembly in FIG. 48.
Figure 50:
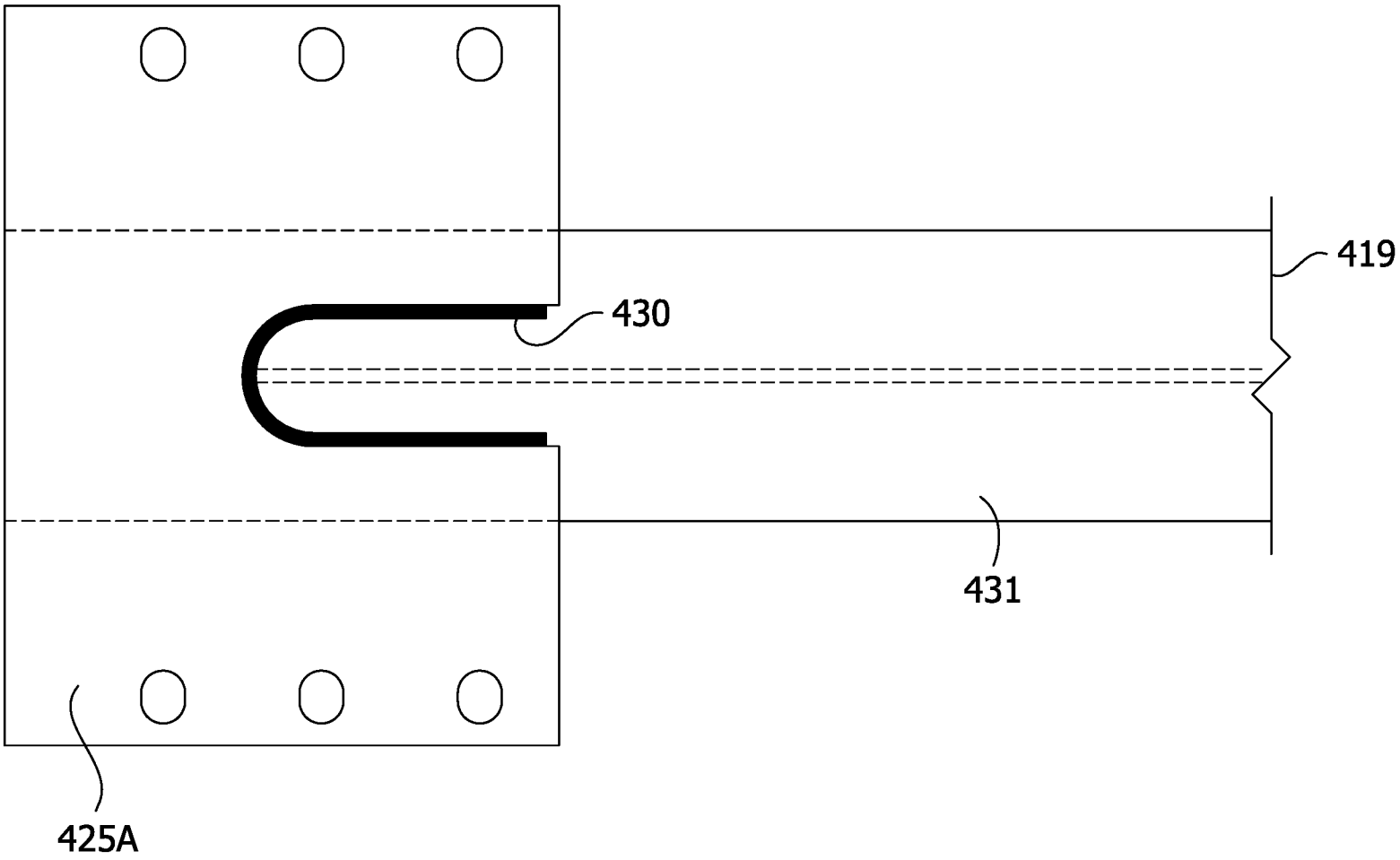
FIG. 50 is a top view of the beam assembly in FIG. 48.
Figure 51:
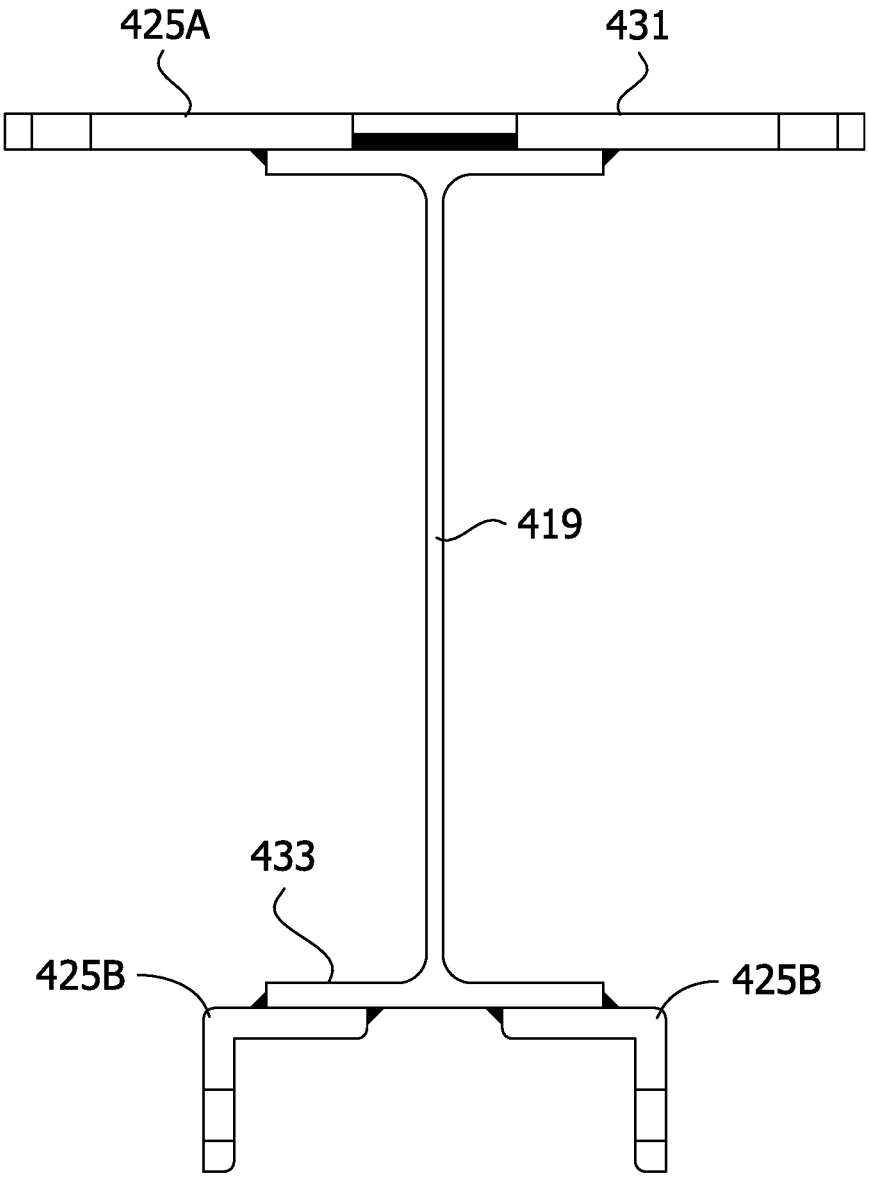
FIG. 51 is a side view of the beam assembly in FIG. 48.

Alternatively, instead of the plurality of horizontally spaced slots 27A, a beam assembly 17' of another embodiment may include a channel 25A' having a single closed oblong radiused opening 37A' extending along the length of the base section 34' of the channel 25A' (FIGS. 11 and 12). In this embodiment, the channel 25A' may be welded to the beam 19' at welds 29'. Welds 29' may be disposed between a transversely extending edge of the base section 34' and the top surface of the upper flange 31' of the beam 19'. Welds 29' may also be disposed between the underside of the base section 34' of the channel 25A' and longitudinally extending side edges of the upper flange 31'. A weld 29' may be disposed in the closed oblong radiused opening 37A'.

Referring to FIGS. 5-7B, a channel 25B (broadly, "a connecting member") may be disposed on a lower flange 33 (broadly, a "bottom surface") of the beam 19 generally at an end of the beam. The channel 25B has a length extending along a length of the beam 19, and a width extending generally perpendicular to the length of the beam 19 and generally parallel to a width of the beam. The width of the channel 25B is greater than the width of the beam 19 such that the channel extends laterally past the longitudinally extending edges of the lower flange 33 of the beam 19 on opposite sides of the beam. The channel 25B is U-shaped in cross section as defined by a horizontal base section 38 attached to the lower flange 33 of the beam 19, and a pair of vertical arms 40 bent downward from the base section in a direction extending generally perpendicular to the length of the beam. The base section 38 of the channel 25B may be attached to the beam 19 in any suitable manner. In one embodiment, the base section 38 of the channel 25B is bolted to the lower flange of the beam 19 by bolts (not shown) extending through bolt holes 26A in the beam aligned with elongate slots 27B in the channel 25B. In the illustrated embodiment, horizontally extending and horizontally spaced apart slots 27B are formed in the base section 38 of the channel 25B and are positionable to align with circular bolt holes 26A in the lower flange 33. The bolt holes 26A are arranged in pairs that are spaced apart along the length of the beam 19. Each slot 27B extends along a direction generally perpendicular to the length of the beam 19, and the slots are spaced apart from an adjacent slot along a direction generally parallel to the length of the beam. In one embodiment, a slot 27B is configured to align with one of the pairs of horizontally spaced bolt holes 26A in the lower flange 33.

The channel 25B connects the gusset plates 21 to the lower flange 33 of the beam 19 when the beam is received between the gusset plates. The horizontal extension of the slots 27B accounts for variations in the lateral spacing between the two bolt holes 26A in a horizontal pair. Thus, the slots 27B ensure that the bolt holes 26A will be aligned within an opening in the channel 25B for receiving bolts to attach the channel to the beam 19. Therefore, the slots 27B provide advantages over circular bolt holes which do not forgive misalignment with the circular bolt holes 26A in the lower flange 33 of the beam 19.

Additionally, at least one of the slots 27B in the channel 25B may be intentionally out of alignment with the horizontal pairs of bolt hole pairs 26A in the lower flange 33 of the beam 19. A misaligned slot 27B may be configured to function as a yield point for the joint connection such that under an extreme load, the joint connection will fail at the channel 25B before the beam 19 or column 15. In the illustrated embodiment, aligned and misaligned slots 27B are alternately disposed along the length of the channel 25B. Accordingly, the horizontal spacing of the bolt holes 26A in the lower flange 33 generally corresponds to the horizontal distance between every other slot 27B in the channel 25B.

As can be seen from the figures, the channel 25B, rather than the beam 19 itself, provides the structure for attaching the gusset plates 21 to the beam. In particular, an outer surface of the arms 40 of the channel 25B are bolted to an inner surface of a respective gusset plate 21 by horizontally spaced bolts (not shown) extending through aligned bolt holes 26A in the arms of the channel and the respective gusset plate. Accordingly, the channel 25B provides the structure for attaching the gusset plates 21 to the beam 19. One advantage of the channel 25B is that it can be produced to very close tolerances (i.e., a closer tolerance than the beam 19) to insure that the connection points for attaching to the gusset plates 21 are properly spaced from each other to allow for connection of the beam assembly 17 to the column assembly 13. This better ensures that the beam assembly 17 can be received between the gusset plates with appropriate clearance for attaching the beam assembly to the column assembly 13 at a construction site.

Alternatively, instead of the plurality of horizontally spaced slots 27B, a beam assembly 17' of another embodiment may include a channel 25B' having a single closed oblong radiused opening (not shown) extending along the length of the base section 38' of the channel 25B' (FIG. 11). In this embodiment, the channel 25B' may be welded to the beam 19' at welds 29'. Welds (not shown) may be disposed between a transversely extending edge of the base section 38' of the channel 25B' and the bottom surface of the lower flange 33' of the beam 19'. Welds 29' may also be disposed between the topside of the base section 38' of the channel 25B' and longitudinally extending side edges of the lower flange 33'. A weld (not shown) may also be disposed in a closed oblong radiused opening (not shown).

In all cases where the channels 25A, 25B, 25C are constructed to yield preferentially over the column 15, beam 19, and gusset plates 21, the joint connection may be repaired after a failure event occurs because the column, beam and gusset plates remain intact. More specifically, it may be possible to replace the channels 25A, 25B, 25C and restore a building to structural soundness after a catastrophic event such as an earthquake.

Referring to FIGS. 13-24 a beam-to-column moment-resisting joint connection structure of another embodiment is generally indicated at 111. The joint connection structure may be used in the construction of a building framework. In the illustrated embodiment, the joint connection joins a column assembly 113 including a column 115 to a full-length beam assembly 117 including a full-length beam 119. In the illustrated embodiment, the column 115 is a hollow rectangular column ("HSS column"). However, the column could have other configurations, such an I-beam, H-beam, or circular shape, without departing from the scope of the disclosure.

The joint connection structure 111 is substantially similar to the first embodiment except the slots 27 in the channels 25A, 25*b* attached to the beam 19 in the first embodiment are removed and instead bolts 126 are received in aligned bolt holes 126A in the channels 125A, 125B and respective flanges 131, 133 of the beam 119 to attach the channels to the beam. Additionally, bolts 126 attach the gusset plates 121 directly to the column 115 (e.g., to a side surface of the column). Thus, the channels 25C attached to the column 15 in the first embodiment are omitted. However, as combinations of features are envisioned, the gusset plates 121 could be connected by channels (not shown) attached to faces of the column 115.

Referring to FIGS. 25-28, a beam-to-column moment-resisting joint connection structure of another embodiment is generally indicated at 211. The joint connection structure 211 may be used in the construction of a building framework. In the illustrated embodiment, the joint connection 211 joins a column assembly 213 including a column 215 to a full-length beam assembly 217 including a full-length beam 219. The joint connection includes a first channel 225A and a second channel 225B bolted to a beam-facing flange 216 (broadly, a "side surface") of the column 215. The beam 219 is received between the channels 225A, 225B and is bolted to the channels to attach the beam to the column 215. One end of each channel 225A, 225B is closed by a channel tab formed with the channel to provide a surface to bolt the channel to the column 215. Channels 225C are bolted to inner surfaces of the flanges 216 of the column 215 to reinforce the column at the joint connection. The bolts extend through the flanges 216 and the channel tabs of the channels 225A, 225B. In this embodiment, a base section 239 of the channels 225C contact and extend across a web 218 of the column 215. Alternatively, the channels 225C could be attached (e.g., bolted) to the column 215 such that arms 241 of the channels engage the outwardly facing surfaces of the column flanges 216. In this embodiment, the channels 225A, 225B on the beam 219 would be bolted directly to the arms of channels 225C thereby attaching channels 225A, 225B to the column 215.

Referring to FIGS. 29A-42, a beam-to-column moment-resisting joint connection structure of another embodiment is generally indicated at 311. The joint connection structure 311 may be used in the construction of a building framework. In the illustrated embodiment, the joint connection 311 joins a column assembly 313 including a column 315 to a full-length beam assembly 317 including a full-length beam 319. Bolts 326 attach the column assembly 313 to the beam assembly 317. Bolts 326 also attach the gusset plates 321 to the column 315, cover plate 325A to the upper flange of the beam 319, and angle irons 325B to the lower flange of the beam.

The angle irons used in any of the embodiments described herein may be formed in a suitable manner. For example and without limitation, the angle irons may be formed by bending a flat plate, forming pieces separately and connecting them together by bolting welding or other suitable connection, and by casting the angle iron as a single piece of material with the arms and base. Casting has certain advantages in being able to precisely control the dimensions and relative positions of the base parts of the angle iron for additional accuracy in making the joint connection. The angle irons may also be formed as fabricated plate sections.

Referring to FIGS. 43-51, a beam-to-column moment-resisting joint connection structure of another embodiment is shown. The joint connection structure may be used in the construction of a building framework. In the illustrated embodiment, the joint connection joins a column assembly 413 including a column 415 to a full-length beam assembly 417 including a full-length beam 419. Bolts (not shown) attach the column assembly 413 to the beam assembly 417. Bolts 426 attach the gusset plates 421 to the column 415. Angle irons 425C are bolted to the inner and outer surfaces of the flanges 416 of the column 415 at a first arm of the angle irons. A second arm of the angle irons 425C is bolted to the gusset plates 421 to attach the gusset plates to the column 415. In the illustrated embodiment, the second arm of each angle iron 425C extends orthogonally from the first arm. A cover plate 425A is welded at 429 to an upper flange 431 of the beam 419 and angle irons 425B are welded to the lower flange 433 of the beam. The cover plate 425A has an oblong radiused slot opening 430 extending along the length of the cover plate.

The channels used in any of the embodiments described herein may be formed in a suitable manner. For example and without limitation, the channels may be formed by bending arms up from a flat plate, forming the arms and base separately and attaching the arms to the base by bolting welding or other suitable connection, and by casting the channel as a single piece of material with the arms and base. Casting has certain advantages in being able to precisely control the dimensions and relative positions of the base and arms for additional accuracy in making the joint connection. The channels and connecting members may also be formed as fabricated plate sections.

Other joint connection structures are disclosed in co-assigned U.S. Pat. No. 9,091,065, the entirety of which is herein incorporated by reference.

OTHER STATEMENTS OF THE INVENTION

AA. A joint connection structure of a building framework comprising:

- a column assembly including a column having a web and flanges on opposite sides of the web;
- a column channel attached to the column and located between the flanges;
- a beam assembly including a beam;
- first and second beam channels, each of the first and second beam channels comprising a base section, arms projecting outward from opposite edges of the beam section, and a channel tab projecting from the base section at an end of the base section; the first and second beam channels being directly connected to the beam;

wherein the channel tab and column channel are directly attached to a flange of the column.

AB. The joint connection structure of AA further comprising bolts extending through the column channel, the column flange and the channel tab of one of the first and second beam channels.

BA. A joint connection structure of a building framework comprising:

a tubular column;

gusset plates bolted to the column on opposite sides thereof;

a gusset plate connector member bolted to the gusset plates;

a beam;

a beam connector bolted to the beam and bolted to the gusset plate connector to attach the beam to the gusset plates.

When introducing elements of the present invention or the one or more embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above apparatuses, systems, and methods without departing from the scope of the invention, it is intended that all matter contained in the above description and shown in the accompanying drawings shall be interpreted as illustrative and not in a limiting sense.

What is claimed is:

1. A prefabricated column assembly comprising:

a column including flanges;

first bolts;

first connecting members bolted to an outer surface of one of the flanges by the first bolts such that the first connecting members contact the outer surface of said one of the flanges;

second connecting members bolted to an inner surface of said one of the flanges by the first bolts such that the second connecting members contact the inner surface of said one of the flanges;

a pair of gusset plates extending laterally outward from the column past the first connecting members at opposite ends of the gusset plates;

second bolts attaching the gusset plates to the first and second connecting members on opposite sides of the column;

wherein the second bolts include a first group of second bolts connecting the gusset plate to the first connecting member, and a second group of second bolts connecting the gusset plate to the first connecting member, the first and second groups of bolts being spaced apart from each other by a distance and free of any other second bolts between the first group and second group, the distance being greater than the separation of adjacent second bolts in the first group from each other or adjacent second bolts in the second group from each other, a space on the gusset plates between the first and second groups of second bolts being free of bolt holes; and third connecting members attached to outer surfaces of the gusset plates by third bolts, wherein the assembly is free of a connecting member on the outer surfaces of the gusset plates between the flanges of the column.

2. The assembly of claim 1, wherein the first connecting members comprise a pair of first connecting members, and the second connecting members comprise a pair of second connecting members.

3. The assembly of claim 1, wherein the first and second connecting members comprise angle irons.

4. The assembly of claim 3, wherein each angle arm includes a first arm bolted to the column and a second arm bolted to a gusset plate.

5. The assembly of claim 1 wherein the first and second connecting members are each formed as one of: bending a plate; connecting separately formed parts; or casting as one piece of material.

6. The assembly of claim 1, wherein the second connecting members extend parallel to a longitudinal axis of the column.

7. The assembly of claim 1, wherein the second connecting members mirror the first connecting members about the flange.

8. The assembly of claim 1, wherein the column is free of welds attaching the connecting members to the flange.

9. The assembly of claim 1, wherein the first and second bolts are vertically offset.

10. The assembly of claim 1, wherein the first and second connecting members are flush with top and bottom edges of the gusset plates.

11. The assembly of claim 1, wherein the assembly is free of bolts extending through both the second and third connecting members, the third connecting members being disposed at a top of the gusset plates.

12. A prefabricated column assembly comprising:

a column including flanges;

first bolts;

first connecting members bolted to an outer surface of one of the flanges by the first bolts such that the first connecting members contact the outer surface of said one of the flanges;

second connecting members bolted to an inner surface of said one of the flanges by the first bolts such that the second connecting members contact the inner surface of said one of the flanges;

a pair of gusset plates extending laterally outward from the column;

second bolts attaching the gusset plates to the first and second connecting members on opposite sides of the column; and third connecting members attached to outer surfaces of the gusset plates by third bolts, wherein the assembly is free of a connecting member on the outer surfaces of the gusset plates between the flanges of the column.

13. The assembly of claim 1, in combination with a beam assembly including a beam, the beam assembly being configured for attachment to the column assembly whereby longitudinal edges of the beam are spaced laterally inward from inner surfaces of the gusset plates so that the beam is received between the gusset plates when the beam assembly is attached to the column assembly.

* * * * *